US005696831A

United States Patent [19]

Inanaga et al.

[11] Patent Number: 5,696,831

[45] Date of Patent: *Dec. 9, 1997

[54] AUDIO REPRODUCING APPARATUS CORRESPONDING TO PICTURE

[75] Inventors: Kiyofumi Inanaga, Kanagawa; Yuji Yamada, Tokyo, both of Japan

[73] Assignee: Sony Corporation, Tokyo, Japan

[ * ] Notice: The term of this patent shall not extend beyond the expiration date of Pat. No. 5,687,239.

[21] Appl. No.: 491,457

[22] Filed: Jun. 16, 1995

[30] Foreign Application Priority Data

Jun. 21, 1994 [JP] Japan ..... 6-139208

[51] Int. Cl.[6] ..... H04R 5/00

[52] U.S. Cl. ..... 381/25; 381/74

[58] Field of Search ..... 381/1, 25, 17, 381/24, 74

[56] References Cited

U.S. PATENT DOCUMENTS 5,181,248 1/1993 Inanaga ..... 381/24

5,452,359 9/1995 Inanaga ..... 381/74

5,495,534 2/1996 Inanaga ..... 381/74

5,526,429 6/1996 Inanaga ..... 381/25

*Primary Examiner*—Minsun Oh

*Attorney, Agent, or Firm*—Jay H. Maioli

[57] ABSTRACT

Audio reproducing apparatus reproducing an audio signal corresponding to a picture which localizes a sound image in a direction corresponding to the picture by processing an audio signal in a real-time fashion is supplied with an audio signal from a general-purpose signal source such as a laser disc a digital vibratory gyroscope detects a rotational angle of a listener's head. In response to the detected rotational angle, the audio reproducing apparatus subjects the audio signal to a predetermined signal processing in a real-time fashion. Thus, a sound image is localized in the direction corresponding to the picture projected on a screen from a projector.

33 Claims, 31 Drawing Sheets

FIGURE 6

| $\theta$ | Table Address | Impulse Response | | | $h_{m,n}(t,\theta)$ |
|---|---|---|---|---|---|
| | | $h_{LL}(t,\theta)$ | $h_{LR}(t,\theta)$ | $h_{RL}(t,\theta)$ | $h_{RR}(t,\theta)$ |
| 0° | 0 | $h_{LL}(t,0)$ | $h_{LR}(t,0)$ | $h_{RL}(t,0)$ | $h_{RR}(t,0)$ |
| 2° | 1 | $h_{LL}(t,1)$ | $h_{LR}(t,1)$ | $h_{RL}(t,1)$ | $h_{RR}(t,1)$ |
| 4° | 2 | $h_{LL}(t,2)$ | $h_{LR}(t,2)$ | $h_{RL}(t,2)$ | $h_{RR}(t,2)$ |
| 6° | 3 | $h_{LL}(t,3)$ | $h_{LR}(t,3)$ | $h_{RL}(t,3)$ | $h_{RR}(t,3)$ |
| ⋮ | 4 ⋮ | ⋮ | ⋮ | ⋮ | ⋮ |
| 358° | 179 | $h_{LL}(t,358)$ | $h_{LR}(t,358)$ | $h_{RL}(t,358)$ | $h_{RR}(t,358)$ |

FIGURE 8

| θ | TABLE ADDRESS | CONTROL DATA $\Delta T_{IJ}(\theta)$, $\Delta L_{IJ}(\theta)$ | | | |
|---|---|---|---|---|---|
| | | $\Delta T_{LL}(\theta), \Delta L_{LL}(\theta)$ | $\Delta T_{LR}(\theta), \Delta L_{LR}(\theta)$ | $\Delta T_{RL}(\theta), \Delta L_{RL}(\theta)$ | $\Delta T_{RR}(\theta), \Delta L_{RR}(\theta)$ |
| 0° | 0 | $\Delta T_{LL}(0), \Delta L_{IJ}(0)$ | $\Delta T_{LR}(0), \Delta L_{LR}(0)$ | $\Delta T_{RL}(0), \Delta L_{RL}(0)$ | $\Delta T_{RR}(0), \Delta L_{RR}(0)$ |
| 2° | 1 | $\Delta T_{LL}(1), \Delta L_{LL}(1)$ | $\Delta T_{LR}(1), \Delta L_{LR}(1)$ | $\Delta T_{RL}(1), \Delta L_{RL}(1)$ | $\Delta T_{RR}(1), \Delta L_{RR}(1)$ |
| 4° | 2 | $\Delta T_{LL}(2), \Delta L_{LL}(2)$ | $\Delta T_{LR}(2), \Delta L_{LR}(2)$ | $\Delta T_{RL}(2), \Delta L_{RL}(2)$ | $\Delta T_{RR}(2), \Delta L_{RR}(2)$ |
| 6° | 3 | $\Delta T_{LL}(3), \Delta L_{LL}(3)$ | $\Delta T_{LR}(3), \Delta L_{LR}(3)$ | $\Delta T_{RL}(3), \Delta L_{RL}(3)$ | $\Delta T_{RR}(3), \Delta L_{RR}(3)$ |
| ⋮ | ⋮ | ⋮ | ⋮ | ⋮ | ⋮ |
| 358° | 179 | $\Delta T_{LL}(179), \Delta L_{LL}(179)$ | $\Delta T_{LR}(179), \Delta L_{LR}(179)$ | $\Delta T_{RL}(179), \Delta L_{RL}(179)$ | $\Delta T_{RR}(179), \Delta L_{RR}(179)$ |

FIGURE 9

| $\theta$ | TABLE ADDRESS | CONTROL DATA $T_{IJ}(\theta)$, $L_{IJ}(\theta)$ | | | |
|---|---|---|---|---|---|
| | | $T_{LL}(\theta), L_{LL}(\theta)$ | $T_{LR}(\theta), L_{LR}(\theta)$ | $T_{RL}(\theta), L_{RL}(\theta)$ | $T_{RR}(\theta), L_{RR}(\theta)$ |
| 0° | 0 | $T_{LL}(0), L_{IJ}(0)$ | $T_{LR}(0), L_{LR}(0)$ | $T_{RL}(0), L_{RL}(0)$ | $T_{RR}(0), L_{RR}(0)$ |
| 2° | 1 | $T_{LL}(1), L_{LL}(1)$ | $T_{LR}(1), L_{LR}(1)$ | $T_{RL}(1), L_{RL}(1)$ | $T_{RR}(1), L_{RR}(1)$ |
| 4° | 2 | $T_{LL}(2), L_{LL}(2)$ | $T_{L}(2), L_{LR}(2)$ | $T_{RL}(2), L_{RL}(2)$ | $T_{RR}(2), L_{RR}(2)$ |
| 6° | 3 | $T_{LL}(3), L_{LL}(3)$ | $T_{LR}(3), L_{LR}(3)$ | $T_{RL}(3), L_{RL}(3)$ | $T_{RR}(3), L_{RR}(3)$ |
| ⋮ | ⋮ | ⋮ | ⋮ | ⋮ | ⋮ |
| 358° | 179 | $T_{LL}(179), L_{LL}(179)$ | $T_{LR}(179), L_{LR}(179)$ | $T_{RL}(179), L_{RL}(179)$ | $T_{RR}(179), L_{RR}(179)$ |

AUDIO REPRODUCING APPARATUS CORRESPONDING TO PICTURE

BACKGROUND

1. Field of the Invention

The present invention relates to an audio reproducing apparatus suitable for use in reproduction of an audio signal corresponding to a picture through a headphone.

2. Background of the Invention

There has been proposed a method of reproducing an audio signal using a headphone which a listener puts on the head with his both ears covered therewith listens to the audio signal from the both ears. When the method of reproducing the audio signal through the headphone is employed, there occurs a phenomenon referred to as a so-called lateralization in which a reproduced sound image is perceived inside the listener's head even if the audio signal from a signal source is a stereophonic signal.

On the other hand, the system of reproducing the audio signal through the headphone includes a binaural sound-wave pickup and reproduction system. The binaural sound-wave pickup and reproduction system will be described below. Microphones, so-called dummy-head microphones, are located in left and right auricles of a dummy head which assumes the place of the listener's head. An audio signal from a signal source is picked up by the dummy-head microphones. When the audio signal thus picked up is reproduced and the listener actually listens to the reproduced audio signal with the headphone, the listener can obtain presence with which the listener feels as if he listened to the sounds directly from the signal source. According to the binaural sound-wave pickup and reproduction system, it is possible to improve the picked-up and reproduced sound image in directivity, localization, presence and so on. However, when the above-mentioned binaural reproduction is carried out, it is necessary to provide a special source which is picked up by the dummy-head microphones as a sound source signal which is different from that used for reproduction with speakers.

It has been proposed to achieve, by applying the above-mentioned binaural sound-wave pickup and reproduction system, a reproduction effect in which a general stereophonic signal is reproduced through the headphone and a reproduced sound image is localized outside the head (at a speaker position) similar to the reproduction by the speakers. With this arrangement, when the headphone is used for reproduction, the same effect as the reproduction with the speakers is achieved and an effect in which the reproduced sound is prevented from leaking is further achieved because the headphone is used. However, when stereophonic reproduction is carried out by using the speakers, even if the listener changes the direction of his head (face), absolute direction and position of a sound image are not changed and only relative direction and position of the sound image that the listener perceives are changed. On the other hand, in the case of the binaural reproduction using the headphone, even if the listener changes his head (face), the relative direction and position of the sound image which the listener perceives are not changed. Therefore, even if the binaural reproduction is carried out by using the headphone, then when the listener changes the direction of the head (face), the sound image is formed inside the listener's head. It is difficult to effect a so-called forward localization, i.e., to localize the sound image in front of the listener. Moreover, in this case, the sound image tends to be elevated above the head and hence becomes unnatural.

According to a reproduction method using headphone disclosed in Japanese patent publication No. 42-227, the following binaural reproduction system using headphone is proposed. Specifically, directivity and localization of a sound image are determined by difference in volume, time, phase and so on between sounds perceived by left and right ears of the listener. The system disclosed in the above publication has a level control circuit and a variable delay circuit connected to signal lines of left and right channels and also has a gyroscope for detecting the direction of the listener's head. The level control circuit and the variable delay circuit for the audio signal in each of the left and right channels are controlled based on a signal representing the detected direction of the listener's head.

In the above-mentioned reproduction method using the headphone disclosed in Japanese patent publication No. 42-227, however, a motor is driven directly by the detection signal representing the direction of the listener's head and a variable resistor and a variable capacitor in the level control circuit and the variable delay circuit are mechanically controlled based on an analog signal by using the motor. Therefore, after the listener has turned the head, a delay of time occurs before the differences in volume and time between the audio signals of the respective channels supplied to the headphone are changed. It is impossible for the disclosed reproduction system to sufficiently follow the movement of the listener's head.

According to the reproduction method using headphone disclosed in Japanese patent publication No. 42-227, characteristics obtained when the differences in volume and time are changed must be determined based on a relative positional relationship between a sound source and the listener, a shape of the listener's head, shapes of listener's auricles and so on. Specifically, if the above characteristics are limited to a certain characteristic, then the relative positional relationship between the sound source and the listener is fixed. Therefore, a sense of distance and a distance between the sound sources cannot be changed. Further, since each listener's head and auricles are different, the same effects are not always achieved. Moreover, in the above publication, there is not disclosed means for correcting characteristics inherent in sound sources used when transfer functions from a virtual sound source to the listener's ears is measured and characteristics inherent in the headphone used by the listener. Especially, since the characteristics are changed considerably depending on the headphone used, the reproduced state is changed.

A stereophonic reproduction system disclosed in Japanese patent publication No. 54-19242 described that a relationship between the listener's head direction detected by a gyroscope and change amounts of differences in volume and time between audio signals in both channels which are supplied to the headphone can be continuously calculated.

However, the stereophonic reproduction system in the above Japanese patent publication No. 54-19242 requires a memory of a huge capacity for continuously calculating and storing the relationship of the change amounts of the differences in volume and time between the audio signals. Thus, it is very difficult to realize such stereophonic reproduction system. Moreover, the above publication did not disclose a means for correcting the characteristics inherent in sound sources used when transfer functions from the virtual sound source to the listener's ears is measured and the characteristics inherent in the headphone used by the listener.

According to an audio reproduction apparatus disclosed in Japanese laid-open patent publication No. 01-112900 filed by the same assignee of the present invention, there is provided an apparatus for discretely, not continuously, calculating data of the relationship between the change amounts of the differences in volume and time between audio signals and processing the audio signals.

However, the audio reproduction system disclosed in the Japanese laid-open patent publication No. 01-112900 presents only a principle concept that can be applied to both analog and digital signal processings and lacks a specific description required when the audio reproduction apparatus effects the analog or digital signal processing and is applied to actual products. Moreover, in the above publication, there is not disclosed the means for correcting the characteristics inherent in sound sources used when transfer functions from a virtual sound source to the listener's ears is measured and the characteristics inherent in the headphone used by the listener.

According to an audio-signal reproduction apparatus disclosed in Japanese laid-open patent publication No. 03-214897 filed by the same assignee of the present invention, transfer functions from respective virtual sound source positions to listener's ears are fixed and subjected to signal processing and then levels and delay times of signals supplied to the ears are controlled in response to an angle of head gyration. Therefore, it is possible to simplify an arrangement and save a large storage capacity of the memory.

Each of the above-mentioned reproduction methods using a headphone, the stereophonic reproduction system, the audio reproduction apparatus and the audio-signal reproduction apparatus requires a large-capacity memory for signal processing and cannot be realized without a digital signal processing. However, each of the above publications does not disclose a specific signal processing and specific means and method for realizing the signal processing. Therefore, there is then the disadvantage that it is difficult to put each of the systems and apparatus into a practical use.

Each of the above-mentioned reproduction methods using a headphone, the stereophonic reproduction system, the audio reproduction apparatus and the audio-signal reproduction apparatus requires a special sound source for each of the above-mentioned reproduction system. There is then the disadvantage that it is impossible to use a reproduction sound source of a general-purpose audio reproducing apparatus.

In each of the above-mentioned reproduction methods using a headphone, the stereophonic reproduction system, the audio reproduction apparatus and the audio-signal reproduction apparatus, although every listener has a different shape of ears because of the difference among the individuals, the headphones used therein have the same shape. There is then the disadvantage that there is not provided means for correcting differences in the shapes of the ears of the listener due to the difference among the individuals.

In each of the above-mentioned reproduction methods using a headphone, the stereophonic reproduction system, the audio reproduction apparatus and the audio-signal reproduction apparatus, it is frequently observed that a positional relationship between the ears and the headphones is different each time the listener wears the headphone. However, there is then the disadvantage that means for correcting differences in the positional relationship is not provided.

In each of the above-mentioned reproduction methods using a headphone, the stereophonic reproduction system, the audio reproduction apparatus and the audio-signal reproduction apparatus, a reproduced sound is different depending upon characteristics of the headphone to be used. However, there is then the disadvantage that means for correcting difference in the reproduced sound is not provided.

Each of the above-mentioned reproduction method using a headphone, the stereophonic reproduction system, the audio reproduction apparatus and the audio-signal reproduction apparatus is encountered with the disadvantage that it is difficult to localize a reproduced sound image in an arbitrary direction, particularly in front of the listener.

Human beings recognize an audio signal on the basis of a visual information and a localization of the sound image is influenced by the visual information. However, each of the above-mentioned reproduction methods using a headphone, the stereophonic reproduction system, the audio reproduction apparatus and the audio-signal reproduction apparatus is encountered with the disadvantage that each of the above-mentioned publications refers to only the audio signal and does not refer to the reproduction of an audio signal corresponding to a video signal.

In each of the above-mentioned reproduction methods using a headphone, the stereophonic reproduction system, the audio reproduction apparatus and the audio-signal reproduction apparatus, it is necessary for an angle detecting apparatus to detect a gyration of a head of the listener with respect to a reference position and direction and outputting a signal to have small size in scale and light weight and detect a signal indicative of an angle of a head gyration in a real-time fashion. However, there is then the disadvantage that each of the above-mentioned publications does not refer to the required angle detecting apparatus.

Each of the above-mentioned reproduction methods using a headphone, the stereophonic reproduction system, the audio reproduction apparatus and the audio-signal reproduction apparatus is encountered with the disadvantage that when the listener puts the headphone on the head, the listener feels unsatisfactory because a sound generator unit presses the listener's ears.

Although each of the above-mentioned reproduction methods using a headphone, the stereophonic reproduction system, the audio reproduction apparatus and the audio-signal reproduction apparatus is encountered with a request that the sound field and reverberation which allows the listener to feel as if the listener listened to sounds through specific speakers or in a concert hall are added to reproduced signals during the above-mentioned signal processings, there is then the disadvantage that each of the above-mentioned publications does not disclose a means for adding such sound field and reverberation and a means for independently switching a degree of added reverberation.

Although each of the above-mentioned reproduction methods using a headphone, the stereophonic reproduction system, the audio reproduction apparatus and the audio-signal reproduction apparatus is encountered with a request that an impulse responses to a sound field from a virtual sound source position with respect to reference position and direction of a listener's head to both ears of the listener, which are fixed, is replaced, there is then the disadvantage that each of the above-mentioned publications does not disclose a means for changing a sound field to be reproduced.

Although each of the above-mentioned reproduction method using a headphone, the stereophonic reproduction system, the audio reproduction apparatus and the audio-signal reproduction apparatus is encountered with a request that when an impulse responses to a sound field from a virtual sound source position with respect to reference position and direction of a listener's head to both ears of the listener, which are fixed, is replaced, or when a degree of added reverberation is switched, contents of the replacement or the switching are displayed, there is then the disadvantage that each of the above-mentioned publications does not disclose a means for changing a sound field to be reproduced.

In each of the above-mentioned reproduction method using a headphone, the stereophonic reproduction system, the audio reproduction apparatus and the audio-signal reproduction apparatus, the analog audio signals in two channels are supplied through connection cords to a signal processing unit and the headphone. However, there is then the disadvantage that although the connection cords get entangled to cause unsatisfactory operability of the headphone, each of the above-mentioned publications does not disclose a means for supplying the analog audio signals in two channels through a wireless transmission system using some electromagnetic waves such as infrared rays or the like.

Although each of the above-mentioned reproduction methods using a headphone, the stereophonic reproduction system, the audio reproduction apparatus and the audio-signal reproduction apparatus is encountered with a request that an input level is switched in response to levels of input analog audio signals in two channels, there is then the disadvantage that each of the above-mentioned publications does not disclose a means for switching the input level.

Although each of the above-mentioned reproduction methods using a headphone, the stereophonic reproduction system, the audio reproduction apparatus and the audio-signal reproduction apparatus is encountered with a request that a headphone housing portion is provided in a case of a signal processing unit for carrying out the above-mentioned signal processing and/or an audio amplifier unit, each of the above-mentioned publications does not disclose the headphone housing portion.

Although each of the above-mentioned reproduction methods using a headphone, the stereophonic reproduction system, the audio reproduction apparatus and the audio-signal reproduction apparatus is encountered with a request that signals are supplied through amplifiers having different gains and A/D converters having different coding levels to a control circuit in accordance with an output value of an angle detector and an A/D converter used for calculating a rotational angle is selected depending upon a data value of the control circuit, each of the above-mentioned publications does not disclose the means for selecting the A/D converter.

Although each of the above-mentioned reproduction methods using a headphone, the stereophonic reproduction system, the audio reproduction apparatus and the audio-signal reproduction apparatus is encountered with a request that a digital filter for an impulse response to a sound field from a previously measured virtual sound source to a measuring point is formed of an FIR (finite impulse response) filter having a finite tap-length, each of the above-mentioned publications does not disclose the means for forming the digital filter of the FIR type.

Although each of the above-mentioned reproduction methods using a headphone, the stereophonic reproduction system, the audio reproduction apparatus and the audio-signal reproduction apparatus is encountered with a request that when a head gyration is detected and a rotational angle relative to a front direction is calculated, it is selected whether or not the calculated rotational angle relative to the front direction is reset to a reference position with respect to a plurality of reference angles, each of the above-mentioned publications does not disclose the means for selecting it.

Although each of the above-mentioned reproduction methods using a headphone, the stereophonic reproduction system, the audio reproduction apparatus and the audio-signal reproduction apparatus is encountered with a request that gains of amplifiers for amplifying a signal output from the angle detector are switched, each of the above-mentioned publications does not disclose the means for switching the gains.

Each of the above-mentioned reproduction methods using a headphone, the stereophonic reproduction system, the audio reproduction apparatus and the audio-signal reproduction apparatus is encountered with the disadvantage that each of the above-mentioned publications does not disclose an A/D converter for converting a signal output for an angle detector of detecting a head gyration and means which, when the rotational angle relative to the front direction is calculated by integrating digital data obtained from the output signal from the A/D conversion, removes a DC offset component from the digital data obtained by the A/D conversion from the output signal.

Each of the above-mentioned reproduction methods using a headphone, the stereophonic reproduction system, the audio reproduction apparatus and the audio-signal reproduction apparatus is encountered with the disadvantage that each of the above-mentioned publications does not disclose that when the audio signals are corrected based on the impulse response, convolution integral is employed.

Each of the above-mentioned reproduction methods using a headphone, the stereophonic reproduction system, the audio reproduction apparatus and the audio-signal reproduction apparatus is encountered with the disadvantage that each of the above-mentioned publications does not disclose that a self-check function is provided in order to determine, when a plurality of convolutional integrators are used to correct the audio signals based on the impulse response, whether or not each of convolutional integrators functions normally.

Although each of the above-mentioned reproduction methods using a headphone, the stereophonic reproduction system, the audio reproduction apparatus and the audio-signal reproduction apparatus is encountered with a request that even after the audio reproducing apparatus is turned off, the similar reproduction is carried out with various set values selected previously when the audio reproducing apparatus is turned on again, each of the above-mentioned publications does not disclose the means for carrying out such reproduction.

SUMMARY OF THE INVENTION

In view of such aspects, an object of the present invention is to provide an audio reproducing apparatus corresponding to a picture which localizes a position of a reproduced sound image obtained from an audio signal such that the sound image corresponds to a picture.

According to the present invention, an apparatus for reproducing an audio signal corresponding to a video signal includes audio reproducing means and an apparatus body unit for subjecting an audio signal corresponding to a video signal and supplied from an external sound source to a predetermined signal processing. The audio reproducing means includes an attachment body attached to a listener's head and angle detecting means for detecting a movement of the listener's head with respect to a reference position and direction at every predetermined angle. The apparatus body unit includes first storage means, second storage means, angle detecting means, A/D converting means, correcting means, D/A converting means, and amplifying means. The first storage means stores a measured result of an impulse response from a virtual sound source position with respect to the reference position and direction of the head of the listener to both ears of the listener that are fixed. The second storage means stores a control signal in response to measured results of an arrival time and a sound pressure level of a reproduced and output audio signal from a virtual sound source position with respect to the reference position and direction of the listener's head to both ears of the listener that are fixed and correspond to a movement of the listener's head. The angle detecting means detects the movement of the listener's head with respect to the reference position and direction and outputting a signal. The A/D converting means converts the audio signals in respective channels supplied from the signal source. The correcting means corrects the digital signals from the A/D converting means based on the impulse response stored in the first storage means based on an output signal from the angle detecting means and for correcting the same based on a control signal stored in the second storage means. The D/A converting means converts digital signals output from the correcting means into two-channel analog signals. The amplifying means amplifies the analog signals from the D/A converting means. The audio signals corrected by the apparatus body unit in response to the movement of the listener's head are reproduced through the audio reproducing means so as to be localized in the direction corresponding to a reproduced video signal.

BRIEF DESCRIPTION OF THE DRAWINGS

FIG. 6 is a table showing data of an impulse response of the audio reproducing apparatus corresponding to a picture according to the embodiment of the present invention;

FIG. 8 is a table showing control data of the audio reproducing apparatus corresponding to a picture according to the embodiment of the present invention;

FIG. 9 is a diagram used to explain a measurement of the control data of the audio reproducing apparatus corresponding to a picture according to the embodiment of the present invention;

DETAILED DESCRIPTION OF THE PREFERRED EMBODIMENTS

An audio reproducing apparatus corresponding to a picture according to an embodiment of the present invention will hereinafter be described with reference to FIGS. 1 through 32.

According to the audio reproducing apparatus corresponding to a picture according to the embodiment of the present invention, when general-purpose audio signals supplied from the outside are reproduced by a headphone, the listener can perceive localization, sound field and so on equivalent to those perceived when the audio signals are reproduced by speakers located in a predetermined positional relationship. Particularly, the audio signals are corrected by removing any difference in shape of listener's ears, noise and so on by adaptive processings.

Specifically, the audio reproducing apparatus corresponding to a picture according to the embodiment of the present invention is used in a system of reproducing audio signals in two channels obtained by picking up sound waves from a laser disc or the like. Particularly, when digitized audio signals recorded in respective channels for localizing respective sound images in a predetermined positional relationship (e.g., at right, left and center positions in front of the listener and other positions) are reproduced through the headphone, it is possible to correct the audio signals in a real-time fashion by detecting the gyration of the listener's head.

Figure 1:
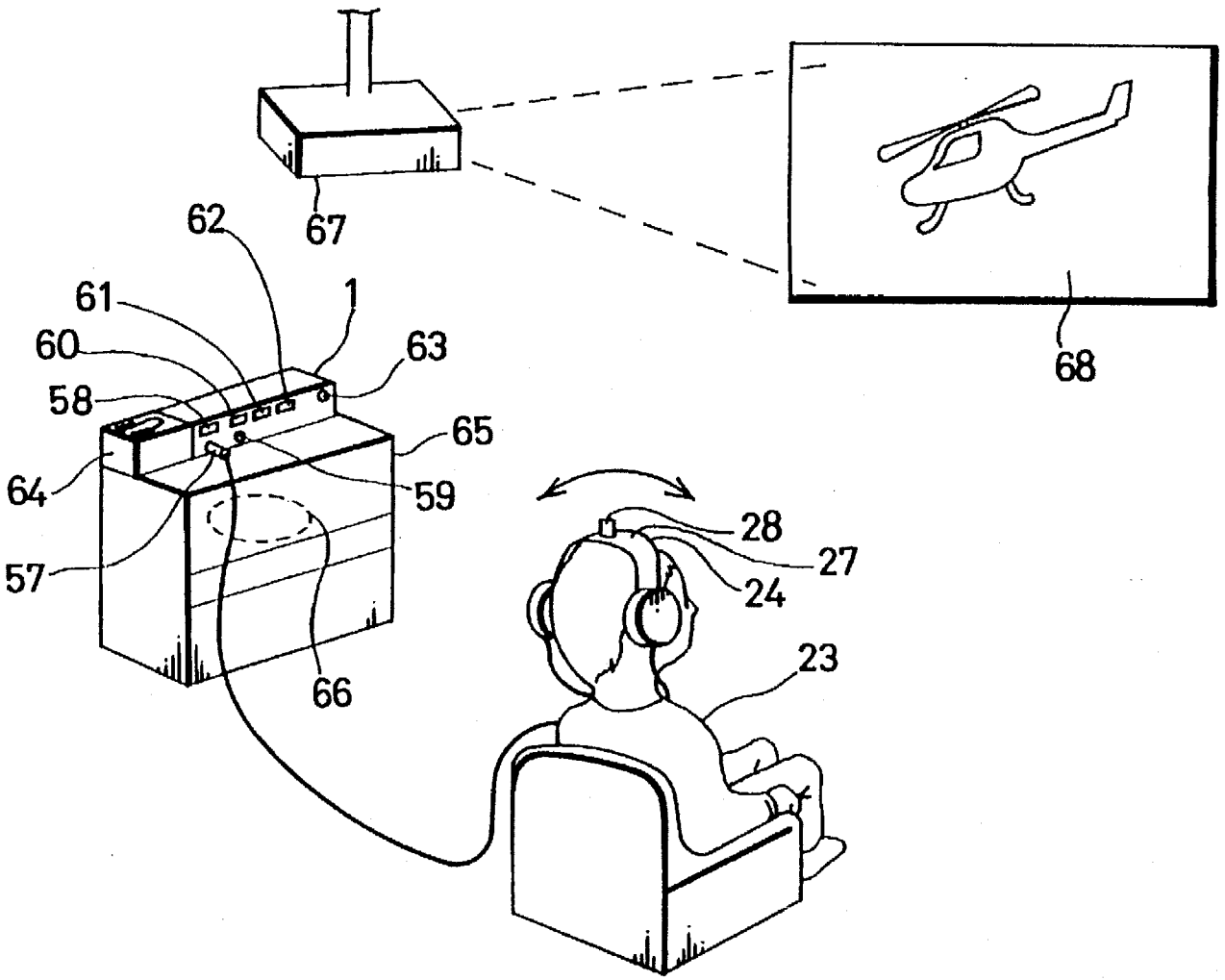
FIG. 1 is a diagram showing the use of an audio reproducing apparatus corresponding to a picture according to an embodiment of the present invention.

FIG. 1 shows the audio reproducing apparatus corresponding to a picture according to the embodiment of the present invention in use. An audio reproducing apparatus body 1 processes audio signals. Analog audio signals in two channels corresponding to a picture and recorded on a laser disc 66 are reproduced by a laser disc player 65 and supplied to the audio reproducing apparatus body 1 through connection cords (not shown). A video signal reproduced from the laser disc 66 is supplied to a projector 67 which projects a picture on a screen 68. The audio signals supplied to the audio reproducing apparatus body 1 are subjected to predetermined signal processings and supplied through a connection cord connected to a headphone terminal 57 to a headphone 24.

A listener 23 can listen to reproduced sounds with the headphone 24 on the head. When the audio signals are reproduced through the headphone 24 or the like, the audio signals are corrected in a real-time fashion by detecting the gyration of the head of the listener 23. The correction allows reproduced images to be constantly localized in the direction of the picture projected onto the screen 68. In this case, when the audio reproducing apparatus body 1 is energized, the reproduced audio signals are muted to improve a quality of reproduced sound.

The audio reproducing apparatus body 1 has a gyroscope stabilization indicator 58 which indicate that an operation of a digital vibratory gyroscope 28 is stabilized when the connection cord of the headphone 24 is connected to the headphone terminal 57. A bypass switch 59 is used to select a mode in which the reproduced audio signals corresponding to a picture and supplied from the laser disc player 65 are processed by the audio reproducing apparatus body 1 and a mode in which the reproduced audio signals are not processed. The bypass indicator 60 indicates that a bypass mode is selected.

A sound field/reverberation indicator 61 indicates the switched state when the sound field and reverberation are switched by a sound field/reverberation switch which will be described later on. A wireless transmission effective area indicator 62 indicates the state in which, when the audio signals are transmitted from the audio reproducing apparatus body 1 to the headphone 24 in a wireless fashion, the audio signals can be effectively transmitted even if the headphone 24 is away from the audio reproducing apparatus body 1. An input level switch and a wireless switch 63 are used to switch the input level of the audio signal supplied from the player 65 and to switch transmission through the connection cord and the wireless transmission. In this case, the audio signals may be directly transmitted from the sound source to the headphone 24 in a wireless fashion and received by the headphone 24. A headphone accommodating and holding portion 64 is made by boring the audio reproducing apparatus body 1 in a shape of the headphone wherein the headphone 24 is accommodated and held therein.

In this embodiment, when the bypass mode is set by the bypass switch 59, the impulse responses to the sound field from the virtual sound source position with respect to the reference position and direction of the head of the listener 23 to both the ears of the listener 23, that are fixed, are switched by the sound field/reverberation switch described later on. Alternatively, when a degree of the added reverberation is switched, the bypass indicator 60 and the sound field/reverberation indicator 61 may be turned off or may be set in the dark state.

In this embodiment, when the impulse responses to the sound field from the virtual sound source position with respect to the reference position and direction of the head of the listener 23 to both the ears of the listener 23, that are fixed, are switched by the sound field/reverberation switch described later on, the degree of the added reverberation may be switched at the same time.

Figure 2:
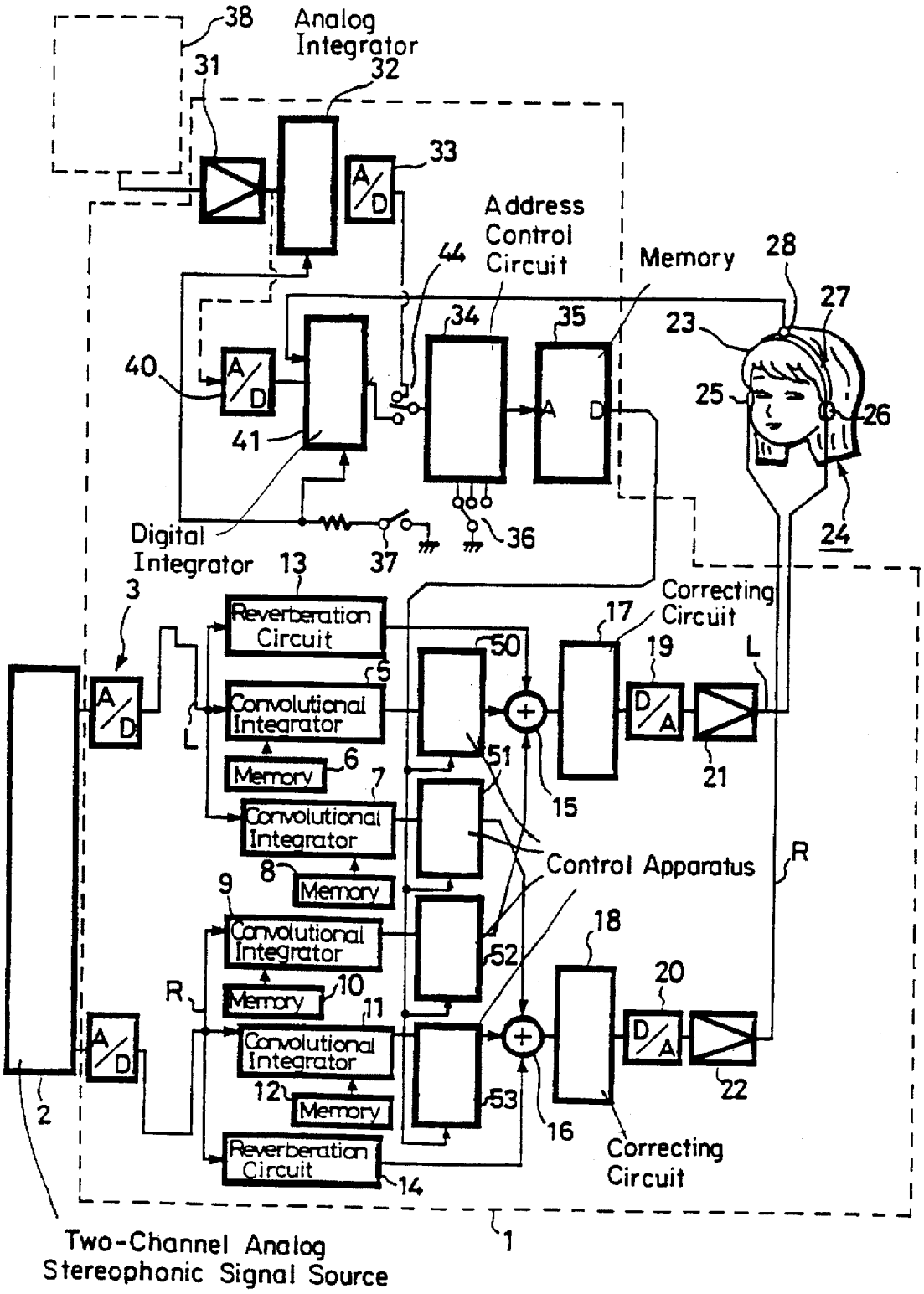
FIG. 2 is a block diagram showing the audio reproducing apparatus corresponding to a picture according to the embodiment of the present invention.

FIG. 2 shows a block diagram of an arrangement of the audio reproducing apparatus corresponding to a picture according to the present invention. The audio reproducing apparatus corresponding to a picture includes a two-channel analog stereophonic signal source, such as a laser disc, an analog record or an analog broadcasting, and A/D converters 3 for converting the analog signals into digital signals.

Since the analog stereophonic signal source 2 supplies the two-channel analog audio signals, there are provided the two A/D converters 3. The A/D converters 3 convert input analog signals into digital signals represented by a constant sampling frequency and a constant number of quantizing bits. In this embodiment, the audio signals in only two channels are used.

A left digital signal L of the converted digital signals is supplied to a convolutional integrator 5. At this time, a set of digitally recorded impulse responses are read out from a memory 6 associated with the convolutional integrator 5, the digitally recorded impulse responses being impulse responses to a sound field from the virtual sound source position with respect to a reference direction of the head of the listener 23, that is fixed, to both ears of the listener 23 and being represented by the constant sampling frequency and the constant number of quantizing bits. The digital signal L is subjected to convolution integral together with the impulse response read out from the memory 6 by the convolutional integrator 5 in a real-time fashion. A convolutional integrator 7 and a memory 8 supply a crosstalk component of a right digital signal R.

Similar to the left digital signal L, the right digital signal R is supplied to a convolutional integrator 11. At this time, a set of digitally recorded impulse responses are read out from a memory 12 associated with the convolutional integrator 11, the digitally recorded impulse responses being impulse responses to a sound field from the virtual sound source position with respect to a reference direction of the head of the listener 23, that is fixed, to the both ears of the listener 23 and being represented by the constant sampling frequency and the constant number of quantizing bits. The digital signal R is subjected to convolution integral together with the impulse response read out from the memory 12 by the convolutional integrator 11 in a real time fashion. A convolutional integrator 9 and a memory 10 supply a crosstalk component of the left digital signal L.

Similarly, the convolutional integrator 7 and the memory 8 and the convolutional integrator 11 and the memory 12 carry out the convolution integral with the impulse responses. As described above, the digital signal series subjected by the convolutional integrators 5, 7, 9 and 11 and the memories 6, 8, 10 and 12 to the convolution integral with the impulse responses are corrected by control apparatus 50, 51, 52, 53 based on control signals representing a sound arrival time and a sound pressure level in response to the head gyration, and supplied to adders 15, 16, respectively. Two-channel digital signals added by the adders 15, 16 are corrected by correcting circuits 17, 18 to remove therefrom difference in shape of the listener's ears and characteristics inherent in sound sources and headphone which are used, and then converted by D/A converters 19, 20 into two-channel analog signals. The two-channel analog signals are amplified to power amplifiers 21, 22 and then supplied to headphone 24.

A newly detected head movement with respect to the reference direction is converted into a digital address signal representing a magnitude including a direction at every constant unit angle or every predetermined angle. The control signal previously stored in the memory 35 is read out by using the digital address signal. The digital signals in respective channels subjected to convolution integration are corrected and changed by the control apparatus 50, 51, 52, 53 in a real-time fashion and corrected results thereof are supplied to the adders 15, 16.

Figure 3:
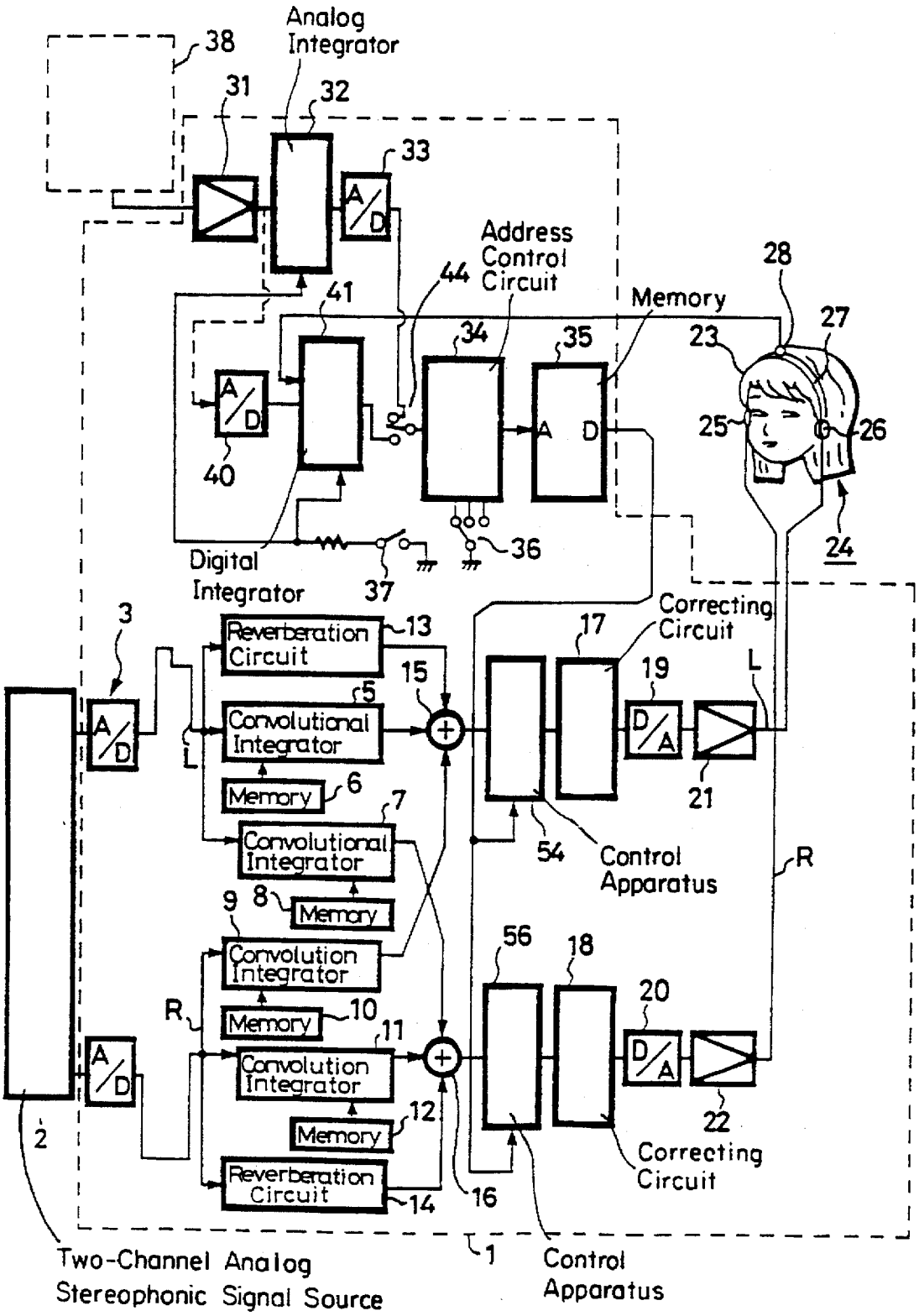
FIG. 3 is a block diagram showing the audio reproducing apparatus corresponding to a picture according to another embodiment of the present invention.

While in the arrangement shown in FIG. 2 the digital signal series subjected by the convolutional integrators 5, 7, 9 and 11 and the memories 6, 8, 10 and 12 to convolution integration together with the impulse responses are corrected by the control apparatus 50, 51, 52, 53 based on the control signals representing the sound arrival time and the sound pressure level in response to the head gyration and then supplied to the adders 15, 16, the present invention is not limited thereto and an arrangement shown in FIG. 3 may be employed. Specifically, the digital signals subjected by the convolutional integrators 5, 7, 9 and 11 and the memories 6, 8, 10 and 12 to the convolution integral together with the digitally recorded impulse responses to a sound field from the virtual sound source position with respect to the reference direction of the head, that is fixed, to both ears are supplied to the adders 15, 16 to obtain two-channel digital signals. The two-channel digital signals are corrected by the control apparatus 54, 56 based on the control signals representing the sound arrival time and the sound pressure level in response to the head gyration.

Thus, the digital signal series subjected to convolutional integral together with the impulse responses in a real-time fashion are supplied to the adders 15, 16 to obtain the two-channel digital signals. A newly detected head movement with respect to the reference direction is converted into the digital address signal representing the magnitude including the direction at every constant unit angle or every predetermined angle. The control signals previously stored in the memory 35 are read out therefrom. Based on the control signals, the two-channel digital signals supplied from the adders 15, 16 are corrected and changed by the control apparatus 54, 56 in a real-time fashion.

In the arrangement shown in FIG. 2, when the convolutional integrators 5, 7, 9 and 11 correct the audio signals based on the impulse responses, the convolution integral method is employed.

In the arrangement shown in FIG. 2, when the audio reproducing apparatus corresponding to a picture is energized, it may be checked by a self-check function whether or not the plurality of convolutional integrators 5, 7, 9 and 11 function normally.

In the arrangement shown in FIG. 2, if various set values that are selected last are stored in a predetermined memory when the power switch is turned off, then the same data reproduced last can be reproduced by turning on the power switch the next time.

Each of the control apparatus 50, 51, 52, 53, 54 and 56 may be formed by combining a variable delay device and a variable level controller or a level controller for controlling a level in every frequency band, such as a graphic equalizer having a number of divided bands or the like. Information stored in the memory 35 may be impulse response representing difference in time, level and so on between sounds obtained at both ears from the virtual sound source positions to both ears in the direction in which the listener 23 turns the head with respect to the reference direction of the head. In this case, each of the above-mentioned control apparatus 50, 51, 52, 53, 54 and 56 may be formed of an IIR (infinite impulse response) or FIR variable digital filter.

As described above, the digital signals are given spatial information by the control apparatus 50, 51, 52, 53, 54 and 56, corrected by the correcting circuits 17, 18 with respect to difference in a shape of the listener's ears, characteristics inherent in the sound sources and headphones which are used, changed in response to the head movement, and then converted by the D/A converters 19, 20 into the analog signals. The analog signals are amplified by the amplifiers 21, 22 and then supplied to the headphone 24.

In this case, the correcting circuits 17, 18 for correcting the difference in a shape of the listener's ears, the characteristics inherent in the sound sources and headphones to be used may process signals in an analog or digital fashion. If the headphone 24 is of wireless type, then the correcting circuits 17, 18 may be disposed within the headphone body. The correcting circuits 17, 18 need not necessarily be disposed within the headphone body, but may be disposed in the cords of the headphone, for example, or may be provided in connector units for connecting the apparatus body and the headphone or a subsequent stage. The correcting circuits 17, 18 may be provided in the control apparatus of the apparatus body or a subsequent stage. The correction characteristics may be stored in the memories 6, 8, 10 and 12 together with the impulse responses stored therein and read out therefrom to subject the digital signals to convolution integration in the convolutional integrators 5, 7, 9 and 11. In the correcting circuits 17, 18, a part of or whole of correcting characteristics may be formed of analog filters.

Figure 4:
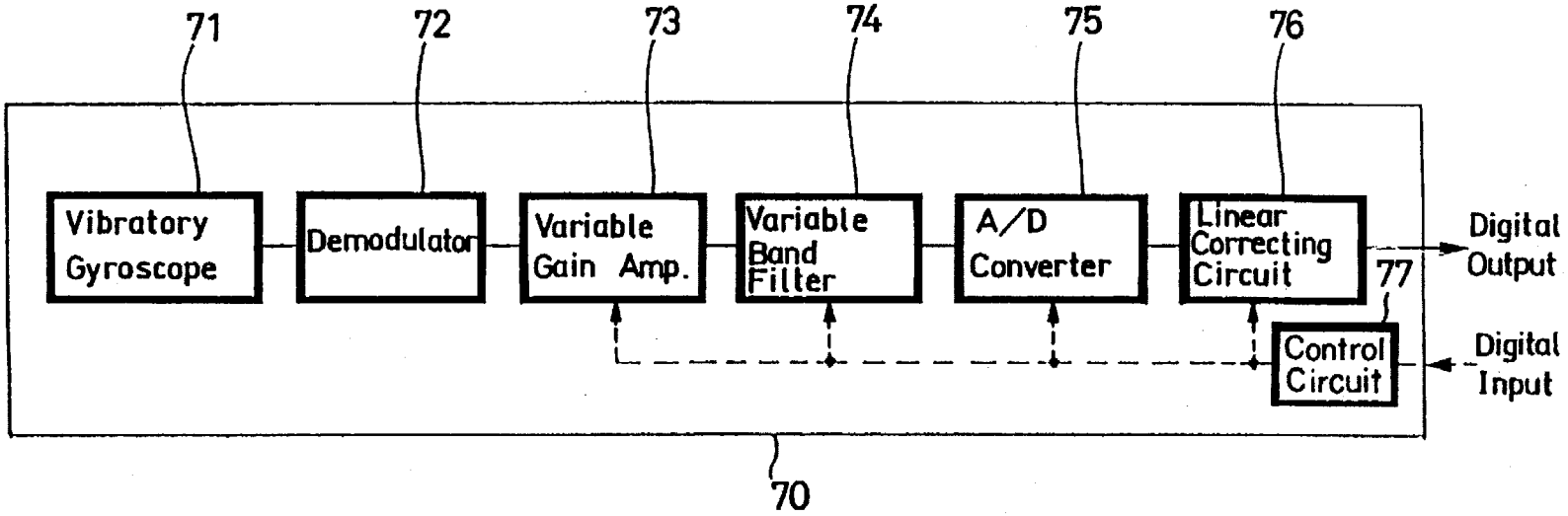
FIG. 4 is a block diagram showing an arrangement of a vibratory gyroscope apparatus for use in the audio reproducing apparatus corresponding to a picture according to the embodiment of the present invention.

The digital vibratory gyroscope 28 detects a movement of the head of the listener 23. FIG. 4 shows an arrangement of the digital vibratory gyroscope 28 in detail. FIG. 4 is a diagram showing an arrangement of a vibratory gyroscope apparatus for use in the audio reproducing apparatus corresponding to a picture according to the present invention. A vibratory gyroscope apparatus 70 has a vibratory gyroscope 71, a demodulator 72, a variable gain amplifier 73, a variable band-pass filter 74, an A/D converter 75, a linear correction circuit 76 and a control circuit 77.

When the vibratory gyroscope 71 detects an angular movement, an electric signal is changed in response to a level of an angular velocity in the vibratory gyroscope 71. A vibratory pickup which can detect an acceleration, a velocity and, a positional displacement is used to detect a linear movement. A gyroscope or the like which can detect an angular acceleration, an angular velocity and change of an angle is used to detect a rotational movement.

A signal detected by the vibratory gyroscope 71 sometimes represents a change of vibration and is sometimes output in the form of a modulated wave. When the detected signal is output in the form of the modulated wave, the demodulator 72 derives a change of the vibration from the detected signal. For example, a speed pickup outputs a current proportional to a vibration speed. When the vibratory gyroscope is used, it is necessary to carry out a demodulation processing, such as a synchronous detection or the like, since the vibratory gyroscope outputs an amplitude-modulated signal proportional to an angular velocity (Coriolis force).

Since the detected signal thus output has a small output level, the detected signal is amplified by the variable gain amplifier 73 so that a dynamic range of the A/D converter 75 at the succeeding stage can be utilized effectively. The detected signal amplified by the variable gain amplifier 73 is supplied to the variable band-pass filter 74 and necessary bands are derived thereby from the detected signal.

Since vibration of a vibrating body is not always constant and the necessary band of the signal is not always constant, an amplification degree of the variable gain amplifier 73 and a band width of the variable band-pass filter can be controlled from the outside.

Thus, the dynamic range of the A/D converter 75 can be utilized more effectively. The control circuit 77 receives a digital control signal supplied thereto from the outside and generates control signals necessary for the variable gain amplifier 73, the variable band-pass filter 74 and the A/D converter 75. The control circuit 77 may be formed of a CPU (central processing unit) when the vibratory gyroscope 70 incorporates a CPU.

The A/D converter 75 converts the analog signal indicative of a detected vibration which is thus adjusted in amplification degree and the bandwidth into a digital signal. At the succeeding stage, the linear correction circuit 76 corrects the digital signal with respect to nonlinearity of a detection element of the vibratory gyroscope 71. A value used in this correction is changed in response to the amplification degree set through the control signal from the control circuit 77 from the outside.

The vibratory gyroscope apparatus is operated as follows. Since the signal indicative of the detected vibration is amplified and frequency band width is limited in the very vicinity of the vibratory gyroscope 71, it is possible to transmit the signal indicative of the detected vibration with less distortion and with satisfactory S/N ratio. Moreover, since the amplification degree, i.e., vibratory detection sensitivity and the frequency band can be controlled at a position away from the vibratory gyroscope apparatus 70, its operability is improved and the vibratory gyroscope apparatus 70 can be used for various purposes.

Since a subsampling rate can be changed in response to the setting of the necessary band, it is possible to transmit many more detection signals in a time-division multiplex fashion. Moreover, it is possible to considerably reduce the number of wires of a transmission line by utilizing characteristics of the digital output signal and to transmit signals economically with little deterioration.

In addition, since the analog signal is converted into the digital signal and then the non-linearity of the vibratory gyroscope 71 is corrected by the digital processing, it is possible to arrange the vibratory gyroscope with highly satisfactory linearity.

In the arrangement shown in FIG. 4, the signal output from the vibratory gyroscope 71 may be input to the variable gain amplifiers 73 having two different gains or more. In this case, signals output from the variable gain amplifiers 73 are supplied through the A/D converters 75 having different coding rates to the control circuit 77, and the variable gain amplifiers 73 and the A/D converters 75 are selected based on values of data supplied with the control circuit 77.

In the arrangement shown in FIG. 4, if a rotational angle relative to the front direction calculated by the control circuit 77 has an angular deviation smaller than a constant angle relative to a plurality of reference angles, the rotational angle may be set to a closest reference angle at a predetermined speed. If the rotational angle has an angular deviation larger than the constant angle, it may be unnecessary to set the rotational angle thereto.

In the arrangement shown in FIG. 4, only when a change amount of the angle calculated by the control circuit 77 exceeds a certain value, a value of the angle may be updated.

Figure 5:
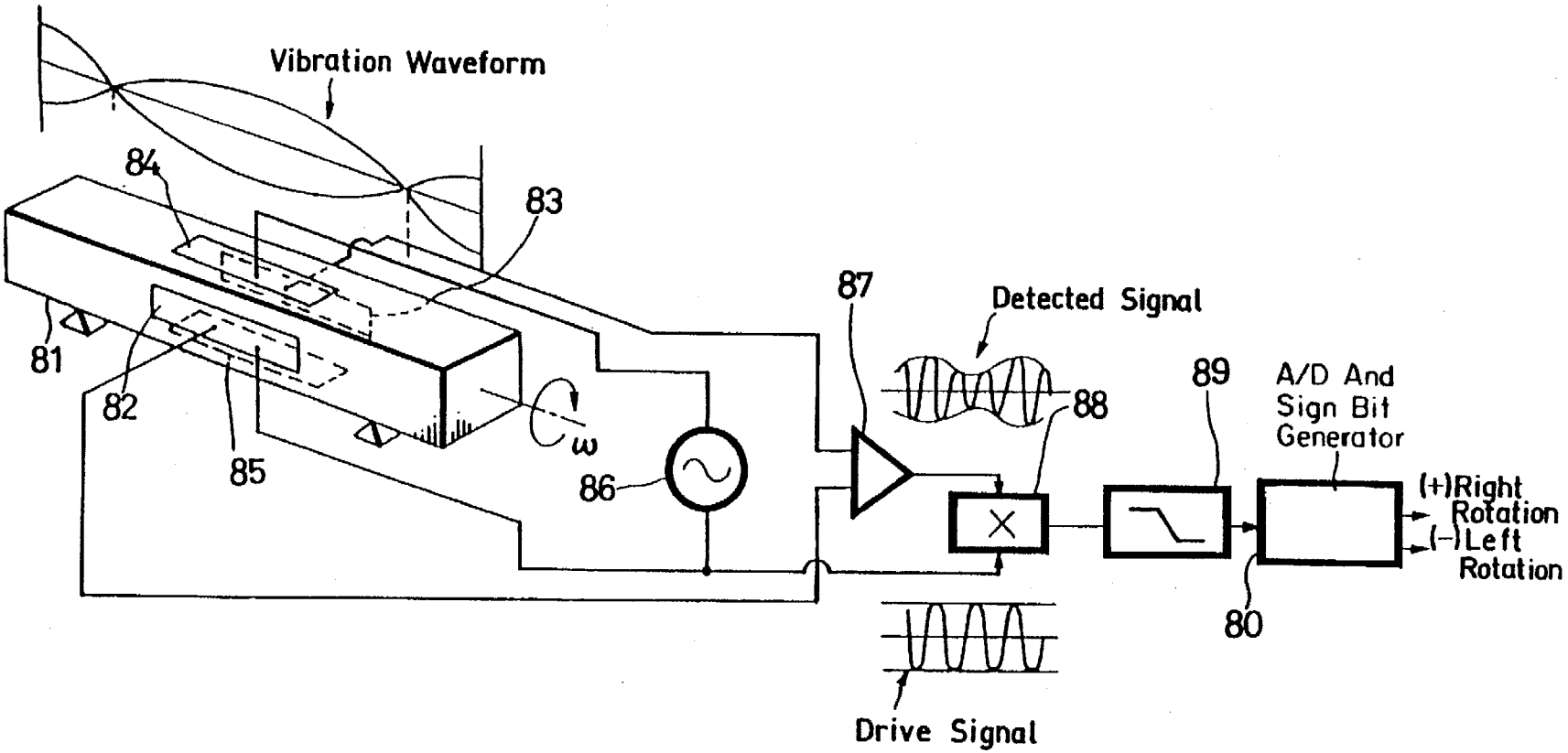
FIG. 5 is a detailed diagram showing an operation of the vibratory gyroscope apparatus for use in the audio reproducing apparatus corresponding to a picture according to the embodiment of the present invention.

FIG. 5 is a circuit diagram, partially in perspective form, showing an operation of the vibratory gyroscope 71 in detail. A vibratory quadratic prism 81 having a square cross section shown in FIG. 5 is formed of various kinds of vibratory bodies. The vibratory quadratic prism 81 has detection elements 82, 83 attached to a pair of its two surfaces opposed to each other and drive elements 84, 85 attached to the other pair of its two surfaces opposed to each other. The detection elements 82, 83 and the drive elements 84, 85 are formed of magnetostrictive elements for detecting vibration electromagnetically or being driven, and may be formed of piezoelectric elements. Any detection elements may be used as long as it can detect vibration of the vibratory quadratic prism 81.

The drive elements 84, 85 are connected with a drive signal source 86 and supplied with an alternating signal therefrom. Signals output from the detection elements 82, 83 are supplied to a differential amplifier 87. A differential output from the differential amplifier 87 and the alternating signal output from the drive signal source 86 are supplied to a multiplier or phase detector 88 and multiplied or phase-detected thereby. An output from the multiplier or phase detector 88 is supplied to a band-pass filter 89 which removes a carrier wave component therefrom. An output from the band-pass filter 89 is supplied to an A/D converter and sign bit generator 80. Depending upon a sign bit, the vibratory gyroscope 71 detects gyration of the head in the right or left direction.

As shown in FIG. 5, the vibratory gyroscope 71 thus arranged is operated as follows. When an alternating signal having a vibration frequency inherent in the vibratory quadratic prism 81 is applied to the drive elements 84, 85, the vibratory quadratic prism 81 is forcibly vibrated based on a vibration waveform shown in FIG. 5. The forcible vibration is used to produce resonance in a constant mode.

In this case, when an external force is not being applied to the vibratory quadratic prism 81, each of the detection elements 82, 83 does not output signals. When a rotational force having an angular velocity $\omega$ is applied to the vibratory quadratic prism 81 in its axis direction, the alternating signal for forcible vibration as a carrier wave is amplitude-modulated and detected as a detected signal as shown in FIG. 5. A magnitude of an amplitude in this case is proportional to the angular velocity $\omega$ of the rotation applied to the axis of the vibratory quadratic prism 81, a direction of the rotation corresponds to the phase shift direction relative to the drive signal.

Accordingly, a product of the detected and amplitude-modulated signal and the drive signal is calculated by the multiplier or phase detector 88. A signal indicative of the product is supplied to the band-pass filter 89 which removes its carrier wave component from the signal to obtain a detected signal.

A calculation error caused when the multiplier or phase detector 88 calculates the product and a time delay caused when the signal passes through the band-pass filter 89 are produced. In order to avoid the calculation error and the time delay, there is provided the AD converter and sign bit generator 80 formed of the A/D converter which carries out the sampling with employing N-fold or 1/N-fold (N=1, 2, 3 . . . ) frequencies of the detected and amplitude-modulated signal and the drive signal shown in FIG. 5 as a sampling frequency and with employing a peak value of the amplitude-modulated signal as a sampling point, and the sign bit generator for employing the peak value of the amplitude-modulated signal as the sampling point and converting a synchronous detected output of a reference carrier wave and the amplitude-modulated signal into sign bits. The band-pass filter 89 corresponding to the sampling frequency is provided at the preceding stage of the AD converter and sign bit generator 80.

Since the peak value of the amplitude-modulated detected signal is used as quantization data and a polarity of the synchronizing-detected output is converted into the digital signal represented by the sign bit, the transmission signal is not affected much by extraneous noise and is prevented from being much deteriorated.

According to the arrangement shown in FIG. 5, since the analog output signal indicative of the detected vibration is converted into the digital signal in the very vicinity of the detection elements 82, 83, it is possible for the signal indicative of the detected vibration to not be affected much by the extraneous noise and it is possible to drastically reduce the deterioration of the transmission signal. While the vibratory gyroscope apparatus is set in its de-energized state, it is preferable to set peripheral circuits in their energized states for stabilizing the operation of the vibratory gyroscope 71. It is preferable to provide the vibratory gyroscope 71 such that it can detect an angle of a horizontal movement of the listener's head.

According to the arrangement shown in FIG. 5, since the vibratory gyroscope apparatus 70 incorporates the liner correction circuit 76 for correcting the non-linearity of the detection elements 82, 83 and a dimension converter for converting a dimension of the detected vibration, it is possible to output the signal indicative of the detected vibration after the non-linearity of the detection elements is corrected and the dimension of the detected vibration is converted with high accuracy.

According to the arrangement shown in FIG. 5, it is unnecessary to use a thick and heavy cable and it is possible to use a thin and light cable such as an optical cable or the like.

According to the arrangement shown in FIG. 5, even if a plurality of the vibratory gyroscope apparatus are used, it is unnecessary to provide a large number of transmission lines since a time division multiplex transmission system is employed. Therefore, it is possible to arrange the vibratory gyroscope for use in detecting of the vibration of a moving body.

According to the arrangement shown in FIG. 5, when the analog signal indicative of the detected vibration is converted into the digital signal and the digital signal is transmitted in a wireless fashion, the transmission signal can be prevented from being affected by any disturbance.

According to the arrangement shown in FIG. 5, it is possible to easily change the setting from a position away from the vibratory gyroscope by setting the transmission between the audio reproducing apparatus body 1 and the vibratory gyroscope apparatus 70 as a bidirectional transmission.

When the head movement of the listener 23 with respect to the reference direction is output as discrete information at every unit angle or at every predetermined angle at every predetermined time, the digital vibratory gyroscope 28 may be provided at the head center position with its input axis being perpendicular to the listener's head and the vibratory gyroscope being provided at the input axis. In this case, accordingly, a signal indicative of the movement, including a direction with respect to the reference direction, of the head of the listener 23 is output. While the digital vibratory gyroscope 28 is attached to a headband 27 of the headphone 24 as shown in FIG. 1, the digital vibratory gyroscope 28 may be attached to an attachment device independent of the headband 27.

As shown in FIG. 2, the digital signal output from the digital vibratory gyroscope 28 is supplied to a digital integrator 41 and integrated thereby. The integrated digital signal is supplied to an address control circuit 34.

The address control circuit 34 supplies a memory 35 with a the digital address signal representing the angle, i.e., the magnitude of the head movement including its direction at every constant angle or every predetermined angle with respect to the reference direction as an address signal.

The impulse responses, which are previously digitally recorded in the memories 6, 8, 10 and 12, from the virtual sound source positions with respect to the reference direction of the head of the listener 23 to both ears of the listener 23, that are fixed, are read from corresponding addresses of the table of the memories 6, 8, 10 and 12. The impulse responses are subjected together with digitized audio signals in respective channels to convolution integration by the convolutional integrators 5, 7, 9 and 11. Thus, the control apparatus 50, 51, 52, 53 correct the digital signals output from the convolutional integrators 5, 7, 9 and 11 in a real-time fashion with respect to the direction in which the listener 23 turns the head at present, based on the control signals, which are previously digitally stored in the memory 35, representing the sound arrival times and the sound pressure levels from the virtual sound source positions with respect to the reference direction of the head of the listener 23 to both ears of the listener 23 that correspond to the head gyration.

An analog vibratory gyroscope 38 as an analog angle detector shown in FIG. 1 outputs an analog signal and has an arrangement which is similar to the arrangement of the vibratory gyroscope apparatus 70 shown in FIG. 4 except that the A/D converter 75 is not provided.

As shown in FIG. 2, an analog signal output from the analog angle detector 38 is amplified by an amplifier 31, integrated by an analog integrator 32 and then supplied to an A/D converter 33. The A/D converter 33 converts the analog signal into a digital signal and supplies the digital signal through a switcher 44 to the address control circuit 34. The address control circuit 34 generates the digital address signal representing the magnitude of the head movement including its direction at every constant angle or every constant time with respect to the reference direction, supplying the digital address signal to the memory 35. A signal output from the amplifier 31 may be supplied through an A/D converter 40 to the digital integrator 41.

In the arrangement shown in FIG. 2, the control signals, which are previously digitally recorded in the memory 35, representing the sound arrival times and the sound pressure levels from the virtual sound source positions with respect to the reference direction of the head of the listener 23 to both ears of the listener 23 are read from corresponding addresses of the table of the memory 35. In response to the control signals, the digitized audio signals in respective channels subjected to convolution integration together with the impulse responses by the convolutional integrators 5, 7, 9 and 11 and the memories 6, 8, 10 and 12 associated respectively therewith are corrected by the control apparatus 50, 51, 52 and 53 in a real-time fashion with respect to the direction in which the listener 23 turns his head at present.

In the arrangement shown in FIG. 3, the control signals, which are previously digitally recorded in the memory 35, representing the sound arrival times and the sound pressure levels from the virtual sound source positions with respect to the reference direction of the head of the listener 23 to both ears of the listener 23 are read out from corresponding addresses of the table of the memory 35. The digitized audio signals in respective channels subjected to convolution integration together with the impulse responses by the convolutional integrators 5, 7, 9 and 11 and the memories 6, 8, 10 and 12 associated respectively therewith are converted by the adders 15, 16 into the two-channel digital signals. In response to the control signals, the two-channel digital signals are corrected by the control apparatus 54, 56 in a real-time fashion with respect to the direction in which the listener 23 his the head at present.

Figure 7:
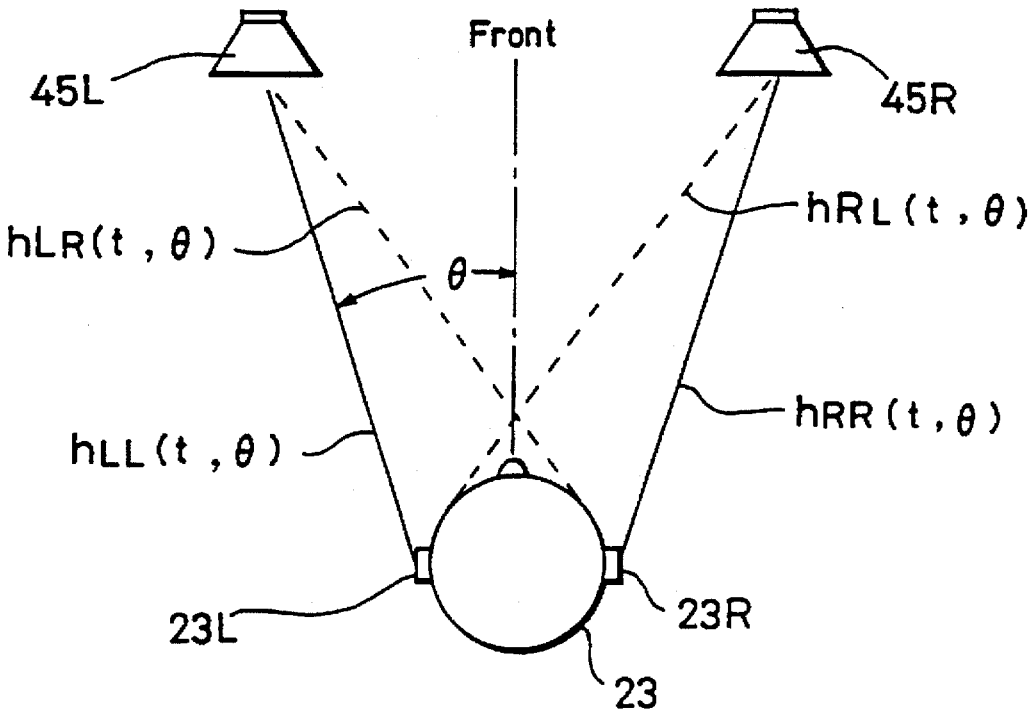
FIG. 7 is a diagram used to explain a measurement of the impulse response of the audio reproducing apparatus corresponding to a picture according to the embodiment of the present invention.

FIG. 6 shows table data stored in the memory 35. Specifically, when front left and right speakers 45L, 45R are positioned in front of the listener 23 as shown in FIG. 7, if the impulse responses to a sound field from positions of the left and right speakers 45L, 45R to both ears of the listener 23 are represented by the following equations (1) to (4), i.e., $$h_{LL}(t, \theta) = 1/2\pi \int_{-\infty}^{\infty} H_{LL}(\omega, \theta) \cdot \exp(j\omega t) d\omega \quad (1)$$

$$h_{LR}(t, \theta) = 1/2\pi \int_{-\infty}^{\infty} H_{LR}(\omega, \theta) \cdot \exp(j\omega t) d\omega \quad (2)$$

$$h_{RL}(t, \theta) = 1/2\pi \int_{-\infty}^{\infty} H_{RL}(\omega, \theta) \cdot \exp(j\omega t) d\omega \quad (3)$$

$$h_{RR}(t, \theta) = 1/2\pi \int_{-\infty}^{\infty} H_{RR}(\omega, \theta) \cdot \exp(j\omega t) d\omega, \quad (4)$$

then the impulse responses representing the above equations are digitally recorded in the memories 6, 8, 10 and 12.

In the table shown in FIG. 6, reference symbol $h_{mn}(t)$ depicts an impulse response to a sound field from a speaker position m to an ear n, reference symbol $H_{mn}(\omega)$ depicts transfer function from the speaker position m to the ear n, reference symbol $\omega$ depicts an angular frequency of $2\pi f$, and reference symbol f depicts a frequency.

FIG. 8 shows an example of control data of the control signals stored in the table in the memory 35. The control data are supplied to the control apparatus shown in FIGS. 2 and 3. Specifically, the difference in time between the sounds respectively obtained at both ears, $\Delta T_{IJ}(\theta)$, and difference in level between the sounds respectively obtained at the both ears, $\Delta L_{IJ}(\theta)$, are recorded in the table of the control signals stored in the memory 35 (where IJ=LL, LR, RL, RR, . . . . ). These control signals are supplied to the above-mentioned control apparatus 50 through 54 and 56.

Each of the control apparatus 50 through 54 and 56 may be formed by combining the variable delay device and the variable level controller or the level controller for controlling the level in every frequency band, such as the graphic equalizer having a number of divided bands or the like. Information stored in the memory 35 may be impulse response representing difference in time, level and so on between sounds obtained at the both ears from the virtual sound source positions in the direction in which the listener 23 turns the head with respect to the reference direction of the head to both the ears or representing or delay times and sound pressure levels therebetween. Contents stored in the memory 35 have data structure corresponding to the control apparatus 50 through 54 and 56. In this case, each of the above-mentioned control apparatus 50 through 54 and 56 may be formed of an IIR or FIR variable digital filter.

The speakers may be used as the sound sources used for measuring the control signals representing the difference in time between the sounds obtained at the respective ears and the difference in level therebetween. Positions where sound waves are picked up in the respective ears of the listener 23 may be anywhere from the inlets of the external auditory canals thereof to the ear drums thereof.

However, the positions should be equal to positions, which will be described later, used to calculate characteristics of correction for canceling the characteristics inherent in the headphone to be used.

On the assumption of the above-mentioned impulse responses, each of the digitally recorded impulse responses obtained when an angle θ is changed by a unit angle, e.g., 2° is written in the address of the table of the memory 35. The unit angle is set to be every angle through which the listener 23 can perceive with the left and right ears that he turns the head.

The memory 35 includes three sets of such tables, each of sets having different data value depending upon shapes of the head and the auricles of the listener 23, the characteristics of the headphone to be used and so on. One of the three sets of tables is selected by switching the switcher 36 of the address control circuit 34.

In FIGS. 2 and 3, when a center reset switch is turned on, values of the digital integrator 41 are reset to "all 0". At this time, an address θ=0 is selected in the table of the memory 35. Specifically, when the center reset switch 37 is turned on, the direction in which the listener 23 turns the head at present is set to be the forward direction toward the sound sources.

Figure 10:
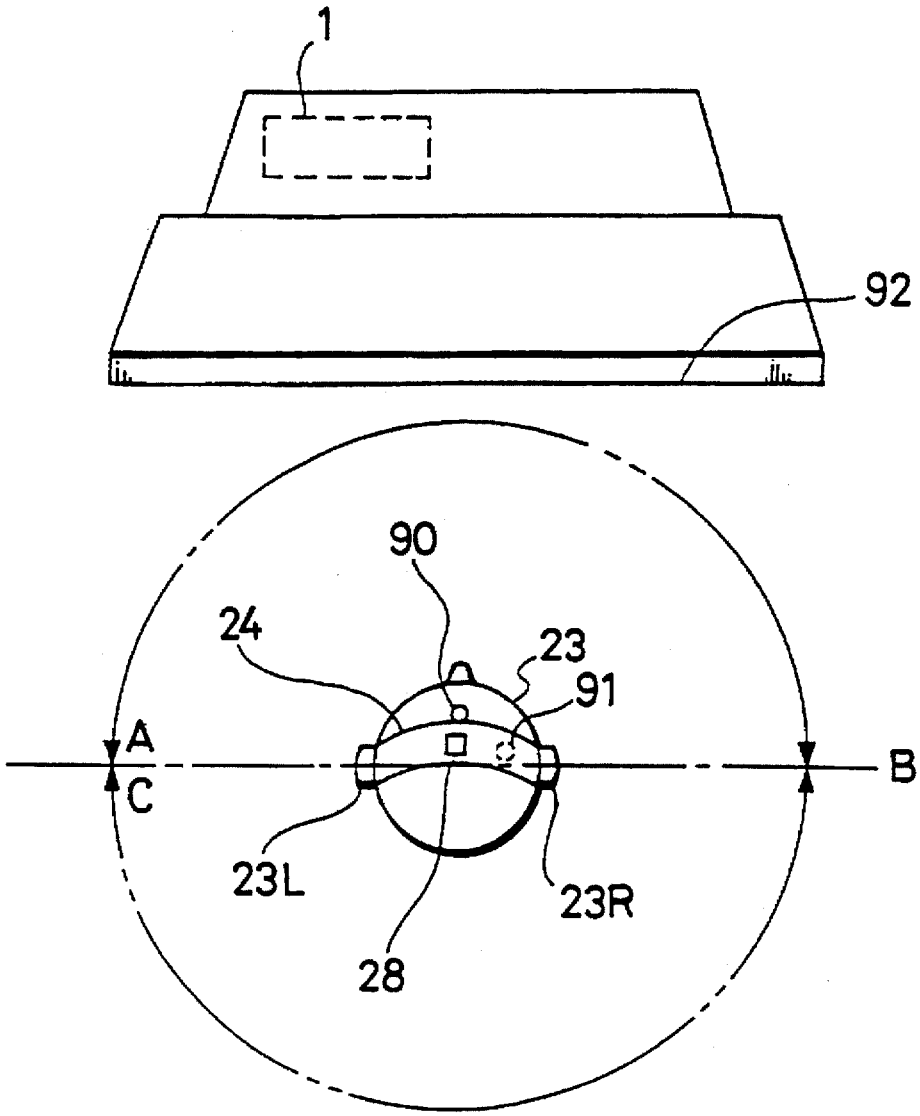
FIG. 10 is a diagram showing a simulated layout of speakers in the audio reproducing apparatus corresponding to a picture according to the embodiment of the present invention.

FIG. 10 shows simulated layout of the speakers in the audio reproducing apparatus corresponding to a picture according to the embodiment of the present invention is used. In this arrangement shown in FIG. 10, a television monitor 92 is used as video signal reproducing means and the audio reproducing apparatus body 1 is incorporated in the television monitor 92. When the listener 23 puts the headphone on the head, the digital vibratory gyroscope 28 detects the angle of the head gyration and in response to the detected angle, the sound image is localized in the direction in which the picture displayed on the screen of the television monitor 92. At this time, it is possible to reproduce the audio signals through the headphone in response to the picture as if the speakers were located in a forward area A, on a straight line B passing through both ears 23L, 23R of the listener 23 or in a rear C as shown in FIG. 10.

If the listener 23 pushes a reset switch 90 provided in the headphone 24, the direction in which the sound image is localized, i.e., the front direction is reset to the direction in which the listener 23 turns the head at present or the direction toward the television monitor 92. Thus, the digital vibratory gyroscope 28 detects the angle of the head gyration relative to the reset front direction. While the listener 23 pushes the reset switch 90 to reset the front direction, the front direction is automatically reset by the head pushing a reset switch 91 provided on the inner surface of the headphone 24 when the listener 23 puts the headphone 24 on the head.

Adaptive processing filters may be substituted for the correcting circuits 17, 18. Each of the adaptive processing filters 17, 18 has at least one of, a combination of some of, or all of the correction characteristics for canceling the characteristics inherent in the sound source used for measurement of the impulse responses or the control signals and the correction characteristics for canceling the difference in shapes of ears and auricles of the listeners, noises, the characteristics inherent in the characteristics of the headphone 24 to be used. Accordingly, since the adaptive processing filters 17, 18 carried out all of the above correction processings in its digital signal processings at once, they can process signals in a real-time fashion.

Figure 11:
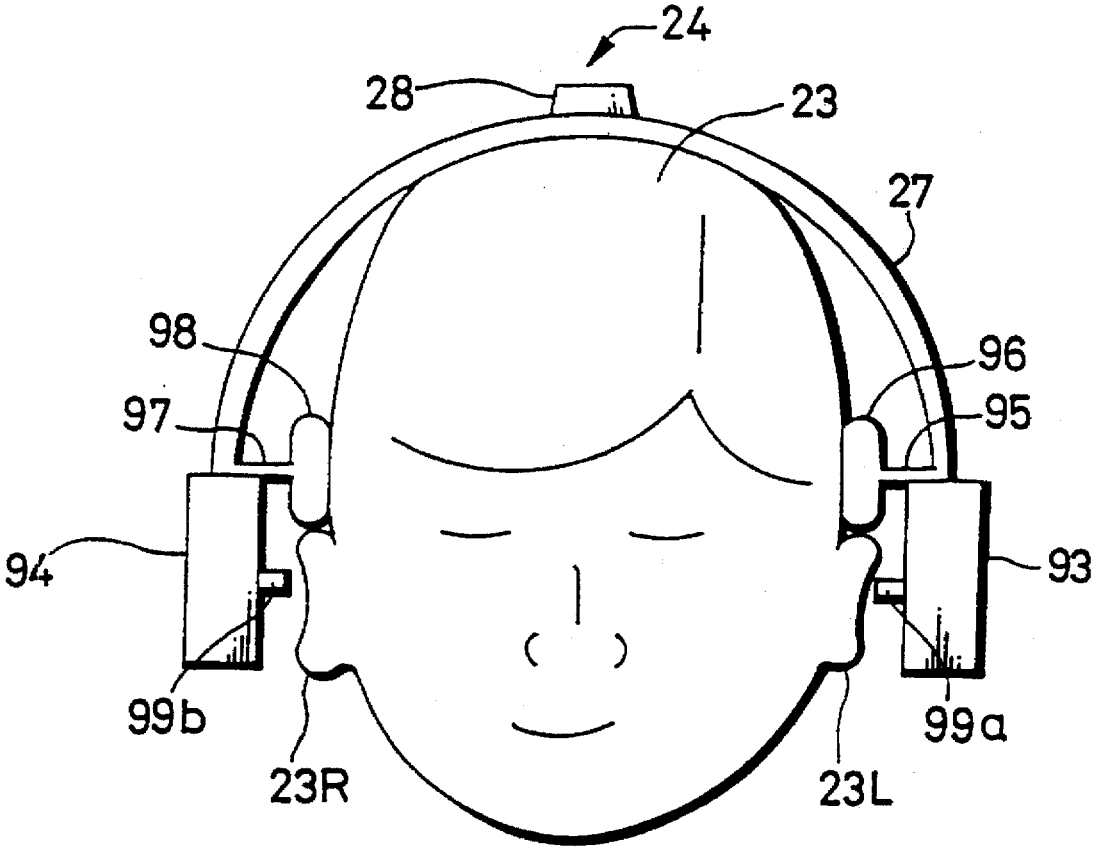
FIG. 11 is a diagram showing an overall arrangement of a headphone of the audio reproducing apparatus corresponding to a picture according to the embodiment of the present invention.

FIGS. 11 to 15 show the headphone of the audio reproducing apparatus corresponding to a picture according to the embodiment of the present invention and attachment positions of microphones used therein. FIG. 11 shows an overall arrangement of the headphone of the audio reproducing apparatus corresponding to a picture according to the embodiment of the present invention. In FIG. 11, the digital vibratory gyroscope 28 and headphone units 93, 94 are provided at the headband 27 of the headphone 24. Supporting bodies 96, 98 are provided in the vicinity of the positions where the headphone units 93, 94 are attached to the headband 27 and being projected from supporting bars 95, 97. With this arrangement, the listener 23 can put the headphone 24 on the head with the headphone units 93, 94 being placed at positions away from the ears 23L, 23R of the listener 23 at a predetermined interval. When the listener 23 puts the headphone 24 on the head, it is possible to measure the reproduction characteristics by microphones **99*a*, 99*b* provided at the headphone units 93, 94 so as to be projected to the ears 23L, 23R of the listener 23**.

According to the arrangement shown in FIG. 11, since the headphone units 93, 94 are out of contact with the ears 23L, 23R of the listener 23 by the supporting bars 95, 97 and the supporting bodies 96, 98 as supporting members provided at the headband 27 as a head attachment body of the headphone as audio reproducing means and sound generating characteristics of the headphone units 93, 94 are set close to characteristics obtained when the audio signals are reproduced and reproduced sounds are picked up, a radiation impedance from the inlets of the external auditory canals thereof outward is close to that obtained when the listener 23 does not put the headphone on the head. Therefore, it is possible to facilitate localization of the reproduced sound image and it is possible for the listener 23 to feel more satisfactory when putting the headphone 24 on the head. While the digital vibratory gyroscope 28 is provided at the headband 27 in the above arrangement shown in FIG. 11, the digital vibratory gyroscope 28 may be provided at either of the left and right headphone units 93, 94.

Figure 12:
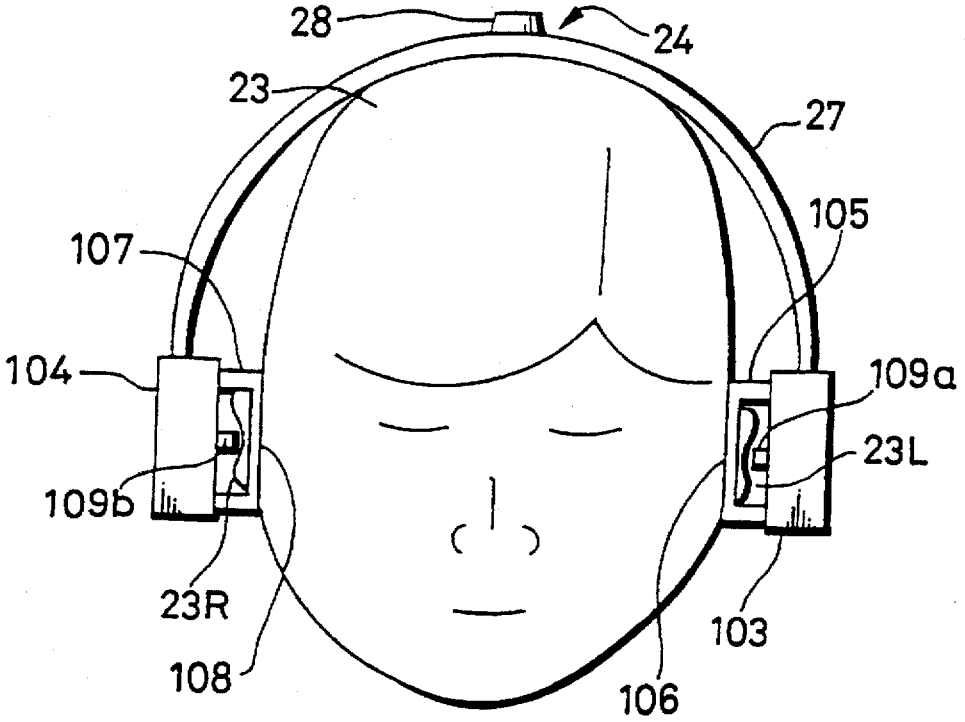
FIG. 12 is a diagram showing an overall arrangement of a headphone of the audio reproducing apparatus corresponding to a picture according to the embodiment of the present invention.

FIG. 12 shows another overall arrangement of the headphone of the audio reproducing apparatus corresponding to a picture according to the embodiment of the present invention. In FIG. 12, the digital vibratory gyroscope 28 and headphone units 103, 104 are provided at the headband 27 of the headphone 24. Contact portions 106, 108 are provided inside the headband 27 of the headphone 24 so as to be projected from supporting bars 105, 107. With this arrangement, the listener 23 can put the headphone 24 on the head with the headphone units 93, 94 being placed at positions away from the ears 23L, 23R of the listener 23 at a predetermined interval. When the listener 23 puts the headphone 24 on the head, it is possible to measure the reproduction characteristics by microphones **109*a*, 109*b* provided at the headphone units 103, 104 so as to be projected to the ears 23L, 23R of the listener 23**.

According to the arrangement shown in FIG. 12, since the headphone units 103, 104 are brought out of contact with the ears 23L, 23R of the listener 23 by the supporting bars 105, 107 and the contact portions 106, 108 as supporting members provided at the headband 27 as a head attachment body of the headphone as audio reproducing means and sound generating characteristics of the headphone units 103, 104 are set close to characteristics obtained when the audio signals are reproduced and reproduced sounds are picked up, a radiation impedance from the inlets of the external auditory canals thereof outward is close to that obtained when the listener 23 does not put the headphone on the head. Therefore, it is possible to facilitate localization of the reproduced sound image and it is possible for the listener 23 to feel more satisfactory when putting the headphone 24 on the head. While the digital vibratory gyroscope 28 is provided at the headband 27 in the above arrangement shown in FIG. 11, the digital vibratory gyroscope 28 may be provided at either of the left and right headphone units 103, 104.

Figure 13:
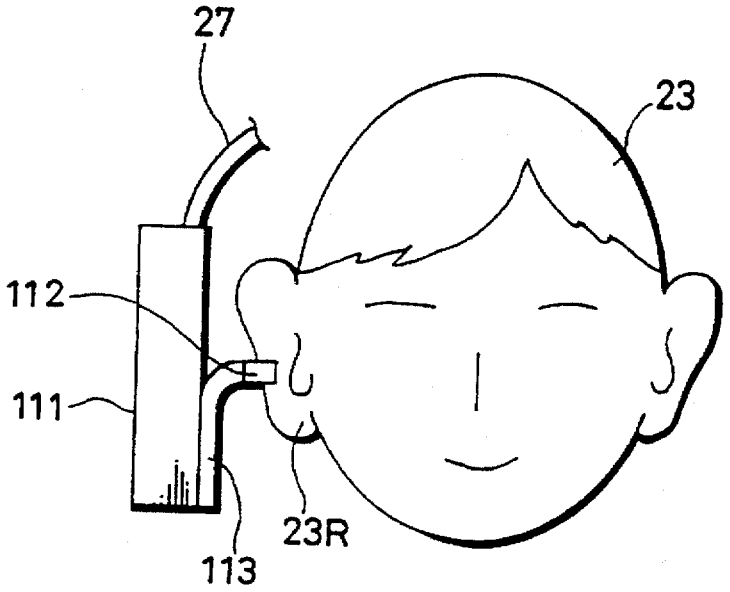
FIG. 13 is a diagram showing an attachment position of a microphone in the audio reproducing apparatus corresponding to a picture according to the embodiment of the present invention.
Figure 14:
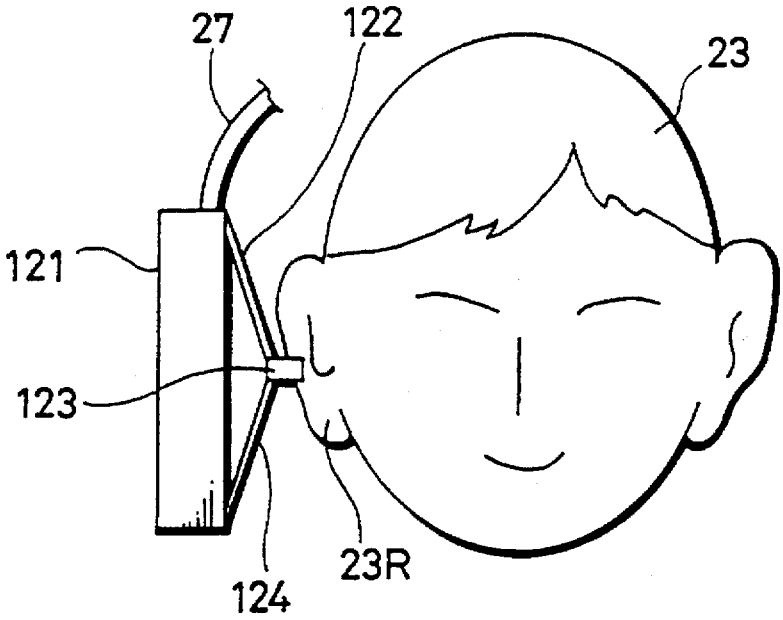
FIG. 14 is a diagram showing an attachment position of the microphone in the audio reproducing apparatus corresponding to a picture according to the embodiment of the present invention.
Figure 15:
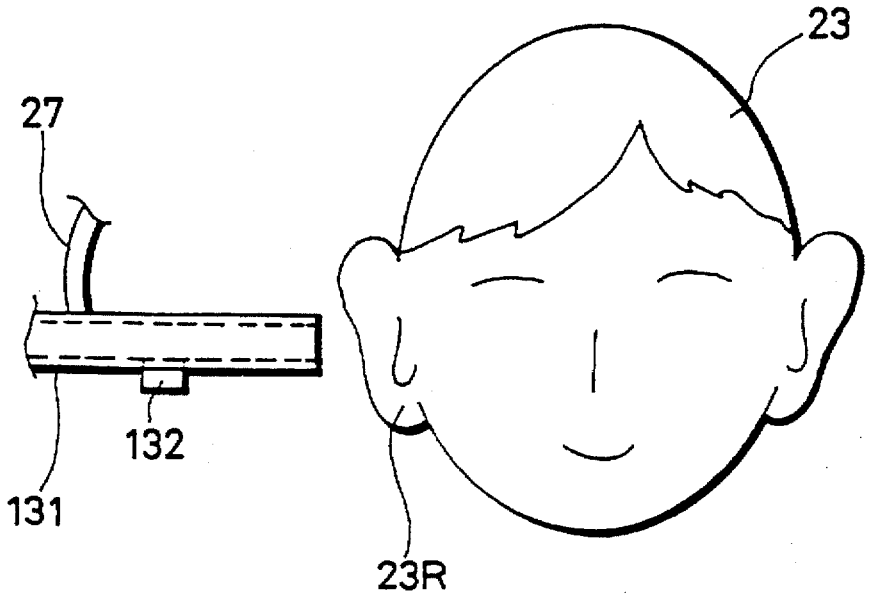
FIG. 15 is a diagram showing an attachment position of the microphone in the audio reproducing apparatus corresponding to a picture according to the embodiment of the present invention.

FIGS. 13 to 15 show specific positions where the microphones are attached. In FIG. 13, a flexible arm 113 is flexibly provided at a headphone unit 111 provided at an end portion of the headband 27 and a microphone 112 is provided at a head end of the flexible arm 113 so as to be opposed to an earhole of the right ear 23R of the listener 23.

In the above arrangement shown in FIG. 12, since the microphone 112 is a probe microphone, it is possible to reliably measure a noise, such as a reflected wave entering the earhole, through an actual measurement by moving the probe microphone with fine adjustment. Thus, it is possible for the adaptive processing filters 17, 18 to correct the digital signals with inverse characteristics.

In the arrangement shown in FIG. 14, a microphone 123 is fixed through arms 122, 124 to a headphone unit 121 provided at an end portion of the headband 27 so as to be opposed to the earhole of the right ear 23R of the listener 23.

According to the above arrangement shown in FIG. 14, since the microphone 123 is fixed to the headphone 24 through the arms 122, 124 as the supporting members so as to be opposed to the earhole of the right ear 23R of the listener 23, it is possible to reliably measure a noise, such as a reflected wave entering the earhole, or the like, through an actual measurement by moving the probe microphone with fine adjustment. Thus, it is possible for the adaptive processing filters 17, 18 to correct the digital signals with inverse characteristics.

In an arrangement shown in FIG. 15, a hollow-cylinder-shaped headphone unit 131 is provided at an end portion of the headband 27 such that a tip end portion of the headphone unit 131 is opposed to the earhole of the right ear 23R of the listener 23. A microphone 132 is fixed to the hollow-cylinder-shaped headphone unit 131 such that a tip end portion of the microphone 132 is projected toward an inside of the hollow-cylinder-shaped headphone unit 131.

According to the arrangements shown in FIGS. 11 to 15, since noise characteristics of audio signals are measured by picking up reproduced sounds of the audio signals through the microphones 99*a*, 99*b*, 109*a*, 109*b*, 112, 123 and 132 and the adaptive processing filters 17, 18 generate inverse characteristics of the measured noise characteristics, the adaptive processing filters 17, 18 correct the digital audio signals in respective channels corrected by the convolutional integrators 5, 7, 9 and 11, the memories 6, 8, 10 and 12, and the control apparatus 50 through 54 and 56 by using the inverse characteristics of the noise characteristics. Therefore, it is possible to reproduce the audio signals under the same conditions by removing any noises caused by differences among shapes of ears of the listeners 23 and smoothing the characteristics.

Figure 16:
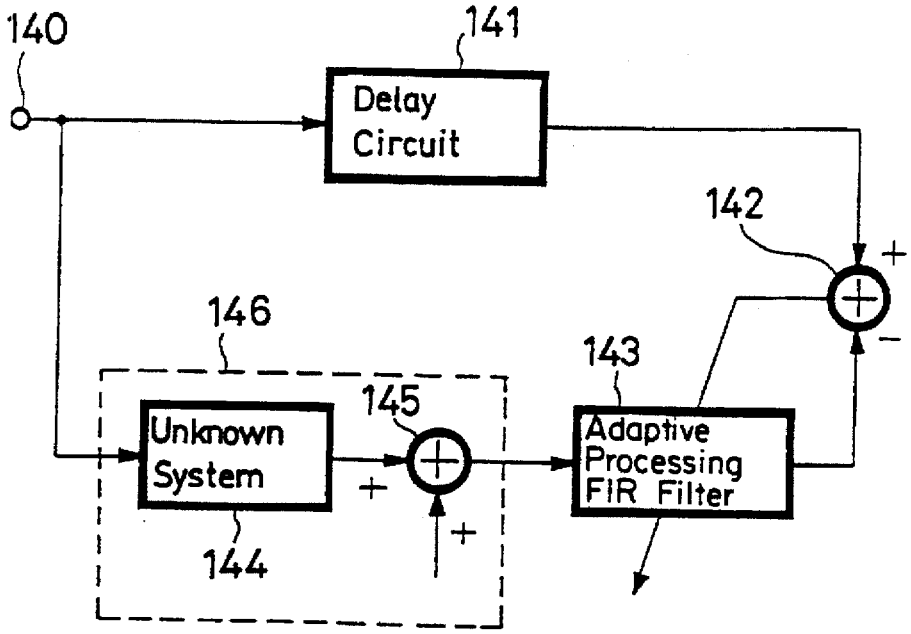
FIG. 16 is a block diagram showing an arrangement using an adaptive processing FIR filter of the indirect execution type in the audio reproducing apparatus corresponding to a picture according to the embodiment of the present invention.
Figure 17:
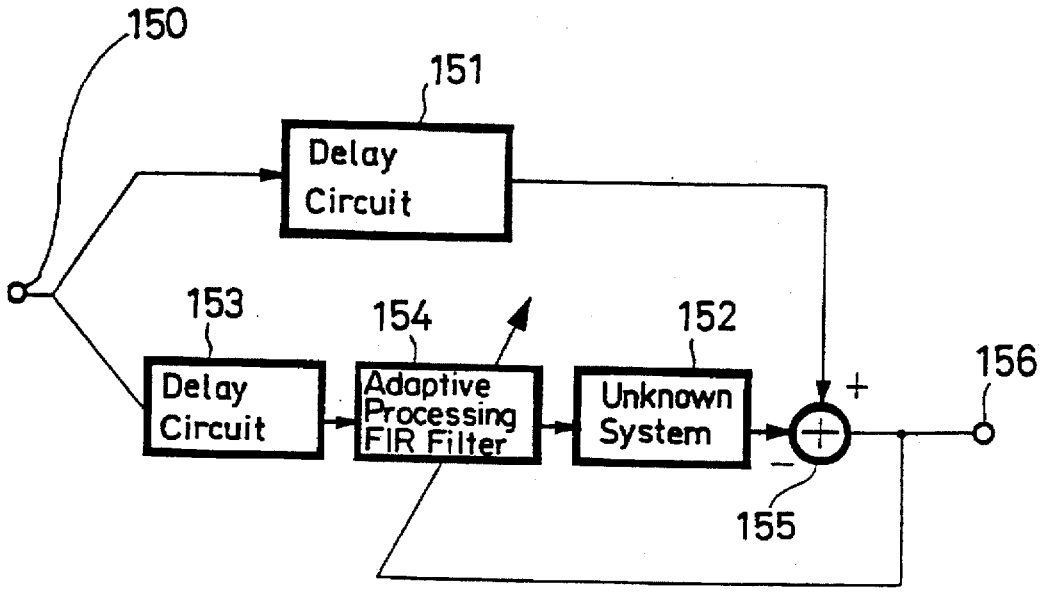
FIG. 17 is a block diagram showing an arrangement using an adaptive processing FIR filter of the direct execution type in the audio reproducing apparatus corresponding to a picture according to the embodiment of the present invention.

Adaptive processing FIR filters 143, 154 as shown in FIGS. 16 and 17, which are programmable digital filters, may be used as the adaptive processing filters 17, 18. In this case, initially, the reproduction characteristics are calculated by picking up the reproduced sounds through the microphones provided at the headphone units so as to be opposed to the earhole of the right ear 23R of the listener 23. Subsequently, the adaptive processing FIR filters 143, 154 generate the inverse characteristics for smoothing the reproduction characteristics. When the audio signals are supplied to the adaptive processing FIR filters 143, 154 in which the inverse characteristics are set, the adaptive processing FIR filters 143, 154 remove any characteristics caused by the difference in the shapes of the individual listeners 23 and the noises and any characteristics inherent in the headphone and sound source to be used from the supplied audio signals.

According to the arrangements shown in FIGS. 11 to 15, since the adaptive processing FIR filters 143, 154 are employed as the adaptive processing filters 17, 18, it is possible to form the digital filters by programs under the desired conditions and to process the audio signals in the digital signal processing.

As described above, since the audio signals L, R are corrected based on the digitally recorded impulse responses to the impulse signal from the virtual sound source positions, corresponding to the direction of the head of the listener 23, with respect to the reference direction to both ears or the control signals representing the sound arrival times and the sound pressure levels of the sounds obtained at both ears, it is possible to obtain the sound field which allows the listener 23 to feel as if the sounds were reproduced by a plurality of the speakers located at the virtual sound source positions.

Since the control signals which are digitally recorded in the tables of the memory 35 and represent the sound arrival times that the sound pressure levels of the sounds obtained at the both ears are read out therefrom and purely electronically supplied to the control apparatus 50 through 54 and 56 to and the control apparatus 50 through 54 and 56 correct the digital signals subjected by the convolutional integrators 5, 7, 9 and 11 and the memories 6, 8, 10 and 12 to convolution integral together with the impulse responses based on the supplied control signals, it is possible to prevent the change of the characteristics of the audio signals with respect to the direction of the head of the listener 23 from being delayed and to prevent the listener 23 from feeling unnatural.

At this time, since reverberation signals generated by the reverberation circuits 13, 14 are supplied to the headphone 24, it is possible to add the audio signals L, R with such spacial impression that is obtained in a listening room or a concert hall. Therefore, it is possible to obtain an excellent stereophonic sound field.

According to the arrangement shown in FIGS. 2 and 3, the digital vibratory gyroscope 28 or the analog vibratory gyroscope 38 as the angle detecting means supplies the signal corresponding the detected angle to the address control circuit 34. Based on the signals corresponding to the detected angle, the address control circuit 34 supplies to the memory 35 as second storage means the address signal used for designating the address of the memory 35. Based on the address signals, the controls signals are read out from the memory 35. Based on the read control signals, the control apparatus 50 through 54 and 56 correct the digital signals subjected by the convolutional integrators 5, 7, 9 and 11 and the memories 6, 8, 10 and 12 to convolution integration together with the impulse responses, and correct the digital audio signals with respect to the head movements of one or a plurality of listeners 23 in a real-time fashion. The adaptive processing filters 17, 18 remove the external noises from the audio digital signals in respective channels corrected by the convolutional integrators 5, 7, 9 and 11, the memories 6, 8, 10 and 12 and the control apparatus 50 through 54 and 56. Thus, it is possible to reproduce the audio signals through the headphone 24 as the audio reproducing means.

FIGS. 16 and 17 show block diagrams showing arrangements used to calculate the inverse characteristics by using the adaptive processing filters. FIG. 16 is a block diagram showing an arrangement used to calculate the inverse characteristics by an adaptive processing FIR filter of an indirect execution type. In FIG. 16, an input signal is input to an input terminal 140. The input signal is supplied to a delay circuit 141 and an apparatus 146 to be measured. The apparatus 146 to be measured has an unknown system 144 and an adder 145 which adds a signal supplied thereto from the unknown system 144 and a noise N formed of a maximum period sequence signal which is a digitally generated binary pseudo irregular signal. The added signal is supplied to the adaptive processing FIR filter 143.

An adder 142 subtracts a signal output from the adaptive processing FIR filter 143 from a signal output from the delay circuit 141. The adaptive processing FIR filter 143 is supplied with a signal output from the adder 142. Thus, the adaptive processing FIR filter 143 changes its output signal so as to converge a value of signal output from the adder 142 toward a value of zero. Thus, inverse characteristics of the unknown system 144 are calculated. By using a filter coefficient obtained after the value of the signal output from the adder 142 becomes zero, the adaptive processing FIR filter 143 smooths the characteristics of the unknown system 144.

In this case, the input signal input to the input terminal 140 may be the audio signals supplied from the two-channel analog signal source 2 shown in FIGS. 2 and 3. The noise formed of the maximum period sequence signal which is the digitally generated binary pseudo irregular signal may be used in order that the value of the signal output from the adder 142 can promptly become zero. In the unknown system 144, its inputs are the audio signals applied to the right and left sound generators 25, 26 or the headphone units 93 and 94, 103, and 104, 111, 121 or 131 shown in FIGS. 2, 3 or 11 through 15, and its outputs are the audio signals obtained by picking up sounds by the microphones 99*a* and 99*b*, 109*a* and 109*b*, 112, 123 or 132 shown in FIGS. 11 through 15.

As described above, the inverse characteristics of the characteristics inherent in the headphone 24 are calculated by using the microphones 99*a* and 99*b*, 109*a* and 109*b*, 112, 123 or 132 shown in FIGS. 11 through 15. The adaptive processing FIR filter 143 smooths frequency characteristics of the audio signals to be reproduced by using the coefficient obtained by the impulse responses to the unknown system to the audio signals.

According to the arrangement shown in FIG. 16, since the adaptive processing filters 17, 18 are those of the indirect execution type which carry out processings after measurement of the characteristics, it is possible to cancel the extraneous noise by generating the inverse characteristics of the measured characteristics based on the measurement of the characteristics.

FIG. 17 is a block diagram showing an arrangement used to calculate the inverse characteristics by using an adaptive processing FIR filter of a direct execution type. In FIG. 17, an input signal or a measurement noise is input to an input terminal 150. The input signal or the added noise is supplied to delay circuits 151 and 153. A signal output from the delay circuit 153 is supplied to an adaptive processing FIR filter 154.

An adder 155 subtracts a signal supplied from the adaptive processing FIR filter 154 through an unknown system 152 from a signal output from the delay circuit 151. At this time, if an extraneous noise entering the unknown system 152 has no correlation with the input signal, then the adaptive processing FIR filter 154 corrects the characteristics of a system from the audio reproducing means to the microphone by making the signal from the adaptive processing FIR filter 154 through the unknown system 152 close to the input signal supplied to the input terminal 150. Accordingly, the adaptive processing FIR filter 154 can remove the extraneous noise entering the unknown system 152.

In the arrangement shown in FIG. 17, since the adaptive processing filters 17, 18 of FIGS. 2 and 3 are those of the direct execution type which successively carry out the measurement of the characteristics of the unknown system 152 and the processing based on the inverse characteristics thereof, it is possible for the adaptive processing filters 17, 18 to cancel the external noise while carrying out the measurement of the characteristics and the generation of the inverse characteristics.

Figure 18A:
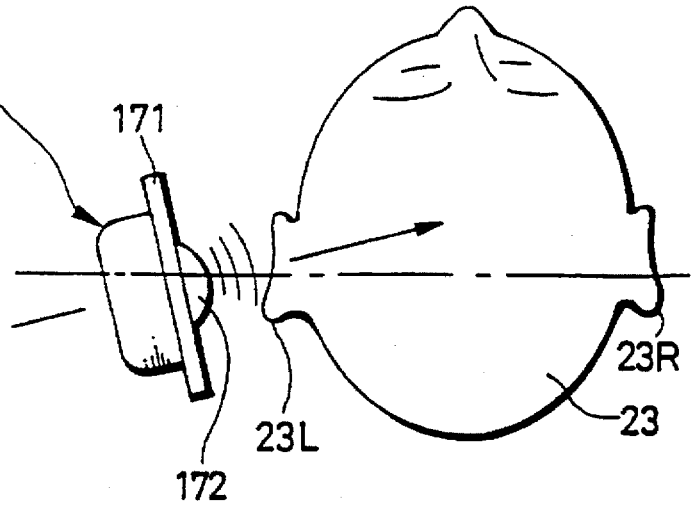
FIGS. 18 is pictorial representations each showing an arrangement in which a headphone unit can be moved in the forward and backward directions in the audio reproducing apparatus corresponding to a picture according to the embodiment of the present invention.
Figure 18B:
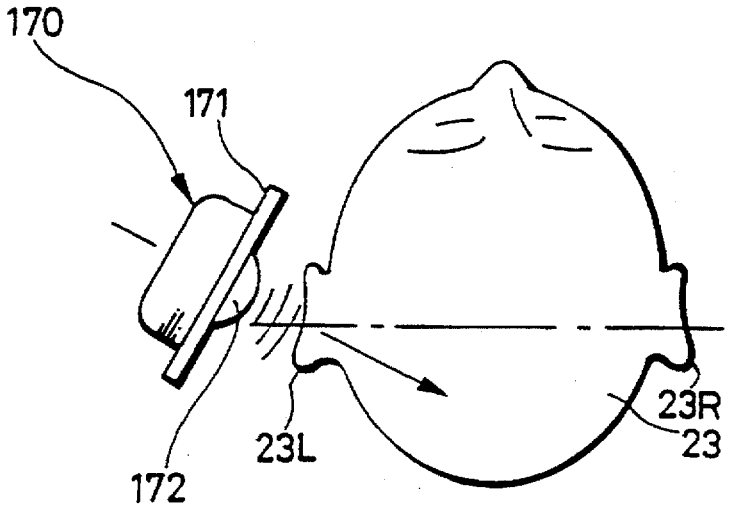
Figure 18C:
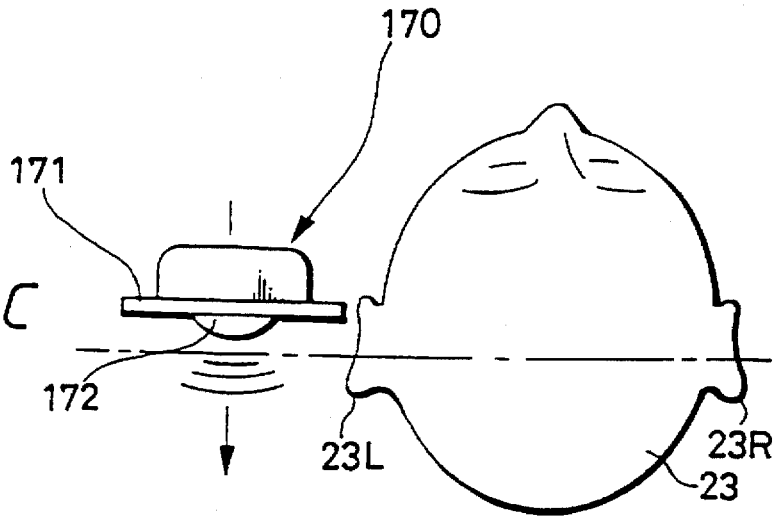

FIGS. 18A to 18C show arrangements in which a headphone unit 170 as a sound generator unit of the audio reproducing apparatus corresponding to a picture according to the embodiment of the present invention can be moved in the forward and backward directions. FIG. 18A shows an arrangement in which an angle of a plane of a baffle plate 171 as a fixed portion of the headphone unit 170 and a diaphragm 172 as a sound generating portion thereof relative to a straight line passing through left and right ears 23L, 23R of the listener 23 is set not to a right angle but to an angle at which the plane is slightly faced forward.

This arrangement reduces an influence of such an unnecessary reflection that a sound wave once radiated from the diaphragm 172 is reflected by an auricle portion of the left ear 23L and further reflected by the diaphragm 172. Moreover, it becomes easy for an external sound from a forward side to arrive at the left ear 23L. In this case, it becomes easy to localize the sound image in front of the listener 23.

FIG. 18B shows an arrangement in which an angle of the plane of the baffle plate 171 and the diaphragm 172 relative to the straight line passing through left and right ears 23L, 23R of the listener 23 is set not to a right angle but to an angle at which the surface is slightly faced backward. This arrangement reduces an influence of such an unnecessary reflection that the sound wave once radiated from the diaphragm 172 is reflected by the auricle portion of the left ear 23L and further reflected by the diaphragm 172. Moreover, it becomes easy for an external sound from a backward side to arrive at the left ear 23L.

FIG. 18C shows an arrangement in which an angle of the plane of the baffle plate 171 and the diaphragm 172 relative to the straight line passing through left and right ears 23L, 23R of the listener 23 is set to an angle of 0°. This arrangement reduces an influence of such an unnecessary reflection that the sound wave once radiated from the diaphragm 172 is reflected by the auricle portion of the left ear 23L and further reflected by the diaphragm 172. Moreover, it becomes easy for an external sound from a backward side to arrive at the left ear 23L.

According to the arrangements shown in FIGS. 18A to 18C, since the headphone unit 170 as the sound generating unit is disposed so as to be opposed to each of both ears 23L, 23R of the listener 23 and the plane of the headphone unit 170 opposing to each of both ears 23L, 23R of the listener 23 is provided with being inclined at a predetermined angle in the forward or backward direction so as not to be at the right angle relative to the straight line passing through both ears 23L, 23R, it is possible to reduce the sound wave from the diaphragm 172 of the headphone unit 170 reflected by the left ear 23L of the listener 23 and a side portion of the head thereof and to emphasize the sound wave arriving from a direction toward which the plane of the headphone unit 170 is faced. If the plane of the headphone unit 170 is faced forward, then it is possible to localize the sound image in front of the listener 23. If the plane of the headphone unit 170 is faced backward, then the sound wave reflected by the auricle portion is reduced. Therefore, it is possible to facilitate the correction and to pick up the sound in front of the listener 23.

Figure 19A:
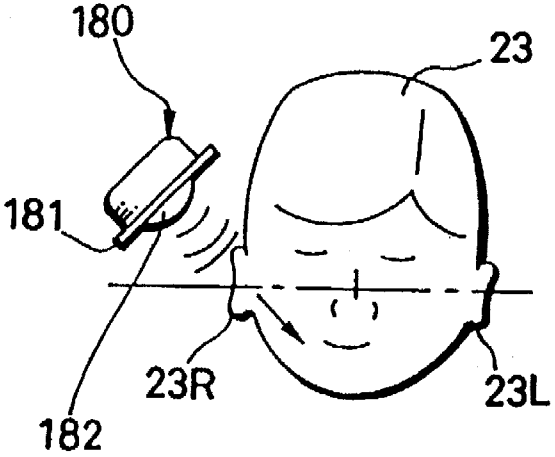
FIGS. 19 is pictorial representations each showing an arrangement in which the headphone unit can be moved in the upward and downward directions in the audio reproducing apparatus corresponding to a picture according to the embodiment of the present invention.

FIGS. 19A TO 19D show arrangements in which a headphone unit 180 as a sound generator unit of the audio reproducing apparatus corresponding to a picture according to the embodiment of the present invention can be moved in the vertical direction. FIG. 19A shows an arrangement in which an angle of a plane of a baffle plate 181 as a fixed portion of the headphone unit 180 and a diaphragm 182 as a sound generating portion thereof relative to a straight line passing through left and right ears 23L, 23R of the listener 23 is set not to a right angle but to an angle at which the plane is faced downward.

Figure 19B:
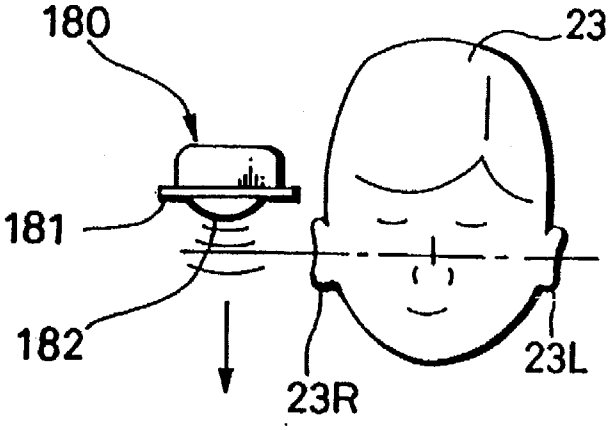

FIG. 19B shows an arrangement in which the angle of the plane of the baffle plate 181 and the diaphragm 182 relative to the straight line passing through left and right ears 23L, 23R of the listener 23 is set to an angle of 0° and the plane is faced downward.

Figure 19C:
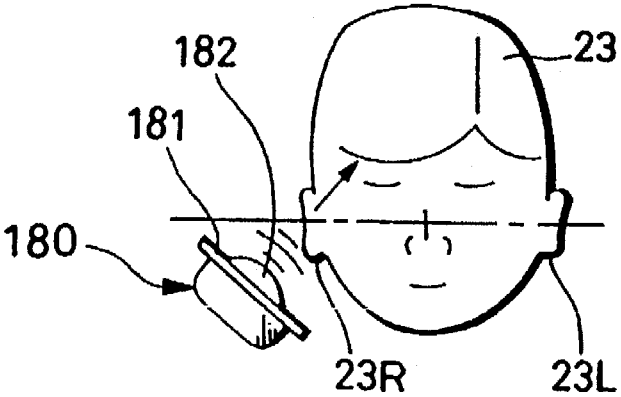

FIG. 19C shows an arrangement in which the angle of the plane of the baffle plate 181 and the diaphragm 182 relative to the straight line passing through left and right ears 23L, 23R of the listener 23 is set to not the right angle but an angle at which the plane is faced upward.

Figure 19D:
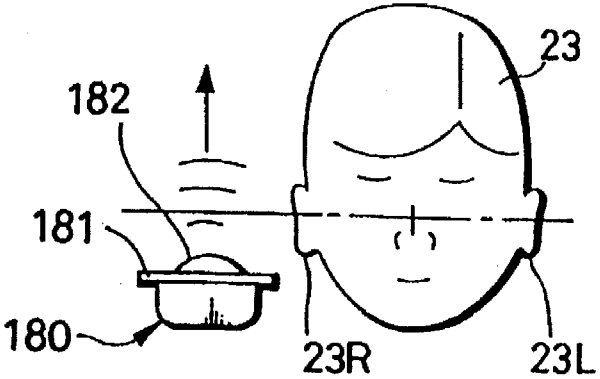

FIG. 19D shows an arrangement in which the angle of the plane of the baffle plate 181 and the diaphragm 182 relative to the straight line passing through left and right ears 23L, 23R of the listener 23 is set to an angle of 0° and the plane is faced upward.

According to the arrangements shown in FIGS. 19A to 19D, since the headphone unit 180 as the sound generating unit is disposed so as to be opposed to each of both ears 23L, 23R of the listener 23 and the plane of the headphone unit 180 opposing to each of both ears 23L, 23R of the listener 23 is provided with being inclined at a predetermined angle in the vertical direction so as not to be at the right angle relative to the straight line passing through both ears 23L, 23R, it is possible to reduce the sound wave from the diaphragm 182 of the headphone unit 180 reflected by the left ear 23L of the listener 23 and the side portion of the head thereof and to emphasize the sound wave arriving from a direction toward which the plane of the headphone unit 180 is faced.

Figure 20:
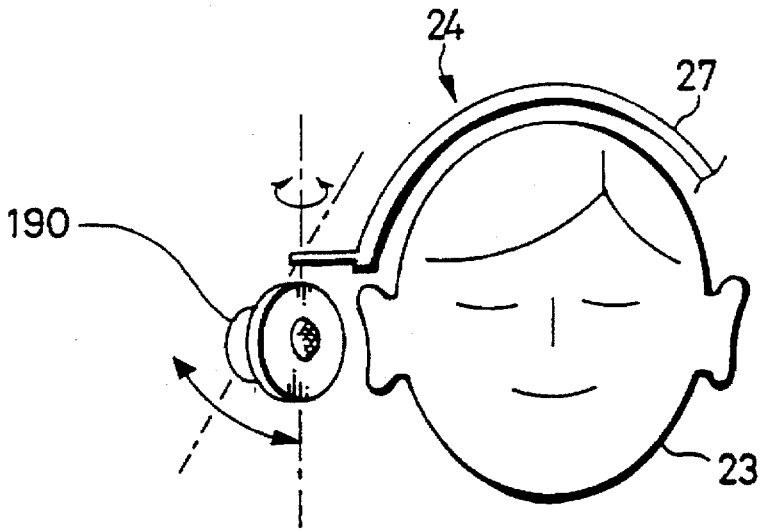
FIG. 20 is a pictorial representation showing an arrangement in which the headphone unit can be adjusted at an optional angle in the audio reproducing apparatus corresponding to a picture according to the embodiment of the present invention.

FIG. 20 shows an arrangement in which a headphone unit 190 as a sound generator unit of the audio reproducing apparatus corresponding to a picture according to the embodiment of the present invention can be moved and adjusted to be faced at an arbitrary angle. A headphone unit 192 can be rotated relative to a head band 27 of the headphone 190 and adjusted to be faced at an arbitrary angle. In this case, as shown in FIG. 21, a headphone unit 200 can be rotated relative to a supporting body 201 provided at an end portion of the headband 27 with a rotating body 202 being slidably in contact with a hollow portion, having a spherical shape, of the supporting body 201.

Figure 21:
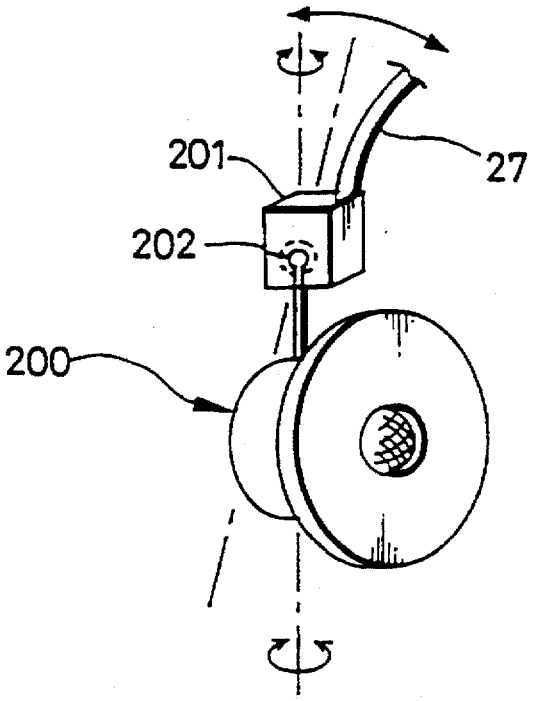
FIG. 21 is a perspective view showing an arrangement in which the headphone unit can be adjusted at an arbitrary angle in the audio reproducing apparatus corresponding to a picture according to the embodiment of the present invention.
Figure 22A:
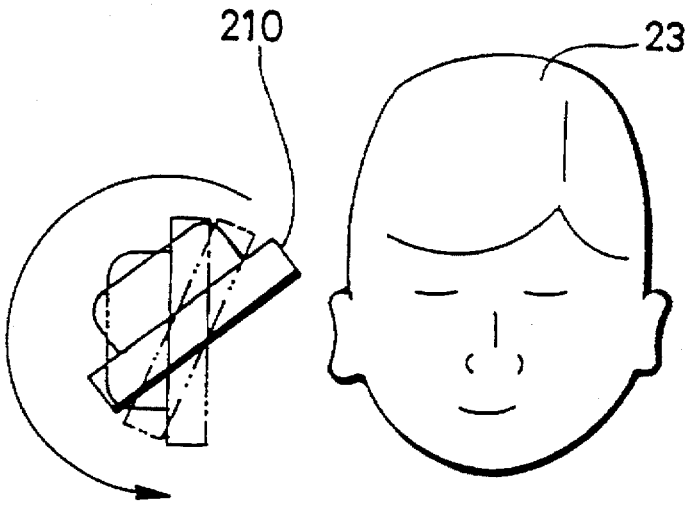
FIGS. 22 is pictorial representations used to explain operation of the arrangement in which the headphone unit can be adjusted at an arbitrary angle in the audio reproducing apparatus corresponding to a picture according to the embodiment of the present invention.
Figure 22B:
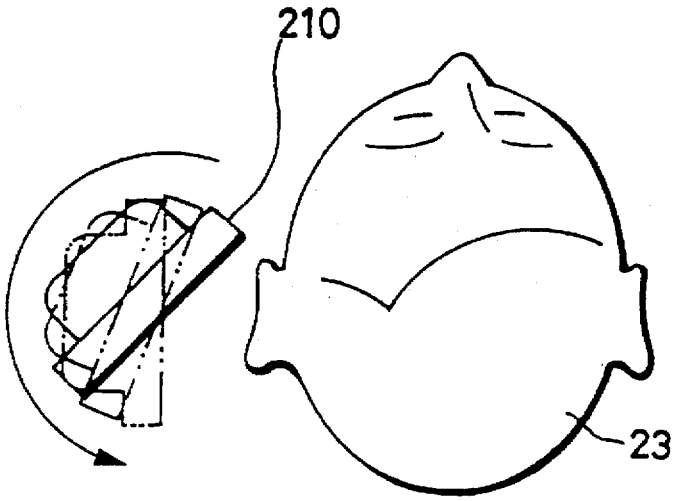

This arrangement shown in FIG. 21 allows a headphone unit 210 to be rotated in the vertical direction relative to the listener 23 as shown in FIG. 22A and to be rotated in the forward and backward direction relative to the listener 23 as shown in FIG. 22B.

According to the arrangements shown in FIGS. 20, 21, 22A and 22B, since the headphone units 190, 200 and 210 as the sound generating units are disposed so as to be opposed to each of the both ears of the listener 23 and the planes of the headphone units 190, 200 and 210 opposing to each of both ears of the listener 23 are provided with being inclined at an arbitrary angle relative to the straight line passing through the both ears, it is possible to reduce the sound waves from the headphone units 190, 200 and 210 reflected by the left ear of the listener 23 and the side portion of the head thereof and to emphasize the sound wave arriving from a direction toward which the plane of the headphone unit 170 is inclined. Moreover, it is possible to avoid an influence caused by difference among shapes of the auricles of the ears of the listener 23.

Figure 23A:
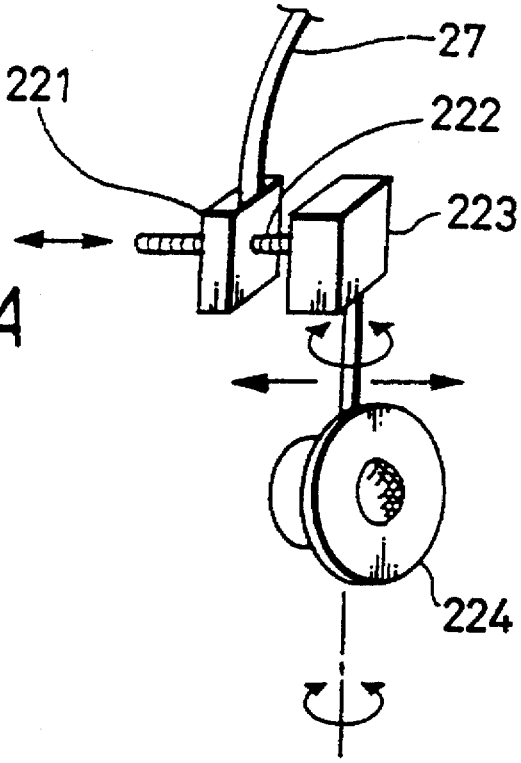
FIGS. 23 is perspective views each showing an arrangement in which the headphone unit can be moved in the horizontal direction in the audio reproducing apparatus corresponding to a picture according to the embodiment of the present invention.
Figure 23B:
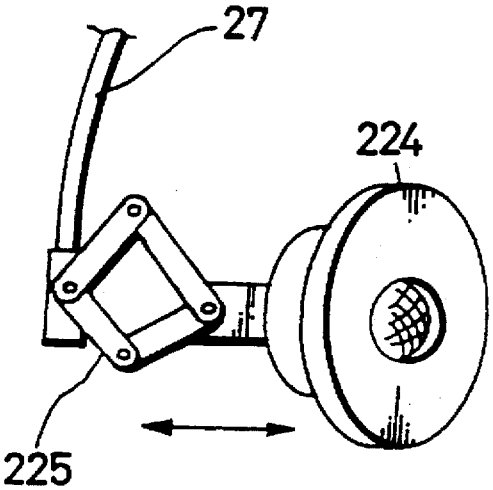

FIG. 23A and 23B shows an arrangement in which a headphone unit 224 as a sound generator unit of the audio reproducing apparatus corresponding to a picture according to the embodiment of the present invention can be moved in the horizontal direction. FIG. 23A shows an arrangement in which the headphone unit 224 provided at a moving body 223 provided through a ball thread at an end portion of the headband 27 can be moved in the horizontal direction. FIG. 23B shows an arrangement in which a pantagraph-shaped member 225 is provided at an end portion of the headband 27 and the headphone unit 224 provided at the other end portion of the pantagraph-shaped member 225 can be moved in the horizontal direction by extending or contracting the pantagraph-shaped member 225.

According to the arrangements shown in FIGS. 23A and 23B, it is possible to keep the plane of the headphone unit 224 corresponding to each of both ears of the listener close to or away from the each of the left and right ears 23. Therefore, it is possible to avoid the influence caused by the difference among the shapes of the auricles of the individual listeners.

Figure 24A:
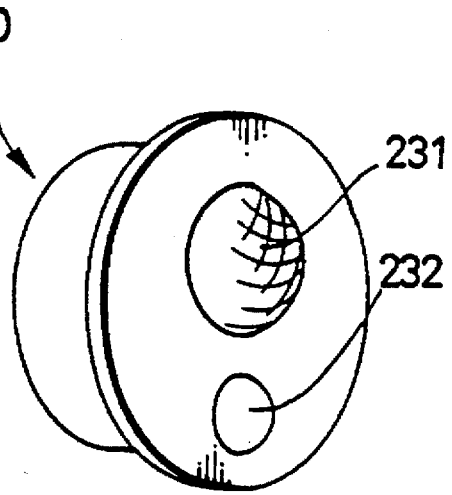
FIG. 24A is a perspective view showing a headphone unit formed of a plurality of units in the audio reproducing apparatus corresponding to a picture according to the embodiment of the present invention.
Figure 24B:
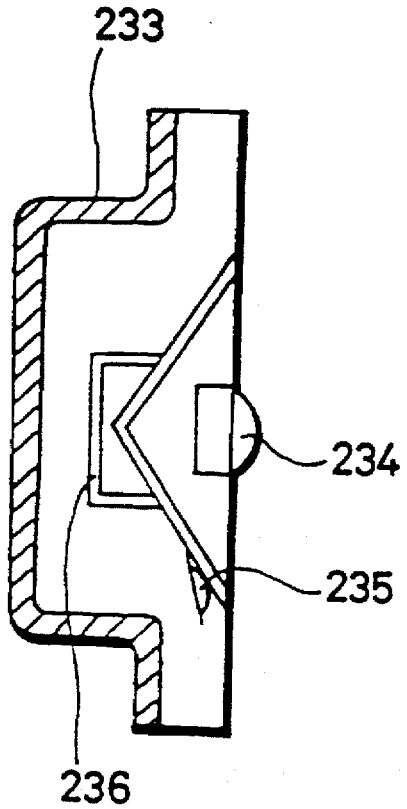
FIG. 24B is a cross-sectional side view thereof.

FIGS. 24A and 24B show arrangements in which a headphone unit as a sound generating unit of the audio reproducing apparatus corresponding to a picture according to the embodiment of the present invention is formed of a plurality of units. FIG. 24A shows an arrangement in which a headphone unit 230 is formed of a bass sound generating unit 231 and a treble sound generating unit 232. FIG. 24B shows an arrangement in which a headphone unit 233 is formed of a low-frequency band sound (bass sound) generating unit 235 and a high-frequency band sound (treble sound) generating unit 234 provided on the former and to which audio signals are supplied through a coaxial cable 236.

According to the arrangements shown in FIGS. 24A and 24B, since a bandwidth of an audio signal is divided into a plurality of bands the headphone units 230, 233 respectively have a plurality of sound generating units 231, 232 and 234, 235 corresponding to a plurality of divided bands, the plurality of sound generating units 231, 232 and 234, 235 radiate the sounds. Therefore, it is possible to clarify the characteristics of the audio signals and to correct the audio signals easily.

Figure 25:
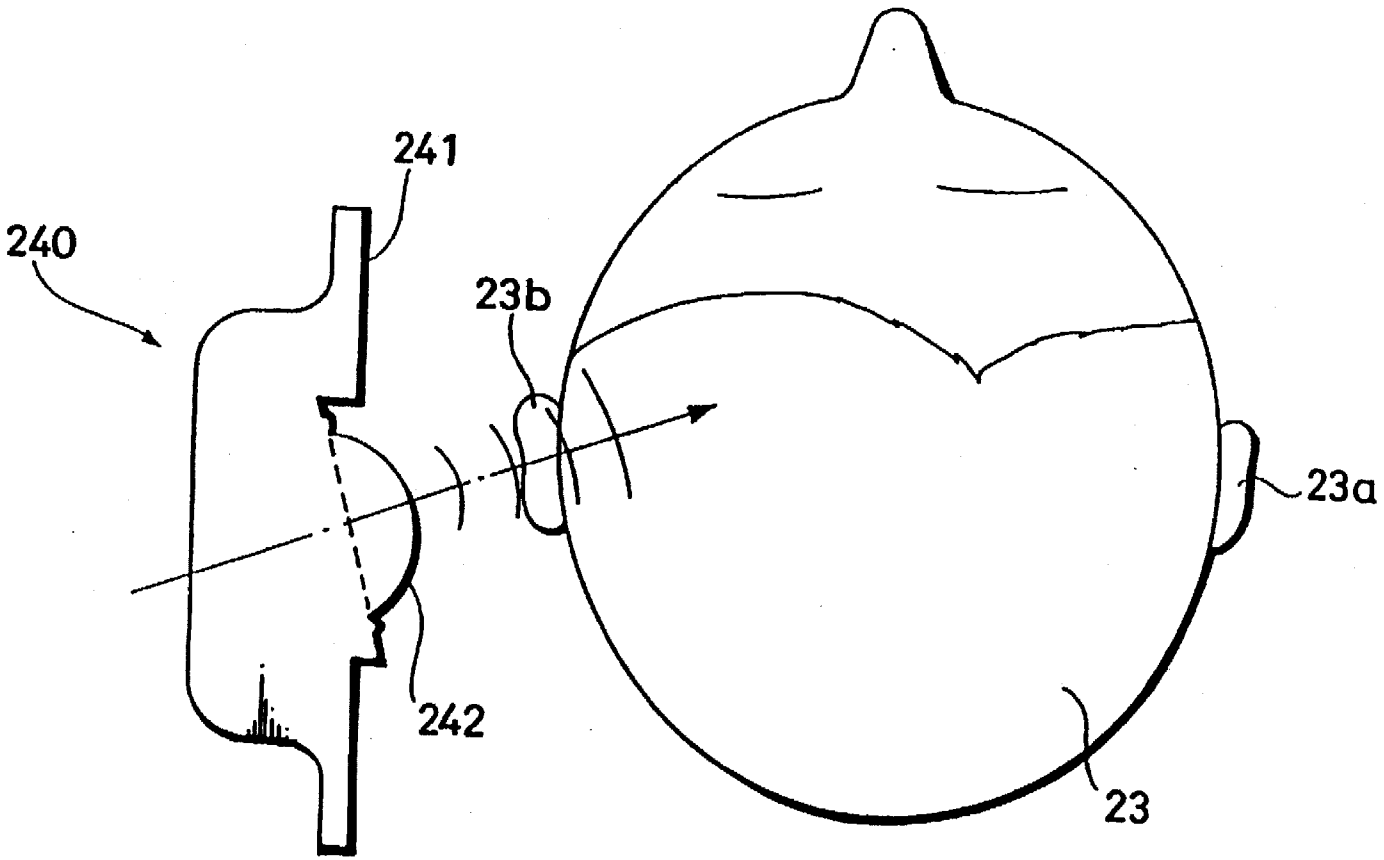
FIG. 25 is a pictorial representation showing an arrangement in which angles of a baffle plate and a diaphragm are changed in the audio reproducing apparatus corresponding to a picture according to the embodiment of the present invention.

FIG. 25 shows an arrangement in which a headphone unit 240 as a sound generating unit of the audio reproducing apparatus corresponding to a picture according to the embodiment of the present invention has a diaphragm 242 inclined at a predetermined angle relative to a baffle plate 241. In this case, a plane of the baffle plate 241 as a fixed portion of the headphone unit 240 is provided at a right angle relative to the straight line passing through the left and right ears 23*a*, 23*b* of the listener 23 and an angle of a plane of the diaphragm 242, which is a sound generating unit as a vibrating unit of the headphone unit 240, relative to the above straight line is set to not the right angle but an angle at which the plane of the diaphragm 242 is inclined.

According to the arrangement shown in FIG. 25, the diaphragm 242 is provided so as to be inclined relative to the baffle plate 241 attached to the headphone unit 240 and an angle of inclination of the diaphragm 242 is changed, it is possible to reduce the sound wave from the diaphragm 242 reflected by the left ear 23*a* of the listener 23 and a side portion of the head thereof and to change an effect of picking up the sound.

Figure 26:
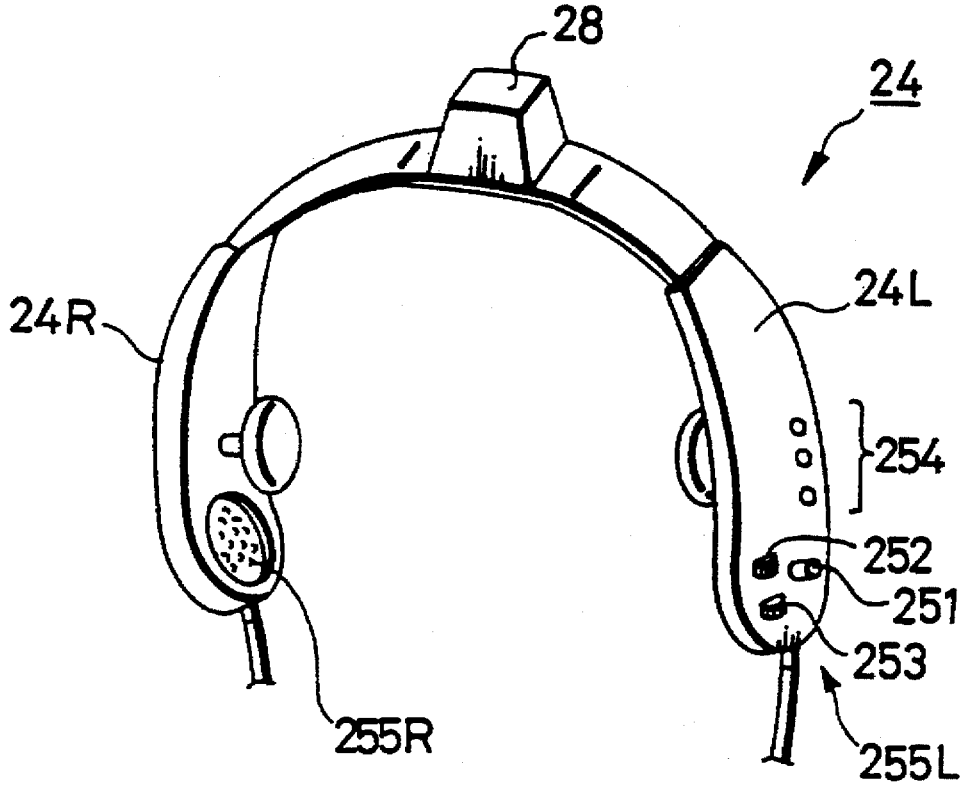
FIG. 26 is a perspective view showing a headphone of the audio reproducing apparatus corresponding to a picture according to the embodiment of the present invention.
Figure 27:
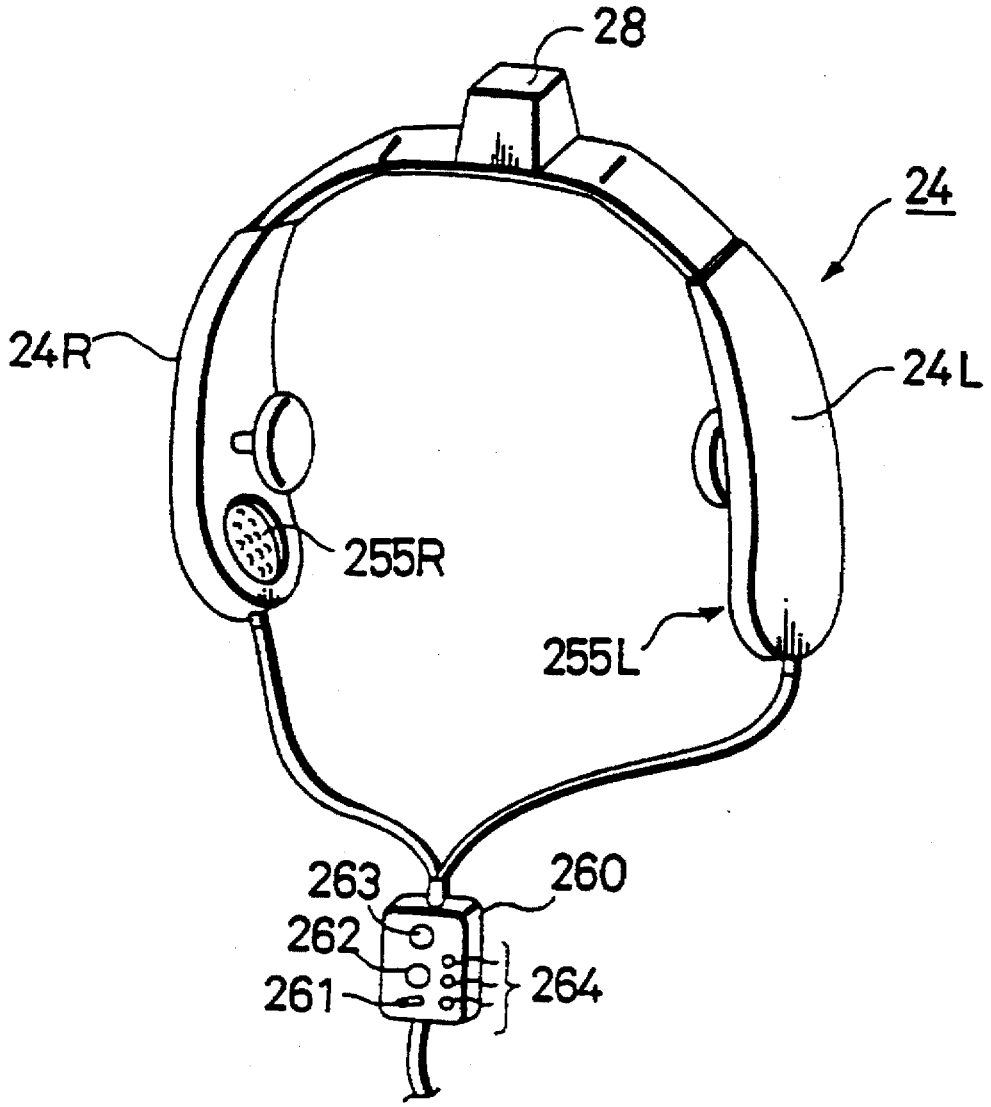
FIG. 27 is a perspective view showing a headphone of the audio reproducing apparatus corresponding to a picture according to the embodiment of the present invention.

While only the correction circuits for canceling the characteristics inherent in the headphone 24 and the sound source for measurement of the impulse signals used for measuring the characteristics of the headphone 24 is provided at the headphone 24 in the above arrangements, other switches and so on used for the signal processing may be provided thereat. FIGS. 26 and 27 show another arrangement of the headphone of the audio reproducing apparatus corresponding to a picture according to the embodiment of the present invention.

In FIG. 26, the headphone 24 is provided with the digital gyroscope 28, a left arm 24L, and a right arm 24R. A left unit 255L is provided on an inside surface of the left arm 24L, and a right unit 24R is provided on an inside surface of the right arm 24R. A reset switches 251, volume adjustment dial 252, a balance adjusting dial 253, a changeover switch 254 for selecting a sound source, reverberation, a sound field and so on are provided on an outside surface of the left arm 24L. The correction circuits for canceling the characteristics inherent in the headphone 24 are provided as electric circuits inside the left and right arms 24L, 24R. However, the present invention is not limited thereto and the correction circuits may be provided at other members, units or parts of the headphone 24.

FIG. 27 shows still another arrangement of the headphone 24 having a remote control unit 260 provided with a reset switch 261, a volume adjusting dial 262, a balance adjusting dial 263, and changeover switches 264 for selecting a sound source, reverberation, a sound field and so on. In the headphone 24 shown in FIGS. 26 and 27, only the correction circuits for canceling the characteristics inherent in the headphone 24 are provided on the headphone side and other circuits are provided on the side of the audio reproducing apparatus body 1. The reason for this arrangement is that a consumed power of the correction circuits for canceling the characteristics inherent in the headphone 24 is comparatively small and hence provision of the correcting circuits on the headphone side does not apply much electrical load. Accordingly, it is needless to say that other circuits maybe provided on the headphone side if their consumed power is low.

While the headphone 24 is connected with the audio reproducing apparatus body 1 through a signal line in the arrangements shown in FIGS. 26 and 27, the audio signal may be reproduced through the headphone 24 in a wireless fashion by providing a modulator and a transmitter at a stage succeeding the convolutional integrators 5, 7, 9 and 11 shown in FIG. 2 to receive the transmission signal by a receiver and a demodulator or by providing a modulator and a transmitter at a stage succeeding the adders 15, 16 shown in FIG. 3 to receive a transmission signal by a receiver and a demodulator.

Figure 28:
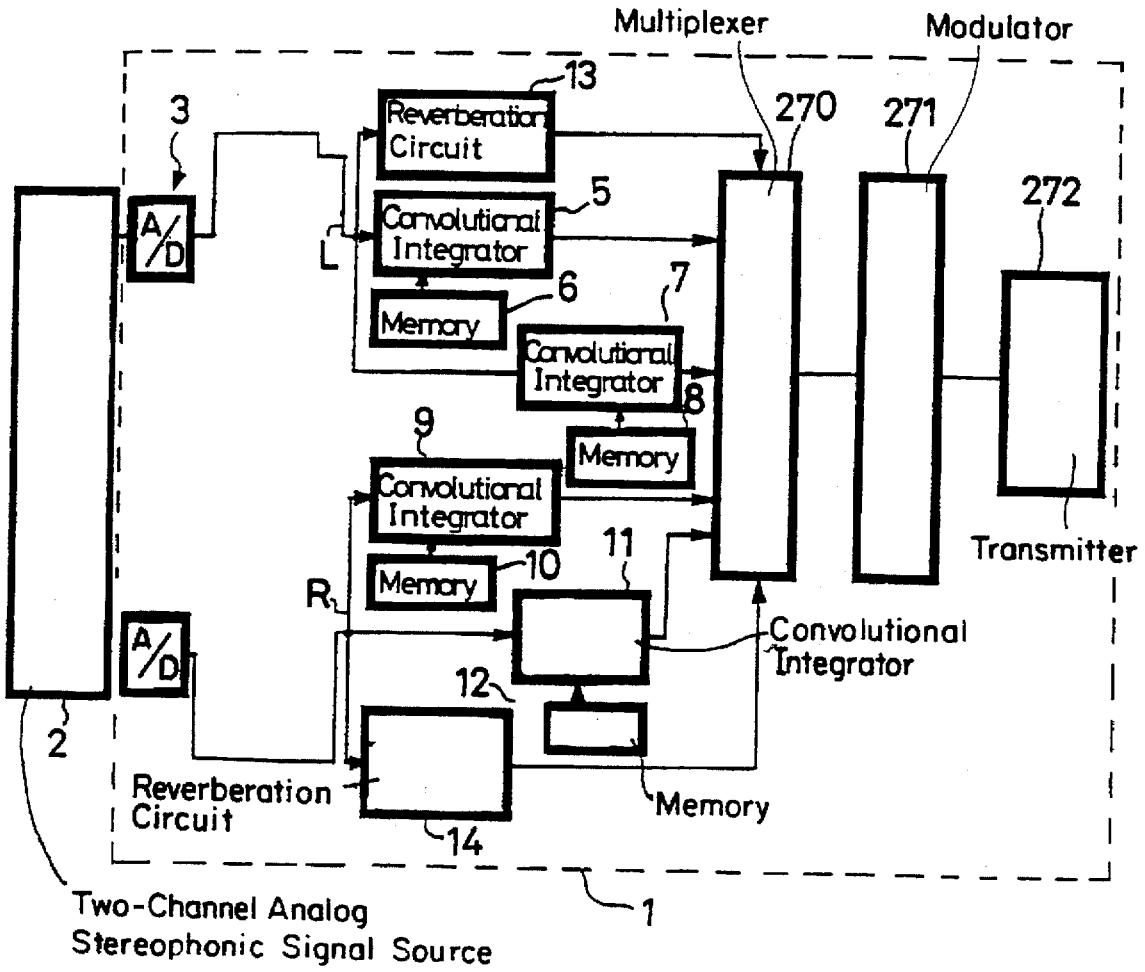
FIG. 28 is a block diagram showing a transmission unit of the audio reproducing apparatus corresponding to a picture according to the embodiment of the present invention.

FIGS. 28 to 33 show arrangements in which the audio signal is transmitted in a wireless fashion. FIG. 28 is a block diagram showing a transmission unit of the audio reproducing apparatus corresponding to a picture according to the embodiment of the present invention. Initially, in a transmission unit, the audio reproducing apparatus body 1 is supplied with the two-channel analog signal from the two-channel analog signal source 2. The audio reproducing apparatus body 1 is arranged as follows. As shown in FIG. 28, the digital signal series subjected by the convolutional integrators 5, 7, 9 and 11 and the memories 6, 8, 10 and 12 to convolution integral together with the impulse responses are supplied to a multiplexer 270. The multiplexer 270 multiplexes the supplied digital signal series and supplies the multiplexed digital signal series to the modulator 271. The modulator 271 modulates the multiplexed digital signal series in a predetermined fashion and supplies the modulated digital signal series to a transmitter 272. The transmitter 272 transmits the digital signal series as an electromagnetic wave.

Figure 29:
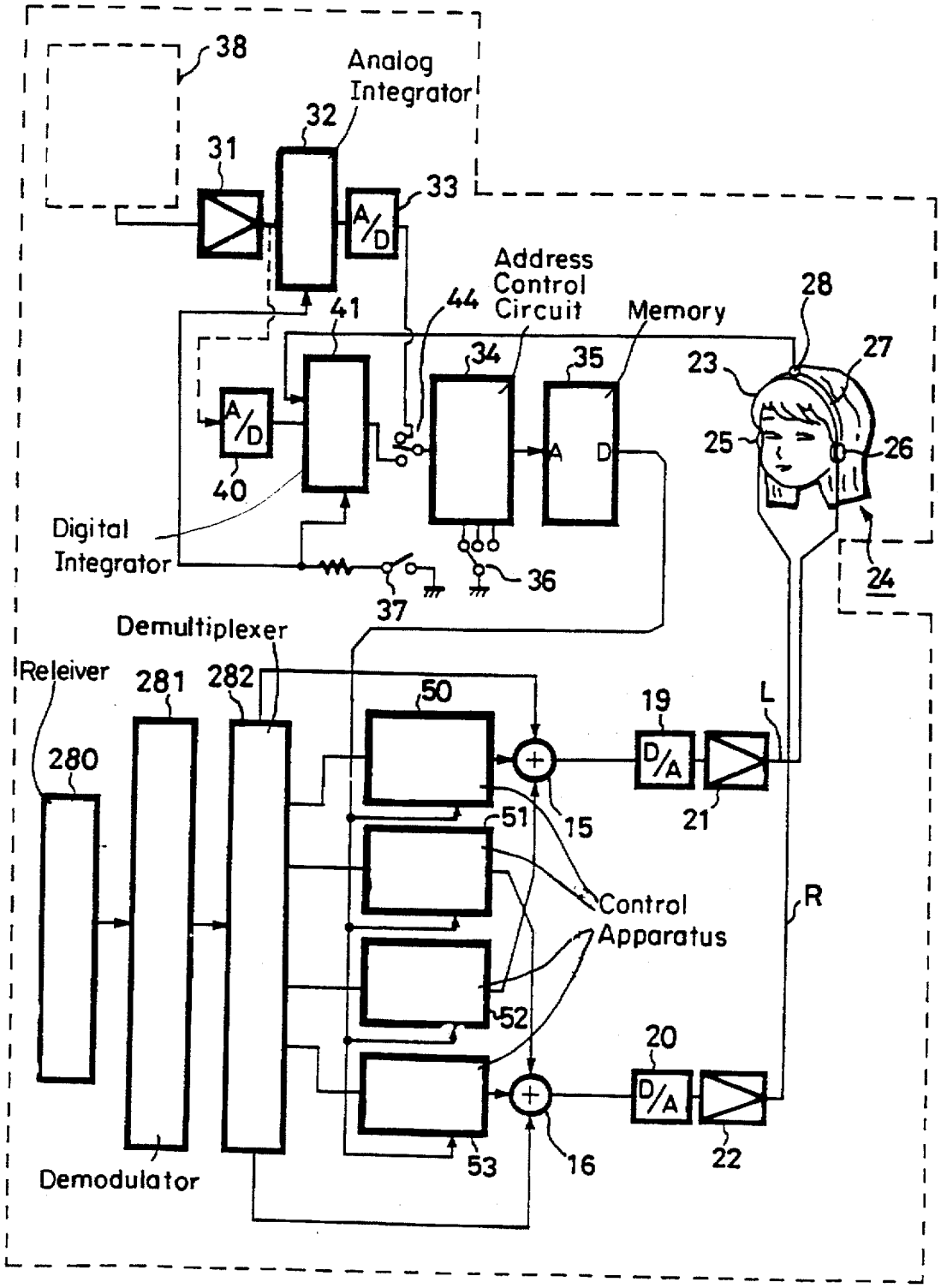
FIG. 29 is a block diagram showing a reception unit of the audio reproducing apparatus corresponding to a picture according to the embodiment of the present invention.

FIG. 29 is a block diagram showing a reception unit of the audio reproducing apparatus corresponding to a picture according to the present invention. The reception unit shown in FIG. 29 corresponds to the transmission unit shown in FIGURE 28. As shown in FIG. 29, the electromagnetic wave which is obtained from the digital signal series subjected to convolution integration and transmitted from the transmission unit shown in FIG. 28 is received by a receiver 280. The receiver 280 converts a received electromagnetic wave into a digital audio signal and supplies the digital audio signal to a demodulator 281. The demodulator 281 demodulates the digital audio signal and supplies the demodulated digital audio signal to a demultiplexer 282. The demultiplexer 282 divides the demodulated digital audio signal and supplies the divided digital audio signals to the control apparatus 50 to 53.

The digital signal indicative of the head movement relative to the reference direction of the head in the direction in which the listener 23 turns the head at present is converted into the digital address signal representing the magnitude including the direction at every constant unit angle or every predetermined angle. Based on the digital address signal, the control signals representing the sound arrival times and the sound pressure levels of the sounds obtained at the both ears from the virtual sound source positions to the both ears are read out from the memory 35. The control apparatus 50 to 53 correct the digital audio signals in a real-time fashion based on the control signals supplied from the memory 35.

The digital audio signals thus corrected by the control apparatus 50 to 53 are supplied to the adders 15, 16 and added thereby to obtain the two-channel digital audio signals. The reverberation signals are directly added to the digital audio signals by the adders 15, 16.

The two-channel digital audio signals are converted by the D/A converters 19, 20 into the analog signals which are supplied to the power amplifiers 21, 22. The power amplifiers 21, 22 amplify the supplied analog signals and supply the amplified analog signals to the headphone 24. The correcting circuits 17, 18 provided in the headphone 24 further correct the two-channel analog signals with respect to the characteristics inherent in the headphone and the sound source used when the control signals were measured. Specifically, the correcting circuits 17, 18 have the correction characteristics for canceling the characteristics inherent in the headphone 24 and the sound source used based upon the impulse responses to a sound field from the virtual sound source position to both ears of the listener 23. Thus, it is possible for the listener 23 to listen to the sounds from the left and right sound generators 24, 26 of the headphone 24.

As described above, the digital audio signals are subjected by the convolutional integrators 5, 7, 9 and 11 and the memories 6, 8, 10 and 12 to convolution integration together with the digitally recorded impulse responses to a sound field from the virtual sound source position with respect to the reference direction to both ears of the listener 23 in the fixed direction. Thereafter, the digital audio signals are transmitted by the transmitter 272 as the electromagnetic wave. The digital audio signals from the receiver 280 are corrected by the control apparatus 50 to 53 in a real-time fashion based on the control signals representing the sound arrival times and the sound pressure levels of the sounds obtained at the both ears from the virtual sound source position in the direction in which the listener 23 turns the head with respect to the reference direction of the head to the both ears. The correcting circuits 17, 18 cancel either or both of the characteristics inherent in the headphone and the sound source used when the control signals were measured. Thus, it is possible to carry out the digital signals processing including the correction in a real-time fashion with the wireless transmission being employed.

Figure 30:
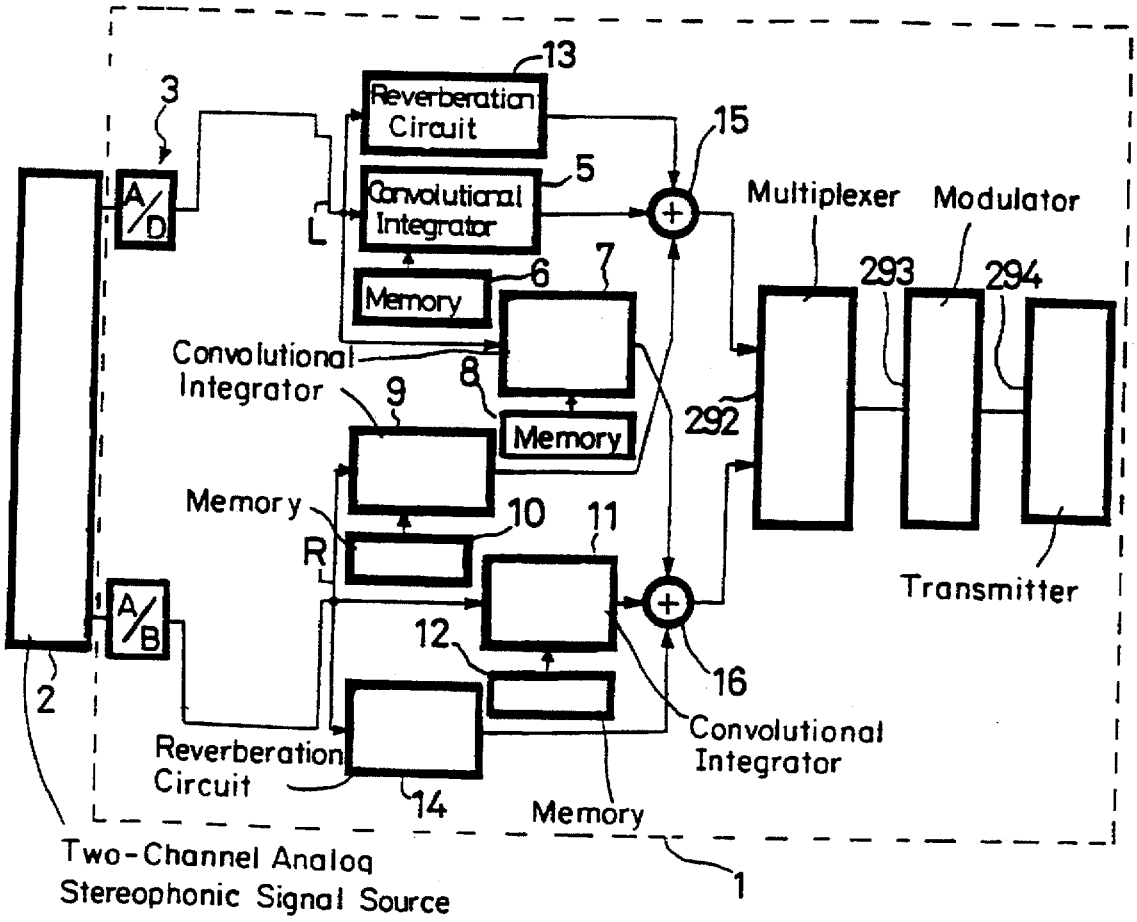
FIG. 30 is a block diagram showing a transmission unit of the audio reproducing apparatus corresponding to a picture according to other embodiment of the present invention.

FIG. 30 shows another arrangement of the transmission unit of the audio reproducing apparatus corresponding to a picture according to the present invention. In the arrangement shown in FIG. 30, the digital audio signals subjected by the convolutional integrators 5, 9 and the memories 6, 10 to convolution integration together with the impulse responses are supplied to the adder 15 and added thereby. The digital audio signals subjected by the convolutional integrators 7, 11 and the memories 8, 12 to convolution integration together with the impulse responses are supplied to the adder 16 and added thereby.

At this time, the reverberation signals from the reverberation circuits 13, 14 are supplied to the adders 15, 16. The left- and right-channel digital signals in two channels supplied from the adders 15, 16 are supplied to a multiplexer 292.

Figure 31:
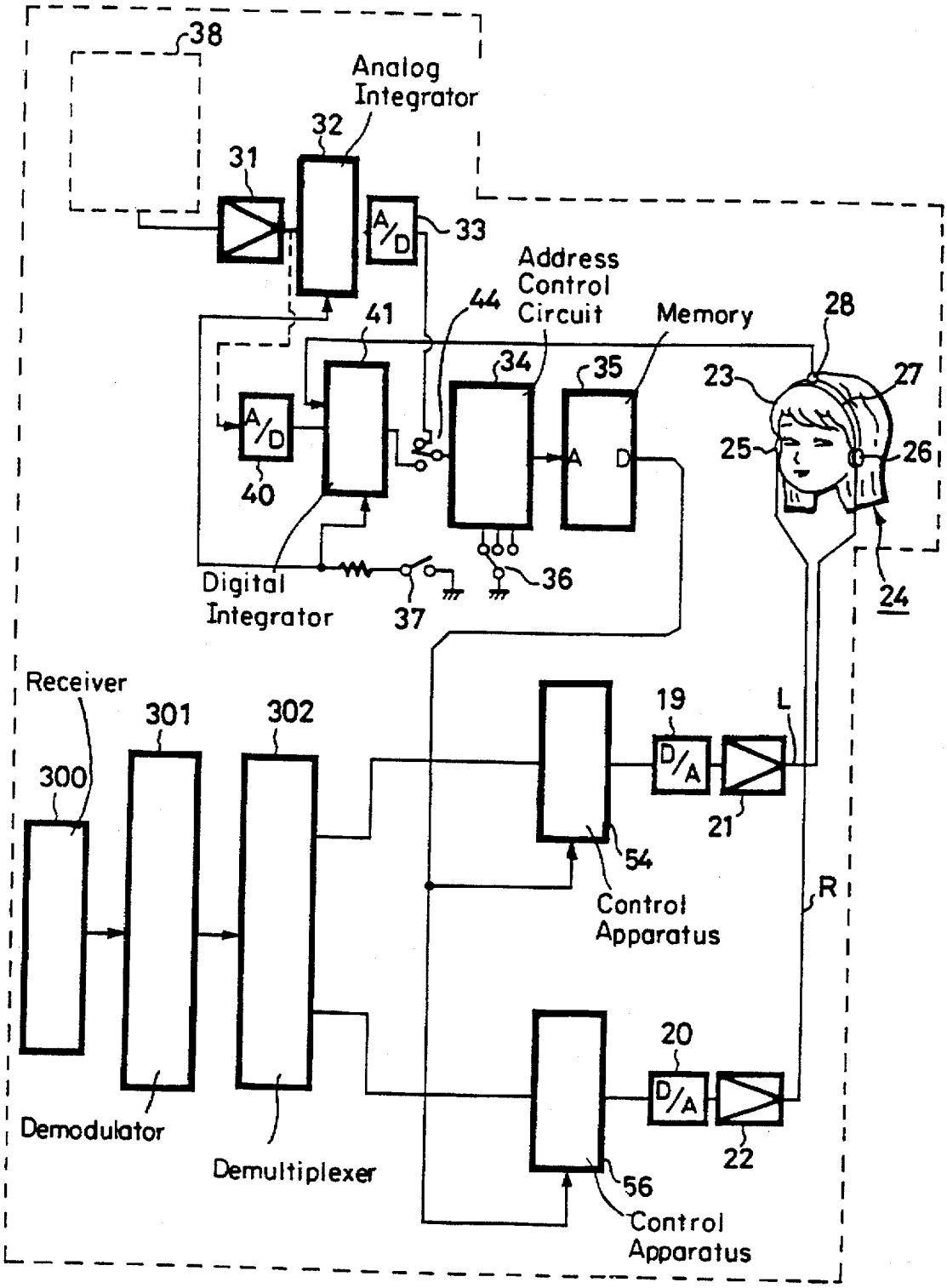
FIG. 31 is a block diagram showing another reception unit of the audio reproducing apparatus corresponding to a picture according to the embodiment of the present invention.

FIG. 31 shows other arrangement of the reception unit of the audio reproducing apparatus corresponding to a picture according to the present invention. The reception unit shown in FIG. 31 corresponds to the transmission unit shown in FIG. 30. In the arrangement shown in FIG. 31, two-channel digital signals from a demodulator 30 and a demultiplexer 302 are supplied to the control apparatus 54, 56.

Figure 32:
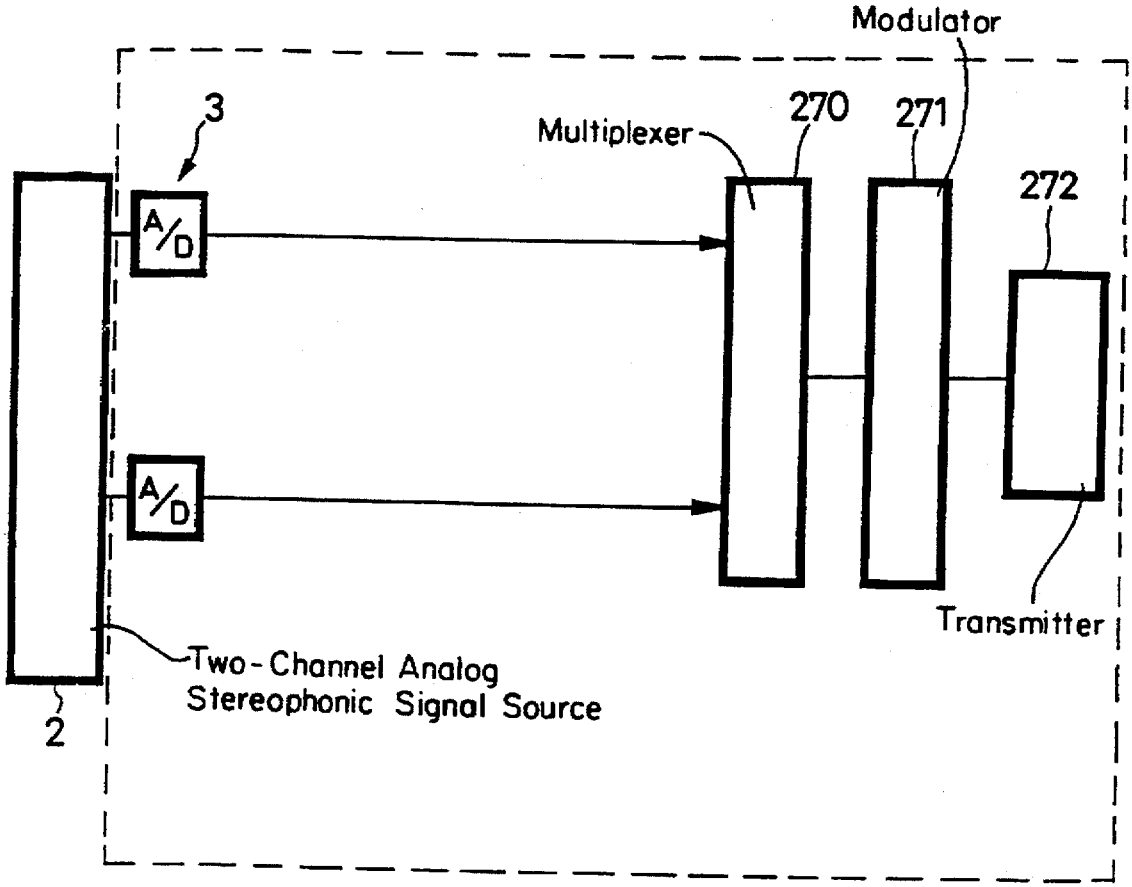
FIG. 32 is a block diagram showing a transmission unit of the audio reproducing apparatus corresponding to a picture according to other embodiment of the present invention.
Figure 33:
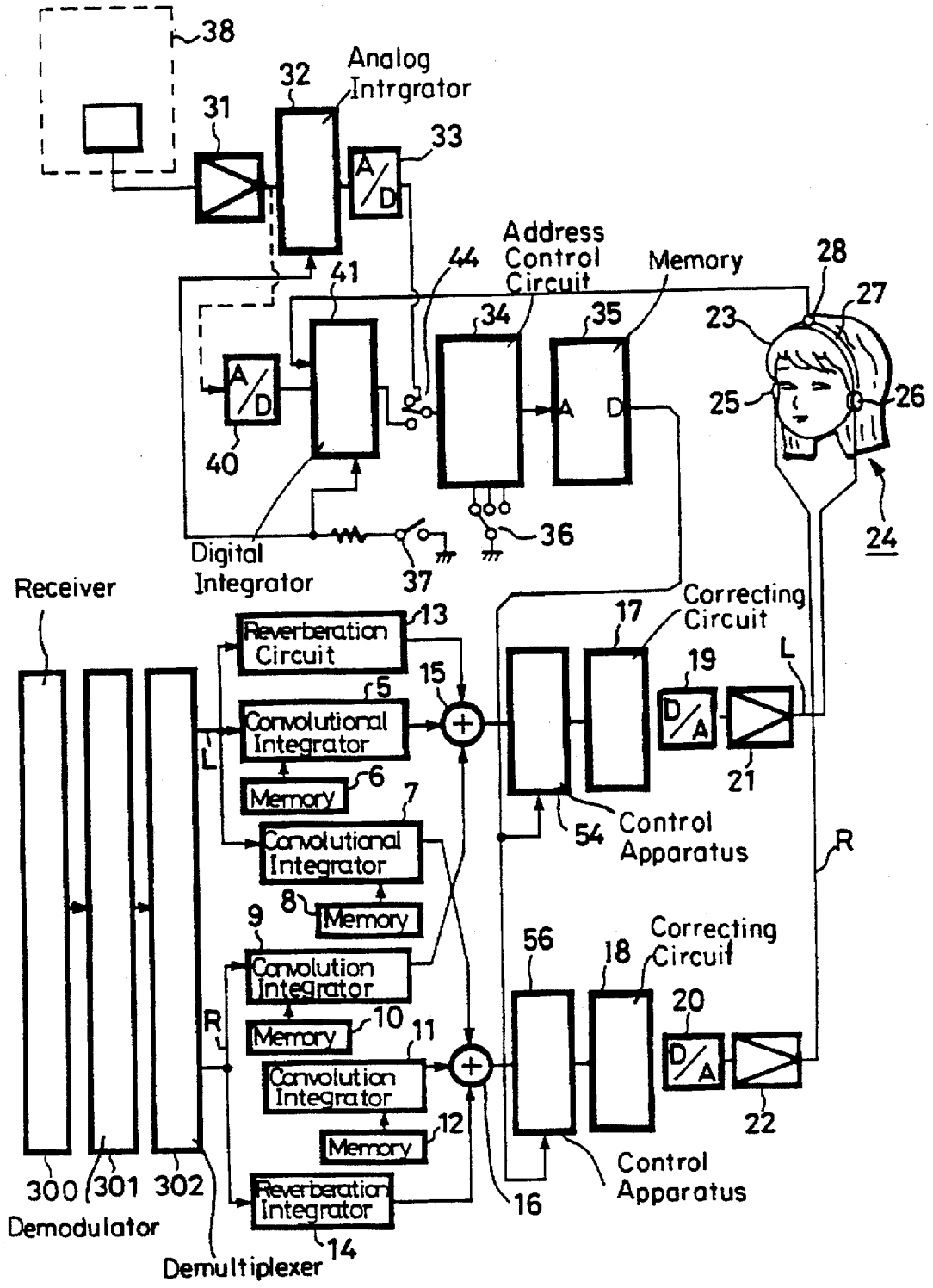
FIG. 33 is a block diagram showing a reception unit of the audio reproducing apparatus corresponding to a picture according to other embodiment of the present invention.

Arrangements shown in FIGS. 32 and 33 may also be employed. In the arrangement shown in FIG. 32, the A/D converter shown generally at 3 convert the analog signals supplied from the two-channel analog signal source 2 into the digital signals and supply the digital signals directly to the multiplexer 270. The multiplexer 270 supplies the multiplexed two-channel analog signals through the modulator 271 to the transmitter 272. The transmitter 272 transmits the transmission signal to a reception unit shown in FIG. 33. In the arrangement shown in FIG. 33, a receiver 300 receives the transmission signal. The transmitted audio signals are processed and then reproduced through the headphone 24. Other parts shown in FIG. 33 are arranged similarly to those shown in FIG. 3.

According to the arrangements shown in FIGS. 28 to 31, since the digital signals or the analog signals obtaining the spatial information by the convolution integration together with the impulse responses are transmitted by the transmitters 272, 294, cords of the respective headphones 24 of a plurality of listeners 23 are prevented from getting entangled. Therefore, even if the number of listeners 23 increases, it is possible to easily provide extra reception units without any change of the wiring and circuits.

While the transmitters 272, 294 of the transmission units shown in FIGS. 28 and 30 transmit the electromagnetic waves to the reception units 280, 300 of the reception units shown in FIGS. 29 and 31 in the arrangements shown in FIGS. 8 to 31, each of the transmitters 272, 294 of the transmission units shown in FIGS. 28 and 30 and the reception units 280, 300 of the reception units shown in FIGS. 29 and 31 could also be formed as a transceiver having both a transmitter and a receiver. When the electromagnetic wave is transmitted from the transmission unit to the reception unit, the reception unit may transmit to the transmission unit the electromagnetic wave indicative of a signal-processing change signal to change contents of the signal processing in the transmission unit. In this case, the signal-processing change signal may be used to change the characteristics of the reverberation circuits 13, 14 or to change the various characteristics that can be selected in the transmission unit.

With this arrangement, it becomes possible to carry out bidirectional communication between the transmission unit and the reception unit and to carry out control with satisfactory operability. Since the bidirectional communication which allows control from the reception unit to the transmission unit is employed, it becomes possible to control the various characteristics which can be selected in the transmission unit, such as the switching of the two-channel analog signal source 2, change of data stored in the memories 6, 8, 10 and 12 for obtaining the spatial information which enhances the reproduction effect, or the like, by the reception unit on the side of the listener 23. Therefore, it is possible to improve the operability.

The headphones 24 shown in FIGS. 26 and 27 can be used in each of the audio reproducing apparatus shown in FIGS. 30 and 31 and the audio reproducing apparatus shown in FIGS. 32 and 33. Especially, the reception units of the audio reproducing apparatus shown in FIGS. 29, 31 and 33 receive the signal of the reproduced sound in a wireless transmission and transmit various kinds of adjusting signals in a wireless transmission. In this case, the headphone 24 has the reception unit other than the digital vibratory gyroscope 28. The headphone 24 may have the transceiver having both of the transmitter and the receiver.

According to the arrangements shown in FIGS. 28 to 33, when the audio signal to be reproduced corresponds to a picture, the listener 23 can always use the various adjusting switches while watching the picture so that, it is possible to improve the operability.

Figure 34A:
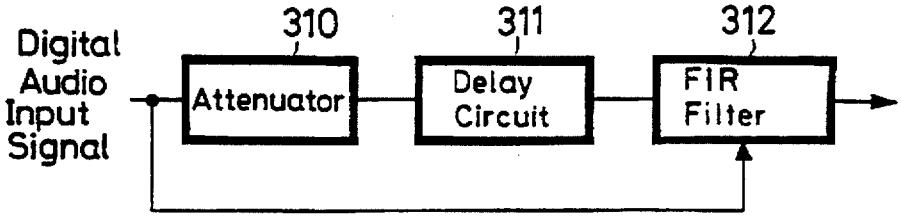
FIG. 34 is block diagrams each showing a signal processing unit for subjecting a signal to convolution together with the impulse response by using an FIR filter in the audio reproducing apparatus corresponding to a picture according to the embodiment of the present invention.

FIG. 34A is a block diagram showing an arrangement of a signal processing unit in which the digital signal and the impulse response are subjected to convolution integration by the FIR filter of the audio reproducing apparatus corresponding to a picture according to and embodiment of the present invention. The digital audio signal is input to an attenuator 310 and an FIR filter 312. The attenuator 310 attenuates the digital audio signal and outputs it to a delay circuit 311. The delay circuit 311 delays the digital signal by a constant time and supplies the digital signal to the FIR filter 312. The FIR filter adds the input digital audio signal and the signal derived from the delay circuit 311 at an intermediate tap. The FIR filter 312 subjects the input signal to convolution integration together with the impulse response by using a predetermined coefficient.

An example of the impulse response will be described. Since a tap length of the FIR filter 312 is finite, if the FIR filter is formed of a normal FIR filter, then only an impulse response of the tap length thereof is obtained. The impulse response is obtained until a time t1 and then stopped. On the other hand, if the digital signal is delayed by the delay circuit 311 by a time t1, attenuated and input to the FIR filter 312, then the FIR filter 312 outputs the impulse response based on the input. Accordingly, when the direct input signal and the attenuated signal delayed by a time t1 are input to the FIR filter 312, a predetermined impulse response is obtained as an output of the FIR filter 312. Therefore, it is possible to substantially extend the impulse response time.

Figure 34B:
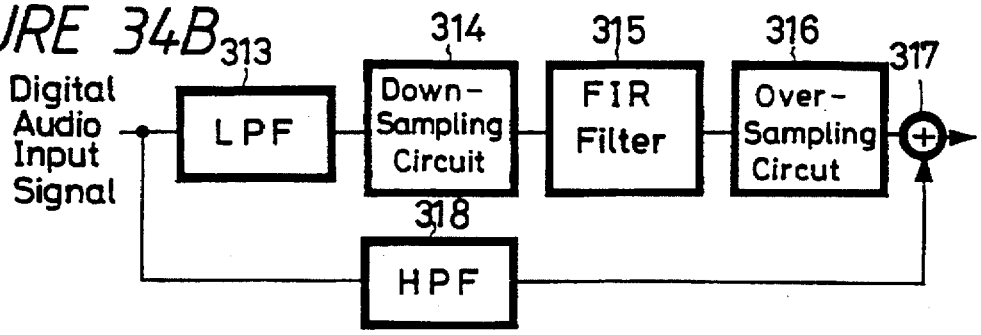

FIG. 34B is a block diagram showing another arrangement of the signal processing unit in which the digital signal and the impulse response are subjected to convolution integration by the FIR filter of the audio reproducing apparatus corresponding to a picture according to the embodiment of the present invention. A digital input signal is input through an input terminal and divided into two signals. One signals of the digital input signal is supplied to a low-pass filter (LPF) 313 for preventing an aliasing distortion from being caused when a down-sampling processing is carried out. The digital signal is supplied therefrom to a down-sampling circuit 314 which carries out the sampling with a sampling frequency that is lower than a frequency of the input digital signal.

The sampled digital signal is supplied to a FIR filter 315. The FIR filter 315 subjects the digital signal to convolution integration together with the impulse response to be realized and supplies the digital signal to an over-sampling circuit 316 which matches the sampling frequency used in the down-sampling circuit 314 with a sampling frequency of the input digital signal. On the other hand, the other signal from the input digital signal is supplied to a high-pass filter (HPF) 318. The HPF 318 extracts only a high frequency band signal from the input signal and supplies the extracted high-band signal to an adder 317. The adder 317 adds the signal output from the over-sampling circuit 316 and the high frequency band signal and outputs the added signal through an output terminal. Since the FIR filter 315 filters the signal after the sampling frequency thereof is lowered, the response time of the impulse response increases as compared with the FIR filter which has the same tap length and filters the signal as it is.

Figure 34C:
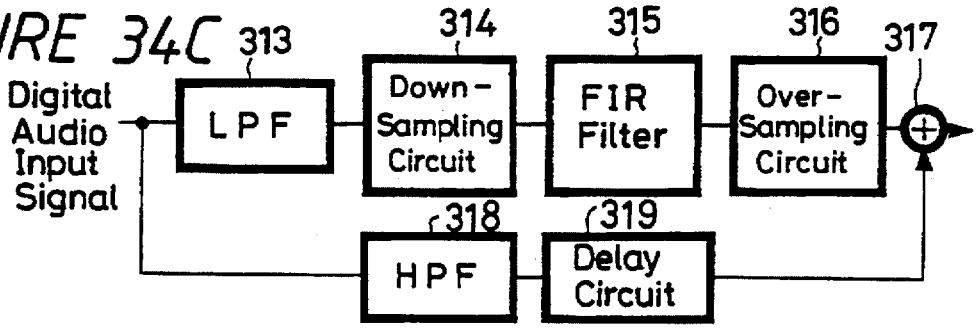

FIG. 34C is a block diagram showing a further arrangement of the signal processing unit in which the digital signal and the impulse response are subjected to convolution integral by the FIR filter of the audio reproducing apparatus corresponding to a picture according to the embodiment of the present invention. A digital input signal is input through an input terminal and divided into two signals. One signals of the digital input signal is supplied to the low-pass filter (LPF) 313 for preventing the aliasing distortion from being caused when the down-sampling processing is carried out. The digital signal is supplied therefrom to the down-sampling circuit 314 which carries out the sampling with the sampling frequency that is lower than the frequency of the input digital signal.

The sampled digital signal is supplied to the FIR filter 315. The FIR filter 315 subjects the digital signal to convolution integration together with the impulse response to be realized, supplying the digital signal to the over-sampling circuit 316 which matches the sampling frequency used in the down-sampling circuit 314 with the sampling frequency of the input digital signal. On the other hand, the other signal of the input digital signal is supplied to the high frequency band filter (HPF) 318. The HPF 318 extracts only a high frequency band signal from the input signal and supplies the extracted high frequency band signal to a delay circuit 319. The delay circuit 319 delays the high frequency band signal by a certain time and supplies the high frequency band signal to the adder 317. The adder 317 adds the signal output from the delay circuit 319 and the signal output from the over-sampling circuit 316 and supplies the added signal through the output terminal. A delay time presented by the delay circuit 319 is set similar to the delay time presented by the FIR filter 315 to thereby match phases of a low-band signal and the high frequency band signal with each other. Alternatively, the high frequency band signal is delayed from the low-band signal by several msec to thereby set the delay time in which a precedence effect prevents the listener from feeling separation of the sound when the listener listens to a sound obtained by reproducing a signal output from the output terminal. Since the FIR filter 315 filters out the signal after the sampling frequency thereof is lowered, the response time of the impulse response increases as compared with the FIR filter which has the same tap length and filters the signal as it is.

Figure 34D:
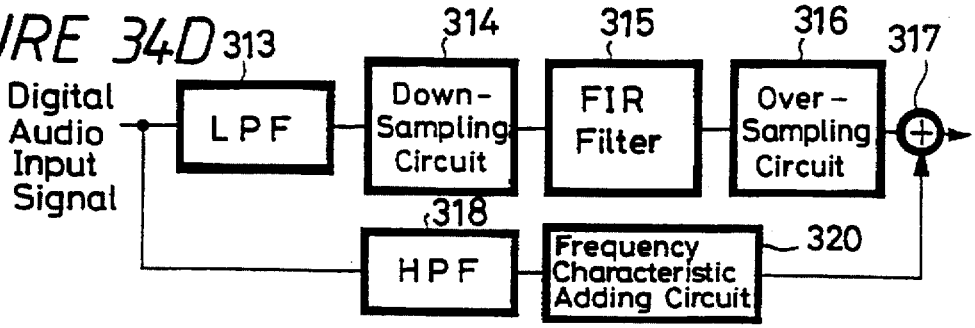

FIG. 34D is a block diagram showing a yet further arrangement of the signal processing unit in which the digital signal and the impulse response are subjected to convolution integration by the FIR filter of the audio reproducing apparatus corresponding to a picture according to the embodiment of the present invention. A digital input signal is input through an input terminal and divided into two signals. One signal from of the digital input signal is supplied to the low-pass filter (LPF) 313 for preventing the aliasing distortion from being caused when the down-sampling processing is carried out. The digital signal is supplied therefrom to the down-sampling circuit 314 which carries out the sampling with the sampling frequency that is lower than the frequency of the input digital signal.

The sampled digital signal is supplied to the FIR filter 315. The FIR filter 315 subjects the digital signal to convolution integration together with the impulse response to be realized, supplying the digital signal to the over-sampling circuit 316 which matches the sampling frequency used in the down-sampling circuit 314 with the sampling frequency of the input digital signal. On the other hand, the other system of the input digital signal is supplied to the high-pass filter (HPF) 318. The HPF 318 extracts only a high frequency band signal from the input signal and supplies the extracted high frequency band signal to a frequency-characteristic adding circuit 320. The frequency-characteristic adding circuit 320 adds the high frequency band signal with the high-band frequency characteristics and supplies the high-band signal to the adder 317. The adder 317 adds the signal output from the frequency-characteristic adding circuit 320 and the signal output from the over-sampling circuit 316 and supplies the added signal through the output terminal. A tap length of the FIR filter 315 required for subjecting the signal to convolution integration together with characteristics of each band is independently selected.

Figure 35:
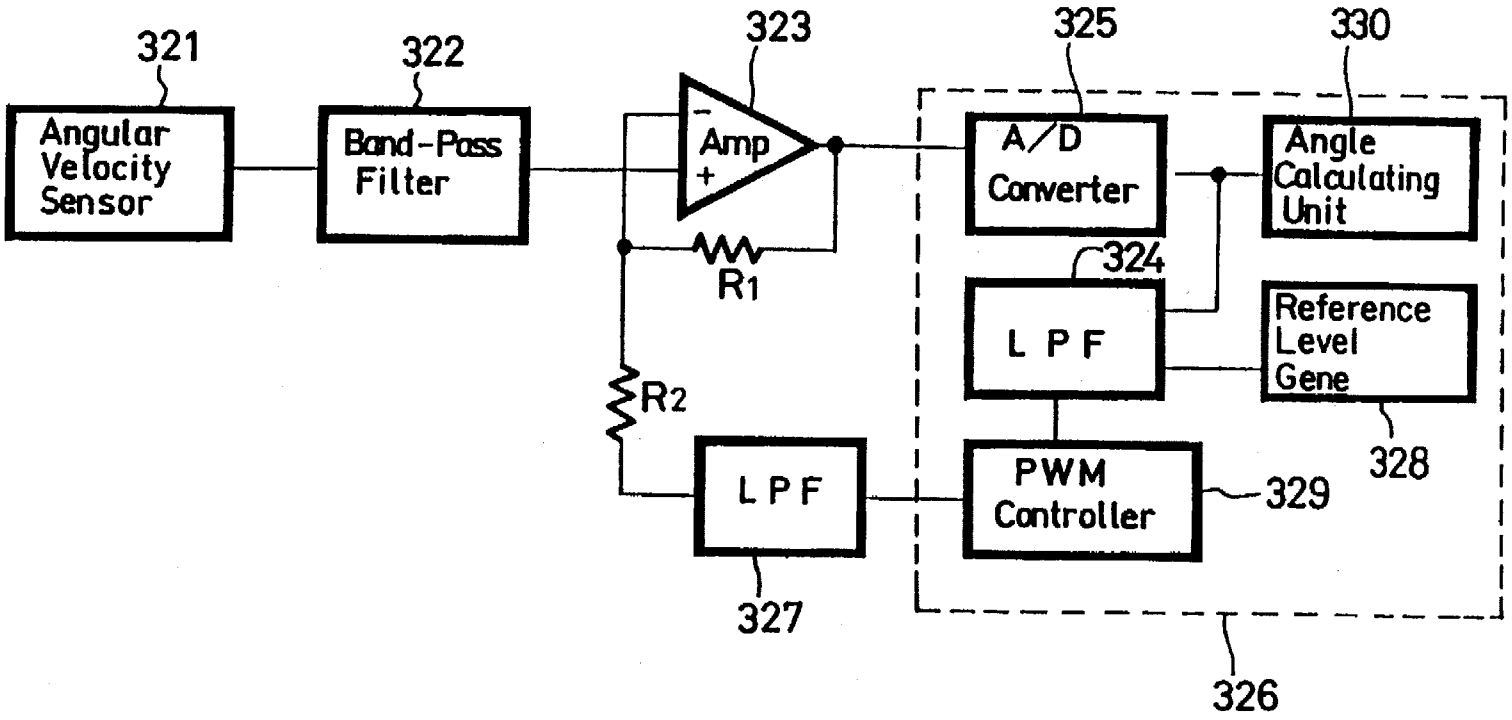
FIG. 35 is a block diagram showing a rotational angle detecting unit of the audio reproducing apparatus corresponding to a picture according to other embodiment of the present invention.

FIG. 35 is a block diagram showing a rotational angle detecting unit of the audio reproducing apparatus corresponding to a picture according to another embodiment of the present invention. As shown in FIG. 35, when a device mounted with an angular velocity sensor 321 is rotated, the angular velocity sensor 321 outputs a signal having a voltage proportional to an angular velocity of the rotation. The output signal is supplied through a band-pass filter 322 to an amplifier 323. The amplifier 323 amplifies the signal and outputs the amplified signal to an A/D converter 325 incorporated in a microprocessor 326. The A/D converter 325 codes the signal and supplies the coded digital signal to a rotational angle calculating unit 330 and a low-pass filter 324 provided in the microprocessor 326 for carrying out a digital signal processing. The LPF 324 derives a low frequency band component from the signal output from the A/D converter 325 based on a comparison with a reference level signal from a reference level generator 328 and provide an output to a pulse width modulation (PWM) control unit 329. The pulse width modulated (PWM) control unit 329 outputs a PWM signal in response to an output value of the LPF 324 to the outside of the microprocessor 326. The output PWM signal is smoothed by a lowpass filter (LPF) 327 and supplied to the amplifier 323 as a negative feedback signal. While the A/D converter 325 is provided in the microprocessor 326 in this arrangement, the A/D converter 325 may be provided independently of the microprocessor 326. The LPF 324 in this arrangement is a digital LPF.

According to the arrangement shown in FIG. 35, even when a DC component of an output level of the angular velocity 321 as the rotational angle detecting unit and a DC component output from the amplifier 323 are offset or fluctuated and even when the A/D converter 325 makes a conversion error or fluctuation, the LPF 324 as low-frequency component detecting means extracts a DC component from coded signal data from the A/D converter 325, compares the extracted DC component and the reference level signal, and supplies a compared result of to the PWM control unit 329 which converts the result into the PWM signal and supplies the PWM signal through the LPF 327 as the low frequency component detecting means to the amplifier 323 as the negative feedback signal. Therefore, it is possible to remove offset DC components from the angular velocity sensor 321 as the rotational angle detecting means and the amplifier 323 and further remove the conversion error and fluctuation of the A/D converter 325 at the same time. Since an output level of the A/D converter 325 obtained when the angular velocity sensor 321 is not moved can be set arbitrarily, the output level thereof obtained when the angular velocity sensor 321 is not moved can be set within the widest portion of the dynamic range of the A/D converter 325. For example, when a 16-bit A/D converter 325 is used, it is possible to set the input level obtained when the angular velocity sensor 321 is not moved and a maximum positive side input level to "$0000" and "$8000" in a unit of two's complement. Then, the dynamic range of the A/D converter 325 is most widest. Moreover, it is possible to optionally set a time constant of the LPF 324 used for detecting the DC component by changing software. Hence, since a hardware does not require a large-capacity capacitor, the rotational angle detecting unit costs inexpensive and can be miniaturized.

According to the embodiment shown in FIG. 1, the audio reproducing apparatus corresponding to a picture includes the audio reproducing apparatus body 1 for subjecting the two-channel audio signals corresponding to a picture and supplied from the external analog sound signal source 2, i.e., the laser disc 66 to a predetermined signal processing, a projector 67 as the video signal reproducing means for reproducing the video signal, the screen 68, and the headphone 24 as the audio reproducing means for reproducing the audio signal processed by the audio reproducing apparatus body 1 in the direction corresponding to the picture reproduced by the television monitor 92. The audio signals are corrected by the convolutional integrators 5, 7, 9 and 11 as the control means based on the impulse responses. The control signals representing the sound arrival times and the sound pressure levels are read out from the memory 35 in response to the signal corresponding to a predetermined angle and supplied from the angle detecting means 28, 38. The audio signals are corrected by the control apparatus 50 to 54 and 56 in a real-time fashion based on the control signals such that the audio signals correspond to the head movement of the listener 23. Then, the audio signals are reproduced. Therefore, it is possible to localize the reproduced sound image forward in the direction corresponding to the reproduced picture by using the reproduction sound source of a general-purpose audio device.

According to the embodiment, since the audio reproducing apparatus body 1 and the television monitor 92 shown in FIG. 10 as the video signal reproducing means are formed integrally, it is possible to localize the reproduced sound image forward in the direction corresponding to the reproduced picture without the audio reproducing apparatus body 1 and the television monitor 92 being connected to each other through the cord.

According to the embodiment, since the vibratory gyroscope is used as the angle detecting means 28, 38 for detecting the head movement of the listener 23 relative to the reference direction and position and outputting the detection signal, it is possible to detect the signal indicative of the angle of the head gyration by the small, light vibratory gyroscope in a real-time fashion.

According to the embodiment, the vibratory gyroscope is used as the angle detecting means 28, 38 for detecting the head movement of the listener 23 relative to the reference direction and position and outputting the detection signal. When the audio reproducing apparatus body 1 is energized or when the headphone 24 and the audio reproducing apparatus body 1 are brought in electrical contact with each other, the gyroscope stabilization indicator 58 gives an alarm until the operation of the vibratory gyroscope 70 is stabilized. Therefore, it is possible to detect unstable operation of the vibratory gyroscope 70.

According to the embodiment, the vibratory gyroscope is used as the angle detecting means 28, 38 for detecting the head movement of the listener 23 relative to the reference direction and position and outputting the detection signal. Even after the audio reproducing main body 1 is de-energized, the vibratory gyroscope 70 and/or the peripheral circuits thereof are set in their energized states in order to keep the vibratory scope 70 in its normal state. Therefore, it is possible to keep the vibratory gyroscope 70 in its normal state.

According to the embodiment, since the digital vibratory gyroscope 28 or the analog vibratory gyroscope 38 as the angle detecting means for detecting the head movement of the listener 23 relative to the reference direction and position and outputting the detection signal is provided at one of the left and right housings of the headphone 24 as the audio reproducing means, it is possible to reliably detect the rotational angle of the head.

According to the embodiment, since the digital vibratory gyroscope 28 or the analog vibratory gyroscope 38 as the angle detecting means For detecting the head movement of the listener 23 relative to the reference direction and position and outputting the detection signal is provided at one of the left and right housings of the headphone 24 as the audio reproducing means so as to detect the angle of the horizontal rotation of the head, it is possible to reliably detect the rotational angle of the head.

According to the embodiment, since the digital vibratory gyroscope 28 or the analog vibratory gyroscope 38 as the angle detecting means has reset switch 90 or 91 and the direction in which the listener 23 turns the head is set to the reference direction when the reset switch 90 or 91 is turned on, it is possible to detect the angle of the rotation of the head by the digital vibratory gyroscope 28 or the analog vibratory gyroscope 38 as the angle detecting means with the direction in which the listener 23 turns the head being set to the reference direction.

According to the embodiment, since the digital vibratory gyroscope 28 or the analog vibratory gyroscope 38 as the angle detecting means has the reset switch 90 or 91 and the direction to the front of the television monitor 92 or the screen 68 where the picture is projected by the projector 67 as the video signal reproducing means is set to the reference direction when the reset switch 90 or 91 is turned on, it is possible to detect the angle of rotation of the head by the digital vibratory gyroscope 28 or the analog vibratory gyroscope 38 as the angle detecting means with the direction to the front of the television monitor 92 or the screen 68 where the picture is projected by the projector 67 as the video signal reproducing means being set to the reference direction.

According to the embodiment, since the digital vibratory gyroscope 28 or the analog vibratory gyroscope 38 as the angle detecting means has the reset switch 90 or 91 which are provided on the headband 27 as of the headphone for allowing the listener 23 to actuate the switch by putting the headphone 24 on the head it is possible for the listener 23 to reset the direction toward the front of the television monitor 92 or the screen 68 to the reference direction without operating the audio reproducing apparatus body 1 when putting the headphone 24 on the head.

According to the embodiment, since the headband 27 as the head attachment body for allowing the listener 23 to put the headphone 24 as the audio reproducing means on the head is provided with the supporting bar 95, the supporting body 96, the supporting bar 97, the supporting body 98, the supporting bar 105, the contact portion 106, the supporting body 107 and the contact portion 108 all of which are used to support the headphone units 93, 94, 103 and 104 as the sound generating units such that the headphone units 93, 94, 103 and 104 as the sound generating units are disposed away from the left and right ears 23L, 23R of the listener 23 at an interval enough not to press the left and right ears 23L, 23R, the radiation impedance from the inlets of the external auditory canals thereof outward becomes close to that obtained when the listener 23 does not put the headphone 24 on the head. Therefore, it is possible to facilitate localization of the reproduced sound image and it is possible for the listener 23 to feel more satisfactory when putting the headphone 24 on the head.

According to the embodiment, the headphone units 93, 94, 103 and 104 as the sound generating units are attached to the headband 27 as the head attachment body for allowing the listener 23 to put the headphone 24 as the audio reproducing means on the head such that a center direction of the directions in which the headphone units 93, 94, 103 and 104 radiate the sounds is not parallel to the straight line passing through the left and right ears 23L, 23R of a listener 23. Therefore, it is possible to prevent the noises caused by the reproduced sounds irregularly reflected by the ears of the listeners 23 whose shapes are different depending upon the individual. Moreover, it is possible to facilitate localization of the reproduced sound image.

According to the embodiment, since a part of or the whole of the characteristics for correcting the characteristics inherent in the headphone 24 as the audio reproducing means for reproducing the audio signals are subjected to convolutional integration together with the impulse responses and stored in the memories 6, 8, 10 and 12 as first storage means, it is possible to efficiently process the audio signals without other means for correcting the characteristics inherent in the headphone 24 as the audio reproducing means being provided.

According to the embodiment, since the correcting circuits having a part of or the whole of the characteristics for correcting the characteristics inherent in the headphone 24 as the audio reproducing means for reproducing the audio signals are formed of analog filters, it is possible to efficiently process the audio signals with a simple arrangement.

According to the embodiment, since switching is provided between the mode in which the audio signals are processed by the audio reproducing apparatus body 1 and the bypass mode in which the audio signals are supplied directly to the headphone 24 without the signal processing in the audio reproducing apparatus body 1 and the bypass switch 59 for the above switching is provided, it is possible to optionally switch between the signal processing mode and the bypass mode.

According to the embodiment, since the degree of the added reverberation is independently switched when the audio reproducing apparatus body 1 processes the audio signals and the switch 254 for the above switching is provided, it is possible to process the signals by optionally changing the degree of the reverberation of the reproduced audio signals.

According to the embodiment, since the impulse responses to the sound fields from the virtual sound source position with respect to the reference position and direction of the head of the listener 23 to the left and right ears 23L, 23R of the listener 23, that are fixed, are changed when the audio signals are processed, the reproduced sound field can be changed. The switch 254 for the above change is provided. Therefore, it is possible for the listener 23 to change the sound field to an optional one while listening to the reproduced sounds.

According to the embodiment, when the impulse responses to the sound fields from the virtual sound source position with respect to the reference position and direction of the head of the listener 23 to the left and right ears 23L, 23R of the listener 23, that are fixed, are changed during the processing of the audio signals or when the degree of the added reverberation is switched, the sound field/reverberation indicator 61 indicates the change or the switching. When the reproduction mode is changed to the signal processing mode in which the audio reproducing apparatus body 1 processes the audio signals or to the bypass mode in which the audio reproducing apparatus body 1 does not process the audio signals, the bypass indicator 60 indicates the switching of the reproduction mode. Therefore, it is possible for the listener 23 to easily recognize the change of the sound field, the switching of the reverberation and the switching of the reproduction mode.

According to the embodiment, when the bypass switch 59 for switching the signal processing mode in which the audio reproducing apparatus body 1 processes the audio signals and the bypass mode in which the audio reproducing apparatus body 1 does not process the audio signals, the bypass indicator 60 is switched to its bypass mode side, the indicator 60 indicating the reproduction mode is set in its off or dark state. When the impulse responses to the sound fields from the virtual sound source position with respect to the reference position and direction of the head of the listener 23 to the left and right ears 23L, 23R of the listener 23, that are fixed, are changed during the processing of the audio signals or when the degree of the added reverberation is switched, the sound field/reverberation indicator 61 indicating the change or the switching is set in its off or dark state. Therefore, it is possible for the listener 23 to easily recognize the change of the sound field, the switching of the reverberation and the switching of the reproduction mode.

According to the embodiment, since the two-channel digital audio signals are transmitted between the transmitter 272 and the receiver 280 in the wireless transmission using electromagnetic waves such as infrared rays, it is possible for the listener 23 to listen to the reproduced sounds without the headphone 24 being connected to the audio reproducing apparatus body 1 through the cable.

According to the embodiment, when the two-channel digital audio signals are transmitted between the transmitter 272 and the receiver 280 in the wireless transmission using the electromagnetic waves such as the infrared rays or the like, the wireless effective area indicator 62 is turned on if the receiver 280 is located within the wireless effective area. Therefore, it is possible to recognize whether or not the wireless transmission is effectively carried out.

According to the embodiment, since the input level switch 63 and/or a volume controller for changing the input level in response to the input two-channel audio signals are provided, it is possible to process the input signal by changing the level of the input level to an optional one.

According to the embodiment, since the degree of the added reverberation is changed at the same time when the impulse responses to the sound fields from the virtual sound source position with respect to the reference position and direction of the head of the listener 23 to the left and right ears 23L, 23R of the listener 23, that are fixed, are changed during the processing of the audio signals, the operability is improved. Therefore, it is possible to effectively process the audio signals.

According to the embodiment, since the audio reproducing apparatus body 1 for processing the audio signals is provided with the headphone housing portion 64, it is possible for the audio reproducing apparatus body 1 to serve as the headphone housing portion 64.

According to the embodiment, the angle detecting means 28, 38 as the rotational angle detecting unit has the vibratory gyroscope 71, the two or more amplifiers 73 having different gains for amplifying the signal output from the vibratory gyroscope 71, the A/D converters 75 for converting the signals amplified by the amplifier 73 into the digital signals, and the control circuit 77 for controlling the amplifier 73 and the A/D converter 75 to calculate the rotational angle. The signal output from the vibratory gyroscope 71 is input to at least two or more amplifiers 73 having different gains. The signals output from the amplifiers 73 are respectively coded by the A/D converters having different coding levels and supplied to the control circuit 77. Based on the data value of the control circuit 77, the A/D converter 75 to be used for calculation of the rotational angle is selected. Therefore, it is possible to select the amplifier 73 having an optimum gain and the A/D converter 75 having an optimum coding level.

According to the embodiment, the previously measured impulse response to an impulse signal from the virtual sound source to a measurement point is realized by the FIR filter 312 having the finite tap length. When the input digital audio signals are processed by convolution integral thereof together with the impulse response, the input digital audio signal is divided into two systems. One system is input to the FIR filter 312. The other system is attenuated by the attenuator 310 and supplied to the delay circuit 311. The delay circuit 311 delays the signal by one and/or a plurality of times more than one sampling time and supplied the delayed signal to the FIR filter 312. The FIR filter 312 adds both of the input signals at an addition point provided at the middle tap thereof. Thus, the FIR filter 312 is initially input with the signal which is not delayed, and when it is substantially finished to obtain the impulse response to the above input signal, the FIR filter 312 is input with the delayed signal. Thus, a length of the impulse response becomes doubled. Therefore, it is possible to obtain the long impulse response even by the FIR filter 312 having the short tap length.

According to the embodiment, the input digital audio signal is divided into two signals. One signal is input to the LPF 313. The signal output from the LPF 313 is down-sampled by the down-sampling circuit 314 and supplied to the FIR filter 315. The signal output from the FIR filter 315 is over-sampled by the over-sampling circuit 316 and supplied to the adder 317. The other signal is supplied to the HPF 318 and supplied to the delay circuit 319. The delay circuit 319 delays the signal by a certain time and supplies the delayed signal to the adder 317. The adder 317 adds both of the signals. Thus, a low-frequency band signal of the input audio signal is down-sampled with the low sampling frequency by the FIR filter 315. Accordingly, the length of the impulse response in the band can be increased. For example, if the signal is down-sampled with a ½ sampling frequency thereof, then the response time obtained by the same FIR filter 315 can be doubled. While the input audio signal having the high frequency band signal of the input audio signal is not supplied to the FIR filter 315 but added to the signal output from the FIR filter 315 which processed the low-frequency band signal, the high-frequency band signal is set as a signal having a band higher than 10 kHz to thereby reduce unnatural auditory sensation. Therefore, it is possible to increase the impulse response time realized by the FIR filter 315 and to obtain the long impulse response even by the FIR filter having the short tap length.

According to the embodiment, the input digital audio signal is divided into two signals. One signal is input to the LPF 313. The signal output from the LPF 313 is down-sampled by the down-sampling circuit 314 and supplied to the FIR filter 315. The signal output from the FIR filter 315 is over-sampled by the over-sampling circuit 316 and supplied to the adder 317. The other signal is supplied to the HPF 318 and supplied to the delay circuit 319. The delay circuit 319 delays the signal by a certain time and supplies the delayed signal to the adder 317. The adder 317 adds both of the signals. The high frequency band signal is added after being delayed by a certain time. Accordingly, after the low frequency band signal component in the input audio signals of the sound generating source such as a musical sound is output, the high frequency band signal component thereof is output. In this case, it is possible to elevate the unnatural auditory sensation caused when the sound image is localized without the high frequency band signal component not being processed by the FIR filter 315.

According to the embodiment, the input digital audio signal is divided into two signals. One signal is input to the LPF 313. The signal output from the LPF 313 is down-sampled by the down-sampling circuit 314 and supplied to the FIR filter 315. The signal output from the FIR filter 315 is over-sampled by the over-sampling circuit 316 and supplied to the adder 317. The other signal is supplied to the HPF 318 and supplied to the frequency characteristic adding circuit 320. The frequency characteristic adding circuit 320 supplies the signal added with frequency characteristics to the adder 17. The adder 317 adds both of the signals input thereto. Thus, the digital audio signal has the characteristics approximate to those of a pass band portion of a desired frequency response by applying the required frequency characteristics to the audio signals by the frequency characteristic adding circuit 320. Accordingly, finally, the frequency response of the output signal obtained by adding the low frequency band signal to the high frequency band signal added with the frequency characteristics becomes approximate to the desired frequency characteristics to be reproduced.

According to the embodiment, the vibratory gyroscope 71 is provided as the angular velocity sensor 321. The rotational angle detecting unit has the A/D converter 325 for converting the signal output from the vibratory gyroscope 71 for detecting the head movement into the digital signal, and the microprocessor 326 for controlling the A/D converter 325 to calculate the angle of the gyration relative to the front direction. When the rotational angle is calculated, the LPF 324 formed of the digital filter detects the DC component from the signal supplied to the microprocessor 326, the PWM control unit 329 outputs the PWM signal to the LPF 327, and the LPF 327 smooths the PWM signal and supplies the processed signal to the amplifier 323 as the negative feedback signal. Thus, the offset DC component of the data supplied to the microprocessor is removed. Therefore, it is possible to calculate the rotational angle with the offset DC component being removed.

According to the embodiment, the analog audio signals in respective channels supplied from the analog signal source 2 are converted by the A/D converters 3 into the digital signals. The digital signals are corrected based on the impulse responses stored in the memories 6, 8, 10 and 12 as the first storage means, and then the corrected digital signals are added. The added digital signals are processed in a real-time fashion in response to the head movement of the listener 23 based on the control signals representing the sound arrival times and the sound pressure levels in response to the angle detected by the digital vibratory gyroscope 38 or the analog vibratory gyroscope 28 as the angle detecting means. The processed digital audio signals are converted into the analog audio signals which are reproduced by the headphone 24 as the audio reproducing means. Therefore, it is possible to correct the audio signals with a simple arrangement only by correcting the two-channel audio signals.

According to the embodiment, the vibratory gyroscope 71 is provided as the angle detecting means 28 or 38. The analog signal output from the vibratory gyroscope 71 is amplified by the amplifier 73 and then converted by the A/D converter 75 into the digital signal which is supplied to the control circuit 77. The control circuit 77 calculates the rotational angle based on the supplied digital signal. When the audio signals are processed based on the calculated results, a value of data indicative of the angle is updated only when a change amount of the calculated angle exceeds a certain value. If an angle of the actual head gyration is different from the rotational angle obtained by calculation, then it is possible to rest the angle to the angle of the front direction at a predetermined speed only when the calculated rotational angle has a deviation smaller than a certain angle relative to the front direction. Specifically, when the picture is within the eyesight of the listener 23, i.e., when it is assumed that the listener 23 is watching the picture, by resetting the calculated rotational angle to the angle of the front direction (0°), it is possible to reduce a positional difference between the picture position and the sound image position. Conversely, when it is apparently assumed that the listener 23 is not watching the picture, i.e., when the calculated rotational angle exceeds the certain angle relative to the front direction, it is possible to reduce an error caused by the reset operation since the calculated rotational angle is not reset to the angle of the front direction.

According to the embodiment, since the convolution integration method is used when the control apparatus 50 to 54 and 56 as the control means correct the audio signals based on the impulse responses, it is possible to accurately process the audio signals.

According to the embodiment, when a plurality of convolutional integrators 5, 7, 9 and 11 are used so that the control apparatus 50 to 54 and 56 as the control means can correct the audio signals based on the impulse responses, the audio reproducing apparatus corresponding to a picture has a self-check function for checking whether or not each of the convolutional integrators 5, 7, 9 and 11 functions normally. Therefore, it is possible to previously check the functions of the convolutional integrators 5, 7, 9 and 11 before the signal processings.

According to the embodiment, even if the audio reproducing apparatus body 1 is de-energized, it is possible to reproduce the audio signals with the same setting contents when the audio reproducing apparatus body 1 is newly energized since various setting values previously selected are stored in a predetermined memory. Therefore, it is possible to improve the operability.

According to the embodiment, it is possible to operate the audio reproducing apparatus even when the signal including only the audio signal is input.

According to the embodiment, the headphone 24 has an operation unit. The operation unit is provided with the reset switch 251 for setting the direction, in which the listener 23 turns the head when the reset switch 251 is pressed, to the reference direction, the switch 254 for independently changing the degree of the added reverberation when the audio reproducing apparatus body 1 processes the audio signals, and the switch 254 for changing the reproduced sound field by changing the impulse responses to the sound field from the virtual sound source position with respect to the reference position and direction of the head of the listener 23 to both ears of the listener 23, that are fixed, upon the above signal processing. The headphone 24 further has a signal cable for connecting the audio reproducing apparatus body 1 thereto. The signal cable is used as a supply cable for the angle detecting means 28 or 38 and an output cable therefrom. Therefore, since the signal cable serves as the supply cable for the angle detecting means 28 or 38 and the output cable therefrom and is connected to the audio reproducing apparatus body 1 through one connector provided in the audio reproducing apparatus body 1, it is possible to transmit the signals between the headphone 24 and the audio reproducing apparatus body 1 through one connector.

Since in each of the above-mentioned arrangements a plurality of tables are prepared in the memory 35 and the listener 23 can arbitrary select one of the tables, it is possible to obtain optimum characteristics of the audio signals regardless of the difference among shapes of the heads and auricles of the listeners 23 and the difference among the characteristics of the headphone 24 to be used.

Moreover, if the amount, which is changed in response to the change of the angle θ, of the digitally recorded control signals representing differences in time and level between the sounds obtained at both ears from the virtual sound source position with respect to the reference direction of the head of the listener 23 to both ears is set larger or smaller than standard values thereof depending on the tables, then the amount of the positional change of the sound image relative to the direction in which the listener 23 turns the head is different. Therefore, it is possible to change the perception of the distance from the listener 23 to the sound image.

Since the reverberation signals are added to the audio signals by the reverberation circuits 13, 14 and allows the listener 23 to listen to the reproduced sounds as if they were sounds reflected by a wall of a hall or reverberation sounds. Therefore, it is possible to obtain the presence which allows the listener 23 to feel as if the listener 23 listened to the music in a famous concert hall.

Data shown in FIG. 4 can be obtained as follows. Specifically, impulse sound sources and dummy-head microphones of necessary channel number are disposed at predetermined positions in a suitable room such that a preferable reproduced sound field should be obtained when the sound is reproduced by the headphone 24. In this case, the speakers may be used as sound sources used to measure the impulses.

Positions where sound waves are picked up in each of the ears of the dummy head may be anywhere from the inlets of the external auditory canal thereof to the eardrum thereof. However, the positions should be equal to positions used to obtain the correction characteristics for canceling the characteristics inherent in the headphone to be used.

The control signals can be measured by radiating impulse sounds from the speakers in the respective channels and picking up the radiated impulse sounds with microphones provided in the ears of the dummy head at every constant angle $\Delta\theta$. Accordingly, since one set of impulse responses is obtained per channel at a certain angle $\theta 1$, if the signal sources has five channels, then five sets of control signals, i.e., ten control signals can be obtained per angle. Accordingly, the control signals representing the difference in time between the sounds obtained at the left and right ears and the difference in level therebetween are obtained from the impulse responses.

The correction characteristics for canceling the characteristics inherent in the headphone which is used are calculated in such a manner that the same dummy-head microphones as those used to obtain impulse responses to a sound field are used, a headphone to be used is mounted on the dummy head, and impulse responses having inverted characteristics of impulse responses between the microphones in the respective ears of the dummy head are calculated from inputs from the headphone.

Alternatively, the correction characteristics maybe directly calculated by using adaptive processings such as an LMS (algorithm or the like. Specific correction of characteristics inherent in the headphone can be realized by either subjecting the digital audio signals to the convolution integration with the impulse responses representing the calculated correction characteristics in view of a processing in a time domain or filtering out the analog signal obtained by the D/A conversion by an analog filter having inverted characteristics in view of an analog signal processing at any time from a time when the audio signals are input to a time when the audio signals are supplied to the headphone.

According to the embodiment, since the adaptive processing filters 17, 18 set predetermined target values and correct the characteristics inherent in the headphone 24 such that the values of the characteristics becomes approximate to the target values, it is possible to constantly reproduce the sound to approximate the sound from the sound source even if the headphone 24 is replaced with another ones.

Moreover, while only the direction of the movement of the head of the listener 23 in a horizontal plane is described in the embodiment, the directions of the head movements in the vertical plane and in a plane perpendicular to both the horizontal and vertical planes can be processed similarly.

Even if the one table of data is prepared in the memory 35, it is possible to obtain, by changing the designation of the address of the data, the control data similar to those obtained when a plurality of tables are prepared therein.

The data stored in the table may be limited to a range of a general direction of the head of the listener 23. The angle $\theta$ may be changed at different intervals depending upon the direction of the head such that the angle $\theta$ is set to be changed at an interval of 0.5° in the vicinity of $\theta=0°$ and to be changed at an interval of 3° in the range of $|\theta \geqq 45°|$. As described above, the angle may be set to be the angle through which the listener can perceive that he turns the head. Moreover, speakers disposed near the respective ears of the listener 23 may be substituted for the headphone 24.

In each of the above-mentioned arrangements, the input audio signals may be digitally recorded signals or signals recorded in an analog fashion both of which are picked up in a multichannel stereophonic mode or the like. The angle detection means for detecting the movement of the head of the listener 23 may output a digital signal or an analog signal.

When the characteristics of audio signals supplied to the headphone 24 are changed in synchronism with the movement of the head of the listener 23, the characteristics are changed not continuously in response to the movement of the head of the listener 23 but by reading data from the tables of the memory 35 at either of every constant unit angle and every predetermined angle which are necessary and sufficient for human beings to recognize in accordance with human auditory characteristics. Therefore, the same effect as that achieved when the characteristics of the audio signals are continuously changed can be achieved only by calculation with respect to necessary and sufficient changes in the movement of the head of the listener 23. Accordingly, the storage capacity of the memory 35 can be saved and more high-speed calculations more than required become unnecessary in view of a processing speed of calculations.

Since binaural characteristics from fixed sound sources in the fixed direction are constantly obtained regardless of the gyration of the head of the listener 23, the listener obtains a highly natural localization.

Since the digital signals previously subjected to the convolution integral with the impulse responses by the convolution integrators 5, 7, 9 and 11 and the memories 6, 8, 10 and 12 are controlled by purely electronic correction using the characteristics represented by the digitally recorded control signals representing the difference in time between the sounds obtained at the respective ears and the difference in level therebetween, the characteristics are prevented from being largely deteriorated. Since the characteristics of the audio signals are changed without delay after the listener turns the head, the listener is prevented from feeling such unnaturalness as he feels when using a conventional system.

Since a plurality of tables are prepared in the memory 35 and the listener 23 can optionally select one of them by using the switcher 36, it is possible to obtain the optimum characteristics regardless of the different shapes of the heads and auricles of the listeners 23, the different characteristics of the headphone 24 and so on.

Since the change amounts of the control signals representing the difference in time between the sounds obtained at the respective ears and the difference in level therebetween obtained when the angle $\theta$ is changed are set to be greater or smaller than the standard value depending upon the tables, then amounts of positional changes of the sound images with respect to the head direction of the listener 23 are different from each other. Therefore, it is possible to change perception of distance from the listener 23 to the sound image.

Since the suitable reverberation signals generated by the reverberation circuits 13, 14 are added to the reproduced sounds if necessary, it is possible to obtain the presence which allows the listener to feel as if he listened to the music in a famous concert hall. Moreover, the adaptive processing filters 17, 18 may set target values of possible sound fields to set the actual sound field.

According to the embodiment, since the adaptive processing filters 17, 18 set predetermined target values and correct the characteristics inherent in the headphone 24 by making the values of the characteristics approximate to the target values such that the sound field becomes approximate to a predetermined sound field, it is possible to reproduce optional sound fields such as a specific theater, a specific concert hall or the like.

According to the embodiment, since the signals are corrected in response to the respective gyrations of the head of a plurality of listeners 23 by using the control signals representing the difference in time between the sounds obtained at the respective ears and the difference in level therebetween, the signals can be reproduced by a plurality of headphones 24 simultaneously and it is unnecessary to prepare the expensive A/D converters 3 and the convolution integrators 5, 7, 9 and 11 which are as many as the number of the listeners 23. Therefore, the apparatus can be arranged with considerably reduced costs.

According to the embodiment, since the vibratory gyroscope suitable for detection of the gyration of the head is used, it is possible for a head gyration detection unit to be small and light, to have low consumed power and long lifetime, and further to be easy to handle and inexpensive.

Moreover, since the vibratory gyroscope does not utilize an inertial force but is operated by a Coriolis force, it is unnecessary to dispose the vibratory gyroscope in the vicinity of a center of the gyration of the head of the listener 23 and hence the vibratory gyroscope may be attached to any portion of the gyration detection unit. Therefore, it is possible to simplify its arrangement and fabrication.

The present invention is not limited to the above-mentioned embodiments and the following arrangements may be employed.

In the audio reproducing apparatus corresponding to a picture, the reset switch for resetting the head movement detecting unit and/or the front direction, the volume controller, the volume balance controller, the sound filed switch, the reverberation switch for changing the degree of the added reverberation, the switch for selecting the bypass mode or the signal processing mode, and the headphone characteristic correcting circuits may be arranged so as to be attached to any headphones after the headphones are manufactured.

In the audio reproducing apparatus corresponding to a picture, there may be provided a switch for selecting an optional menu on a picture displayed on a screen by the head movement of the listener.

In the audio reproducing apparatus corresponding to a picture, the microphone disposed in the vicinity of the earhole and an inverting amplifier may be provided to actively cancel the extraneous noise by adding the signal output from the inverting amplifier to the input signal of the audio reproducing apparatus to reproduced the added signal.

In the audio reproducing apparatus corresponding to a picture, the following arrangement may be employed: a first apparatus for outputting a signal obtained by correcting the audio signal based on the impulse responses by the control apparatus or an external processed signal and an input terminal for inputting the corrected signal or the external processed signal are provided, the control signal representing the sound arrival time and the sound pressure levels of the audio signal are supplied based on the signal corresponding to the angle detected by the angle detecting means, and the output audio signal is reproduced through the audio reproducing means so as to correspond to the head movement of the listener in a real-time fashion based on the control signal.

In the audio reproducing apparatus corresponding to a picture, the following arrangement may be employed: a first apparatus modulating and outputting as the electromagnetic waves such as the infrared rays or the like the signal obtained by correcting the audio signal based on the impulse responses by the control apparatus, an input terminal for inputting the signal thereto and a demodulator are provided, the control signal representing the sound arrival time and the sound pressure levels of the audio signal are supplied based on the signal corresponding to the angle detected by the angle detecting means, and the output audio signal is reproduced through the audio reproducing means so as to correspond to the head movement of the listener in a real-time fashion based on the control signal.

In the audio reproducing apparatus corresponding to a picture, the following arrangement may be employed: a switch for selecting a signal obtained by correcting the audio signal based on the impulse responses by the control apparatus or an external processed signal is provided, the control signal representing the sound arrival time and the sound pressure levels of the audio signal are supplied based on the signal corresponding to the angle detected by the angle detecting means, and the selected signal is reproduced through the audio reproducing means so as to correspond to the head movement of the listener in a real-time fashion based on the control signal.

In the audio reproducing apparatus corresponding to a picture, the following arrangement may be employed: a signal obtained by correcting the audio signal based on the impulse responses by the control apparatus or an external processed signal is transmitted or modulated and then transmitted, the transmitted signals is received and/or demodulated, the control signal representing the sound arrival time and the sound pressure levels of the audio signal are supplied based on the signal corresponding to the angle detected by the angle detecting means, the transmitted signal is reproduced through the audio reproducing means so as to correspond to the head movement of the listener in a real-time fashion based on the control signal, and thus the bidirectional transmission canbe carried out so that broadcasting and/or communication systems corresponding to a picture and/or broadcasting and/or communication for providing the presence are carried out.

In the audio reproducing apparatus corresponding to a picture, when the audio signals in the respective channels supplied from the analog signal source are converted into the digital signals, the digital signals are corrected based on the impulse responses stored in the storage means and the corrected signals are controlled in response to the head movement, the virtual sound source may be reproduced at positions reverse to the position thereof in the front and rear directions and the left and right directions by correcting the control signals representing the sound arrival times and the sound pressure levels and responding to the opposite movement of the head movement, and/or a switch for changing the position in the front and rear directions and the left and right directions may be provided.

In the audio reproducing apparatus corresponding to a picture, the following arrangement may be employed: the audio signals in respective channels supplied from the analog signal source are converted by the A/D converters into the digital signals, and when the audio signals corrected based on the impulse responses stored in the storage means are corrected in response to the head movement, the audio signals are corrected based on only the control signals representing the corrected sound arrival time or the corrected sound pressure levels such that the virtual sound source can be reproduced at a position equivalent to that obtained when the audio signals are corrected based on only the control signals representing the sound arrival time and the sound pressure levels.

The audio reproducing apparatus corresponding to a picture may be formed integrally together with an amusement apparatus.

The audio reproducing apparatus corresponding to a picture may be added with a joy stick, a mouse, a track ball, a data grove, a data suit, an external remote commander device and/or a sound generator to arrange a virtual reality system.

In the audio reproducing apparatus corresponding to a picture, the speakers fixed to a reproducing apparatus maybe used.

In the audio reproducing apparatus corresponding to a picture, a magnetic sensor may be used as a sensor for detecting the head movement.

In the audio reproducing apparatus corresponding to a picture, a magnetic sensor may be used as a sensor for detecting the head movement other than the vibratory gyroscope.

In the audio reproducing apparatus corresponding to a picture, an acceleration sensor and/or an angular acceleration sensor and a double integrator may be used as a sensor for detecting the head movement.

In the audio reproducing apparatus corresponding to a picture, the following arrangement may be employed: the audio signals are corrected based on the impulse responses calculated by the convolutional integrators previously or in a real-time fashion, the control signals representing the sound arrival time and the sound pressure level are calculated previously or in a real-time fashion based on a signal corresponding to the angle detected by the angle detecting unit, the corrected audio signals are corrected based on the control signals in response to the head movement of the listener, and then the audio signals are reproduced through the audio reproducing means.

In the audio reproducing apparatus corresponding to a picture, the following arrangement may be employed: the audio signals are corrected based on the impulse responses calculated by the convolutional integrators from measured values previously or in a real-time fashion, the control signals representing the sound arrival time and the sound pressure level are calculated from measured values of the audio signals previously or in a real-time fashion based on a signal corresponding to the angle detected by the angle detecting unit, the corrected audio signals are corrected based on the control signals in response to the head movement of the listener, and then the audio signals are reproduced through the audio reproducing means.

In the audio reproducing apparatus corresponding to a picture, a vibrator made of a non-metal material may be used as a vibrating body of the vibratory gyroscope for detecting the head movement.

In the audio reproducing apparatus corresponding to a picture, both of lateralized and localized sound images may be reproduced at the same time by adding signals subjected to the signal processings therein with signals which are not subjected to the signal processings.

In the audio reproducing apparatus corresponding to a picture, when the audio signals in respective channels supplied from the analog signal source are converted by the A/D converters into the digital signals and the digital signals are corrected based on the impulse responses stored in the storage means, the audio signals may be corrected by means which, when the digital signal sequence converted by the A/D converter to have a certain length and the impulse responses are subjected to Fourier transformation to become signals in a frequency domain and the signals in the frequency domain are multiplied, subjects a result of multiplication to an inverse Fourier transform to obtain a signal in a time domain again.

The audio reproducing apparatus corresponding to a picture may be formed integrally together with apparatus (a compact disc (CD) player, a mini disc (MD) player, a digital audio tape (DAT) player, a digital compact cassette (DCC) player, etc.) for outputting the digital signals to process and output the digital signals.

In the audio reproducing apparatus corresponding to a picture, an effective sound field may be obtained even when the audio signals are reproduced by the speakers, by processing the signals as described above upon reproduction through the headphone and by storing different programs and data in the signal processing unit upon reproduction by the speakers.

The audio reproducing apparatus corresponding to a picture may be combined with a high definition television receiver or a stereoscopic video apparatus using a movie and a liquid crystal shutter.

The audio reproducing apparatus corresponding to a picture may be combined with a head mount display (HMD) apparatus.

The audio reproducing apparatus corresponding to a picture may be used in a theater having a large-sized screen, a mini theater, a theater having a domed screen, a drive-in theater, and so on.

In the audio reproducing apparatus corresponding to a picture, the audio signals may be corrected not only in response to the head gyration of the listener but also in response to the three-dimensional movement.

The audio reproducing apparatus corresponding to a picture may be applied to a "tele-existence" in which a number of listeners using the audio reproducing apparatus corresponding to a picture collaborate in a common virtual field.

The audio reproducing apparatus corresponding to a picture may be applied to a virtual amusement which provides a bodily sensation and a 360° -screen and in which a number of persons play in a common virtual field with watching the screen and enjoying the bodily sensation.

The audio reproducing apparatus corresponding to a picture may be applied to a TV conference in which a large number of persons using the audio reproducing apparatus corresponding to a picture have discussion around a virtual table.

In the audio reproducing apparatus corresponding to a picture, a source corresponding to a simulation apparatus for generating a vibration or the like in synchronism with the audio reproducing apparatus corresponding to a picture and/or a source in which a signal used for providing a bodily sensation are recorded so as to correspond to video and audio signals may be used.

The audio reproducing apparatus corresponding to a picture may be applied to a flight simulator with a simulation apparatus for providing a movement of a cockpit thereof, a vibration and so on.

The audio reproducing apparatus corresponding to a picture may be applied to a telerobotics as a system in which a man remote-controlling a remote-controlled robot listens to sounds picked up by microphones positioned at both ears of the robot.

In the audio reproducing apparatus corresponding to a picture, when a power switch thereof is turned on or off, when the switch for varying the degree of the reverberation added upon the signal processing is operated, when the switch for switching the signal processing mode and the bypass mode is operated, and when the switch for changing the impulse response to the sound field from the virtual sound source position with respect to the reference position of the head of the listener to the both ears of the listener upon the signal processing is operated, the audio signals may be muted in order not to produce noise.

In the audio reproducing apparatus corresponding to a picture, supporting members for supporting the sound generating units such that the sound generating units are disposed at an interval enough for preventing the sound generating units from pushing the ears of the listener, and pads which are made of an elastic material such as polyurethane foam or the like and can be detachably attached or fixed thereto may be provided at the head attachment body for allowing the listener to put the headphone on the head, and the pads may be covered with thin hides.

Having described preferred embodiments of the present invention with reference to the accompanying drawings, it is to be understood that the present invention is not limited to those precise embodiments and that various changes and modifications can be effected therein by one skilled in the art without departing from the spirit or scope of the invention as defined in the appended claims.

What is claimed is:

1. An apparatus for reproducing an audio signal corresponding to a video signal comprising:

audio reproducing means comprising an attachment body attached to a listener's head and angle detecting means for detecting a movement of the listener's head with respect to a reference position and a reference direction at predetermined angular increments; and a signal processing unit for subjecting an audio signal corresponding to a video signal and supplied from an external signal source to a predetermined signal processing comprising first storage means for storing a measured result of an impulse response from a virtual sound source position with respect to said reference position and reference direction of the listener's head to both ears of the listener, second storage means for storing a control signal in response to measured results of an arrival time and a sound pressure level of an audio signal from a virtual sound source position with respect to said reference position and reference direction and outputting a signal, A/D converting means for converting the audio signals in respective channels supplied from said signal source to digital signals, correcting means for correcting the digital signals from said A/D converting means based on an impulse response stored in said first storage means in response to an output signal from said angle detecting means and for correcting the digital signals based on a control signal stored in said second storage means, D/A converting means for converting digital signals output from said correcting means into two-channel analog signals, and amplifying means for amplifying the analog signals from said D/A converting means, wherein the audio signals corrected by said signal processing unit in response to the movement of the listener's head are reproduced through said audio reproducing means so as to be localized in the direction corresponding to a reproduced video signal being viewed by the listener.

2. An apparatus for reproducing an audio signal corresponding to a video signal according to claim 1, wherein said angle detecting means comprises a vibratory gyroscope.

3. An apparatus for reproducing an audio signal corresponding to a video signal according to claim 2, wherein said signal processing unit comprises display means and wherein when said signal processing unit is energized or when said audio reproducing means and said signal processing unit are brought in electrical communication with each other, said display means displays an alarm until an operation of said vibratory gyroscope is stabilized.

4. An apparatus for reproducing an audio signal corresponding to a video signal according to claim 2, wherein when a supply of power to said signal processing unit is interrupted, said signal processing unit supplies power to at least said vibratory gyroscope and peripheral circuits of said vibratory gyroscope so that said vibratory gyroscope maintains a normal state.

5. An apparatus for reproducing an audio signal corresponding to a video signal according to claim 2, wherein said angle detecting means further comprises a plurality of applying means having different respective gains for amplifying an output signal from said vibratory gyroscope, a plurality of A/D converting means for subjecting output signals from said amplifying means to A/D conversion, and calculating means for calculating a rotational angle of the listener's head based on digital output signals from said A/D converting means.

6. An apparatus for reproducing an audio signal corresponding to a video signal according to claim 5, wherein said angle detecting means further comprises selection means for selecting an output signal for use in said calculation of said rotational angle in said calculating means from said digital output signals from said A/D converting means based on a calculated result from said calculating means.

7. An apparatus for reproducing an audio signal corresponding to a video signal according to claim 2, wherein said angle detecting means further comprises variable gain amplifying means for amplifying an output signal from said vibratory gyroscope, a plurality of A/D converting means for subjecting output signals from said amplifying means to A/D conversion, calculating means for calculating a rotational angle of the listener's head based on output signals from said A/D converting means, and switching means for switching gains of said variable gain amplifying means based on an output signal from said calculating means.

8. An apparatus for reproducing an audio signal corresponding to a video signal according to claim 2, wherein said angle detecting means further comprises amplifying means for amplifying an output signal from said vibratory gyroscope, a plurality of A/D converting means for subjecting output signals from said amplifying means to A/D conversion, arithmetic means for calculating a rotational angle of the listener's head based on output signals from said A/D converting means, extracting means for extracting a DC component from the output signals from said A/D converting means, DC component removing means for removing a DC component removing means from a signal supplied to said calculating means from said A/D converting means in response to an output of said extracting means.

9. An apparatus for reproducing an audio signal corresponding to a video signal according to claim 8, wherein said DC component removing means comprises pulse width modulating means and negative feedback means, wherein an output signal from said pulse width modulating means is smoothed in response to an output signal from said extracting means, and a smoothed signal is fed as a negative feedback through said negative feedback means to an input of said amplifying means.

10. An apparatus for reproducing an audio signal corresponding to a video signal according to claim 1, wherein said audio reproducing means further comprises a pair of housings and said angle detecting means is provided at one of said pair of housings for detecting an angle of horizontal direction rotation upon movement of the listener's head.

11. An apparatus for reproducing an audio signal corresponding to a video signal according to claim 1, wherein said angle detecting means is provided on said attachment body at a position corresponding to a top of the listener's head when said attachment body is put on the listener's head.

12. An apparatus for reproducing an audio signal corresponding to a video signal according to claim 1, wherein said audio reproducing means further comprises a pair of housing portions opposed to side portions of the listener's head when the said attachment body is attached to the listener's head, and said angle detecting means is provided at one of pair of housing portions.

13. An apparatus for reproducing an audio signal corresponding to a video signal according to claim 1, wherein said angle detecting means includes a reset switch and a direction in which the listener's head turns when said reset switch is operated is set to said reference direction.

14. An apparatus for reproducing an audio signal corresponding to a video signal according to claim 13, wherein said reset switch is provided on said audio reproducing means.

15. An apparatus for reproducing an audio signal corresponding to a video signal according to claim 1, wherein said angle detecting means comprises a reset switch and a direction in which the listener's head turns when said reset switch is operated is set to a reference direction with respect to reproduced video signal being viewed by the listener.

16. An apparatus for reproducing an audio signal corresponding to a video signal according to claim 15, wherein said reset switch is provided at said audio reproducing means.

17. An apparatus for reproducing an audio signal corresponding to a video signal according to claim 1, wherein said audio reproducing means further comprises a pair of audio converting means corresponding to respective ears of the listener and said attachment body comprises holding means for holding said pair of audio converting means at positions away from the respective ears of the listener when said attachment body is attached to the listener's head.

18. An apparatus for reproducing an audio signal corresponding to a video signal according to claim 17, wherein said holding means holds said pair of audio converting means such that a direction from which a sound is output from each of said pair of audio converting means is set to a predetermined angle relative to a straight line passing through both ears of the listener.

19. An apparatus for reproducing an audio signal corresponding to a video signal according to claim 1, wherein said first storage means stores characteristics for correcting characteristics inherent in said audio reproducing means which are subjecting to convolutional integration together with an impulse response.

20. An apparatus for reproducing an audio signal corresponding to a video signal according to claim 1, wherein said signal processing unit further comprises an analog filter for correcting DC offset characteristics of said audio reproducing means.

21. An apparatus for reproducing an audio signal corresponding to a video signal according to claim 1, further comprising selection means for selectively supplying an audio signal output from said external signal source to said audio reproducing means.

22. An apparatus for reproducing an audio signal corresponding to a video signal according to claim 1, wherein said signal processing unit further comprises reverberation adding means supplied with an output signal from said A/D converting means for adding a reverberation sound to the supplied output signal by changing a reverberation time thereof.

23. An apparatus for reproducing an audio signal corresponding to a video signal according to claim 22, wherein said audio reproducing means further comprises a variable operation unit for changing a reverberation sound added by said reverberation adding means of said signal processing unit.

24. An apparatus for reproducing an audio signal corresponding to a video signal according to claim 1, further comprising transmission means for transmitting an output signal from said signal processing unit to said audio reproducing means through wireless transmission.

25. An apparatus for reproducing an audio signal corresponding to a video signal according to claim 1, wherein said audio reproducing means further comprises adjusting means for adjusting an input level of an output signal from said signal processing unit fed to said audio reproducing means.

26. An apparatus for reproducing an audio signal corresponding to a video signal according to claim 1, wherein said signal processing unit further comprises a housing portion for housing said audio reproducing means.

27. An apparatus for reproducing an audio signal corresponding to a video signal according to claim 1, wherein said correcting means comprises a convolution processing unit for subjecting an output signal from said A/D converting means to convolution processing together with an impulse response read out from said first storage means.

28. An apparatus for reproducing an audio signal corresponding to a video signal according to claim 1, wherein said correcting means comprises a signal processor for subjecting an output signal from said A/D converting means to attenuation and delay processing and an FIR filter supplied with an output signal from said signal processor, said FIR filter being also supplied with the output signal from said A/D converting means at a center one of a plurality of delay means connected in a series and forming said FIR filter, and said output signal from said A/D converting means is subjected to convolution together with an impulse response.

29. An apparatus for reproducing an audio signal corresponding to a video signal according to claim 1, wherein said correcting means comprises dividing means for dividing an output signal from said A/D converting means into two frequency bands and a convolution processing circuit having an FIR filter, said convolution processing circuit sampling a low frequency band component of an output signal from said dividing means with a sampling frequency lower than a sampling frequency of said A/D converting means, and a sampled signal from said convolution processing circuit being subjected by said FIR filter to convolution together with an impulse response read out from said first storage means, added with a signal including a high frequency band component of the output signal from said dividing means, and then output.

30. An apparatus for reproducing an audio signal corresponding to a video signal according to claim 29, wherein said correcting means further comprises processing means for carrying out an over-sampling processing by which an output signal from said FIR filter has the same sampling frequency as a sampling frequency used by said A/D converting means, and an output signal from said processing means and a signal including a high frequency band component of an output signal from said dividing means are added.

31. An apparatus for reproducing an audio signal corresponding to a video signal according to claim 29, wherein said dividing means is formed of a low-pass filter and a high-pass filter, said correcting means further comprises delay means for delaying an output signal from said high-pass filter, and an output signal from said delay means is added with an output signal from said processing means.

32. An apparatus for reproducing an audio signal corresponding to a video signal according to claim 29, wherein said dividing means is formed of a low-pass filter and a high-pass filter, said correcting means further comprises characteristic correcting means for correcting frequency characteristics of an output signal from said high-pass filter, and an output signal from said characteristic correcting means is added with an output signal from said processing means.

33. An apparatus for reproducing an audio signal corresponding to a video signal according to claim 1, wherein said audio reproducing means comprises reset means for resetting said angle detecting means, a setting switch for setting the reference direction to a direction in which the listener's head turns when said reset means is operated, a variable adjustment switch for changing a reverberation time added to a signal output from said signal processing unit, a switch for changing an impulse response stored in said first storage means, a cable for connecting said signal processing unit and said audio reproducing means, and a connection unit provided on an end of said cable for connecting to said signal processing unit.

* * * * *